US007161569B2

(12) United States Patent
Sekiguchi

(10) Patent No.: US 7,161,569 B2
(45) Date of Patent: Jan. 9, 2007

(54) DRIVING METHOD OF LIQUID CRYSTAL DISPLAY PANEL AND LIQUID CRYSTAL DISPLAY DEVICE

(75) Inventor: Kanetaka Sekiguchi, Sayama (JP)

(73) Assignee: Citizen Watch Co., Ltd., Tokyo (JP)

( * ) Notice: Subject to any disclaimer, the term of this patent is extended or adjusted under 35 U.S.C. 154(b) by 350 days.

(21) Appl. No.: 10/169,762

(22) PCT Filed: Jan. 19, 2001

(86) PCT No.: PCT/JP01/00362

§ 371 (c)(1),
(2), (4) Date: Jul. 19, 2002

(87) PCT Pub. No.: WO01/53882

PCT Pub. Date: Jul. 26, 2001

(65) Prior Publication Data

US 2003/0001813 A1 Jan. 2, 2003

(30) Foreign Application Priority Data

Jan. 21, 2000 (JP) ..... 2000-012450

(51) Int. Cl.
*G09G 3/36* (2006.01)

(52) U.S. Cl. ..... 345/87; 345/204

(58) Field of Classification Search ..... 345/87, 345/90, 91, 92, 93, 94, 95, 96, 97, 98, 100, 345/204, 205

See application file for complete search history.

(56) References Cited

U.S. PATENT DOCUMENTS 5,307,084 A * 4/1994 Yamaguchi et al. ..... 345/58
5,627,560 A * 5/1997 Verhulst ..... 345/97
5,982,461 A * 11/1999 Hayashi et al. ..... 349/43
6,181,310 B1 * 1/2001 Nomura ..... 345/97
6,271,819 B1 * 8/2001 Fujita ..... 345/95
6,433,841 B1 * 8/2002 Murade et al. ..... 349/43
6,522,319 B1 * 2/2003 Yamazaki ..... 345/103

FOREIGN PATENT DOCUMENTS

| | | |
|---|---|---|
| EP | 0 318 050 A2 | 5/1989 |
| GB | 2 332 297 | 6/1999 |
| JP | 5-297349 | 11/1993 |
| JP | 6-148599 | 5/1994 |
| JP | 8-304775 | 11/1996 |
| JP | 11-109923 | 4/1999 |
| JP | 2000-2891 | 1/2000 |

* cited by examiner

*Primary Examiner*—Richard Hjerpe
*Assistant Examiner*—Jean Lesperance
(74) *Attorney, Agent, or Firm*—Westerman, Hattori, Daniels & Adrian, LLP.

(57) ABSTRACT

This invention is a driving method of a liquid crystal display panel in which a liquid crystal layer is sealed between a transparent first substrate formed with a plurality of scanning electrodes and a transparent second substrate formed with a plurality of data electrodes, the electrodes being formed on respective inner faces opposing each other, and portions where the scanning electrodes and data electrodes oppose each other with the liquid crystal layer sandwiched therebetween constitute pixel portions respectively, and which performs display by an electrooptical change having a memory property in the liquid crystal layer at each pixel portion, in which selection signals are applied to the plurality of scanning electrodes and a data signal is applied to the data electrode in correspondence with the selection signal of each scanning electrode to control the individual pixel portion independently, and a plurality of selection signals having different selection periods each for selecting one scanning electrode are selectively applied as the selection signals.

29 Claims, 29 Drawing Sheets

DRIVING METHOD OF LIQUID CRYSTAL DISPLAY PANEL AND LIQUID CRYSTAL DISPLAY DEVICE

TECHNICAL FIELD

The present invention relates to a driving method of a liquid crystal display panel which enables a reduction in power consumption by driving a liquid crystal display panel, which performs display by changing optical characteristics thereof by applying voltage to a liquid crystal layer composed of a memory liquid crystal, at a low voltage or by stopping the driving signal in accordance with a driving environment, and a liquid crystal display device whose liquid crystal display panel is driven by the driving method.

BACKGROUND TECHNOLOGY

A liquid crystal display device is composed of a liquid crystal display panel and a drive circuit thereof, and the basic configuration of the liquid crystal display panel is such that a first substrate formed with many scanning electrodes on the inner face and a second substrate formed with many data electrodes, in such a manner to be perpendicular to the scanning electrodes, on the inner face, are bonded together with a fixed gap provided therebetween, a liquid crystal layer is sealed in the gap, and portions where the scanning electrodes and the data electrodes oppose each other with the liquid crystal layer sandwiched therebetween become pixel portions respectively.

As a driving method of this liquid crystal display panel, a method is employed which applies selection signals in a time division manner to all the scanning electrodes constituting the pixel portions of the liquid crystal display panel and applies a data signal to the data electrode in correspondence with the selection signal of each scanning electrode to induce an optical change in the liquid crystal layer at the individual pixel to thereby perform display.

In such a driving method of the liquid crystal display panel, when the number of pixels of the liquid crystal display panel is increased to improve its display quality, the time during which the signal can be applied to one pixel is decreased, and thus it is necessary to increase the voltage of the selection signal or to increase the voltage of the data signal.

Further, since the display disappears if the liquid crystal is not supplied with charge in a predetermined cycle, it is necessary to apply a predetermined voltage in a fixed cycle even for the same display contents. Therefore, an increase in the number of scanning electrodes causes an increase in the frequency for switching the voltage of the selection signal and also an increase in the frequency of the data signal.

The output voltage and the output frequency of a circuit for applying a predetermined selection signal and data signal to the liquid crystal display panel accordingly become higher to increase the power consumption of the liquid crystal display device.

When the liquid crystal display panel is used for a small portable electronic device, however, there is a limit in thickness, weight, and volume of the case thereof and there is also a restriction in battery capacity. Hence, it is required to enable operation for a long time by a battery having a capacity as small as possible.

Further, a liquid crystal display device having a power generating function is scarcely commercialized in the status quo. The reason is that the electric power consumed is very large as compared to the capacity of a storage battery which stores energy therein. Therefore, it is important to allow the liquid crystal display device to function for a time as long as possible by a predetermined battery capacity, and it can be said that it is also preferable for the earth environment.

There is a method, as a method of reducing the power consumption, which does not perform display on a part or the entire face of the liquid crystal display panel, but it is not preferable because a decrease in display area results in a reduction in the display contents.

Hence, it is desired to reduce the electric power consumed while allowing a display to be performed on the entire face of the liquid crystal display panel constituting the liquid crystal display device.

Further, in the case of a liquid crystal display device provided with a power generating element, it is necessary to balance the amount of power generated by the power generating element and the amount of power consumed by the liquid crystal display device, and therefore it is necessary to reduce the power consumption of the liquid crystal display device. Especially when a photovoltaic element is disposed as the power generating element on the observer side of the liquid crystal display panel and at a position adjacent to the liquid crystal display panel, it is necessary to decrease the area of the photovoltaic element and to increase the proportion of transmitting portions around the photovoltaic element to prevent the display quality of the liquid crystal display panel from deteriorating. Thus, it is very important to reduce the power consumption of the liquid crystal display device.

Hence, it is an object of this invention to reduce power consumption while keeping as much as possible display contents displayed on a liquid crystal display panel constituting a liquid crystal display device so as to increase battery life. Specifically, it is an object to attain a reduction in the power consumption without decreasing its display region.

Further, it is another object to substantially reduce power consumption, also in a liquid crystal display device having a power generating function, by appropriately controlling the driving waveform of a liquid crystal display panel to enable driving of the liquid crystal display panel by a power generating element with a small power generation amount which cannot be used in the prior art.

DISCLOSURE OF THE INVENTION

To attain the above-described objects, this invention provides the following driving method of a liquid crystal display panel and liquid crystal display device:

Specifically, the driving method of a liquid crystal display panel according to this invention is a driving method of a liquid crystal display panel in which a liquid crystal layer is sealed between a transparent first substrate formed with a plurality of scanning electrodes and a transparent second substrate formed with a plurality of data electrodes, the electrodes being formed on respective inner faces opposing each other, and portions where the scanning electrodes and the data electrodes oppose each other with the liquid crystal layer sandwiched therebetween constitute pixel portions respectively, and which performs display by an electrooptical change having a memory property in the liquid crystal layer at each pixel portion.

The driving method is characterized in that selection signals are applied to the plurality of scanning electrodes and a data signal is applied to the data electrode in correspondence with the selection signal of each scanning electrode to control the individual pixel portion independently, and a plurality of selection signals having different selection periods each for selecting one scanning electrode are selectively applied as the selection signals.

Further, it is preferable that a liquid crystal layer charge memory period, during which potentials of the scanning electrode and the data electrode are set to the same potential or a floating potential, is provided after each pixel portion within a display region of the liquid crystal display panel is selected at least once and display contents thereof are rewritten.

Alternatively, it is also adoptable that a liquid crystal layer charge memory period is provided after each pixel portion within a display region of the liquid crystal display panel is repeatedly selected and display contents thereof are rewritten a plurality of times.

Further, it is preferable that a refresh period for applying a refresh voltage for canceling unbalance of charge in the liquid crystal layer at the same time to the liquid crystal layer between each of the plurality of scanning electrodes and each of the plurality of data electrodes is provided before the selection period of a first scanning electrode by the selection signal, and voltages of both positive and negative polarities are applied as the refresh voltage by the selection signal and the data signal.

Alternatively, it is also adoptable that a refresh period for applying a refresh voltage for canceling unbalance of charge in the liquid crystal layer to the liquid crystal layer between the scanning electrode and the data electrode associated therewith is provided before the selection period of each scanning electrode by the selection signal, and voltages of both positive and negative polarities are applied as the refresh voltage by the selection signal and the data signal.

It is possible to perform a whole display rewriting in which the selection signal is applied to each of the scanning electrodes constituting all the pixel portions within a display region of the liquid crystal display panel, and the data signal is applied to each data electrode in correspondence with the selection signal of each scanning electrode to thereby rewrite display contents of all the pixel portions. Further, it is also possible to perform a partial display rewriting in which the selection signals are applied only to the scanning electrodes constituting the pixel portions within a display change region where display contents are changed within the display region, the data signals are applied only to the data electrodes associated therewith respectively, and potentials of the scanning electrodes and the data electrodes constituting the pixel portions except for the display change region are set to a floating potential to thereby rewrite a part of display contents of the display region.

In this case, it is preferable that the selection period for selecting one scanning electrode by the selection signal is made longer in the partial display rewriting than in the whole display rewriting.

Further, it is preferable that a potential difference between the scanning electrode to which the selection signal is applied and the data electrode to which the data signal is applied is made smaller in the partial display rewriting than in the whole display rewriting.

It is preferable that when the partial display rewriting is switched to the whole display rewriting, a refresh period for applying a refresh voltage for canceling unbalance of charge in the liquid crystal layer at the same time to the liquid crystal layer between each of the plurality of scanning electrodes and each of the plurality of data electrodes is provided before start of the whole display rewriting, and voltages of both positive and negative polarities are applied as the refresh voltage by the selection signal and the data signal.

Further, it is preferable that a voltage amplitude of at least one of the selection signal and the data signal is decreased as the selection period for selecting one scanning electrode by the selection signal is increased.

It is preferable that a longest selection period for selecting one scanning electrode by the selection signal is 100 milliseconds or more, and it can be, for example, one minute, one hour, one day or the like.

It is desirable that a potential difference between the selection signal to be applied to the scanning electrode and the data signal to be applied to the data electrode when the selection period for selecting one scanning electrode by the selection signal is short is made larger than a potential difference between the selection signal and the data signal when the selection period is long.

Further, it is desirable that the plurality of selection signals having different selection periods are changed after the pixel portions at least within a predetermined region in the display region of the liquid crystal display panel are selected and display contents thereof are rewritten.

It is also possible that the selection signal and the data signal are generated by electric energy generated by a power generating element or by discharge energy of a storage battery for storing the electric energy, and the selection period for selecting one scanning electrode by the selection signal is changed in accordance with an amount of power generated by the power generating element or an amount of power stored in the storage battery.

In this case, it is preferable that the selection period for selecting one scanning electrode by the selection signal is made shorter and a potential difference between the selection signal to be applied to the scanning electrode and the data signal to be applied to the data electrode is made larger when the amount of power generated by the power generating element or the amount of power stored in the storage battery is large than when it is small.

Further, the plurality of selection signals are switched at a set point of time, and one selection signal of the plurality of selection signals has a period during which a potential thereof to the data signal is positive and a period during which the potential is negative in the selection period of one scanning electrode, which makes it possible to prevent unbalance of charge in the liquid crystal layer by using the selection signal to eliminate the necessity for providing the refresh period.

Alternatively, it is more preferable that one selection signal of the plurality of selection signals has a period during which a potential thereof to the data signal is positive and a period during which the potential is negative in the selection period of one scanning electrode, and an order of the period during which the potential of the selection signal to the data signal is positive and the period during which the potential is negative is reversed in a field and in the next field.

Alternatively, it is also adoptable that each selection signal applies voltages of the same polarity during the period for selecting each scanning electrode in a sequential plurality of fields, and thereafter applies voltages of both positive and negative polarities during the period for selecting one scanning electrode in the next field.

It is preferable that in a mode of reducing power consumption, voltages of one polarity to the data signal are applied as the selection signal during the selection period of each scanning electrode by the selection signal, and a refresh period for applying a refresh voltage for canceling unbalance of charge in the liquid crystal layer at the same time to the liquid crystal layer between each of the plurality of scanning electrodes and each of the plurality of data electrodes is provided before the selection period of a first scanning electrode by the selection signal, and voltages of both positive and negative polarities are applied as the refresh voltage by the selection signal and the data signal.

Alternatively, it is also adoptable that in another mode of reducing power consumption, there are provided a field, in which voltages of one polarity to the data signal are applied as the selection signal during the selection period of the scanning electrode by the selection signal, and a field, in which voltages of both positive and negative polarities are applied, and a refresh period for applying a refresh voltage for canceling unbalance of charge in the liquid crystal layer at the same time to the liquid crystal layer between each of the plurality of scanning electrodes and each of the plurality of data electrodes is provided before the selection period of a first scanning electrode by the selection signal, and voltages of both positive and negative polarities are applied as the refresh voltage by the selection signal and the data signal.

In this case, it is preferable that the selection period of one scanning electrode is made longer in the field, in which the voltages of both positive and negative polarities to the data signal are applied as the selection signal, than in the field, in which the voltages of one polarity are applied, and absolute values of the voltages of both polarities are made equal to absolute values of the voltages of one polarity.

Next, the liquid crystal display device according to this invention comprises: a liquid crystal display panel in which a liquid crystal layer is sealed between a transparent first substrate formed with a plurality of scanning electrodes and a transparent second substrate formed with a plurality of data electrodes, the electrodes being formed on respective inner faces opposing each other, and portions where the scanning electrodes and data electrodes oppose each other with the liquid crystal layer sandwiched therebetween constitute pixel portions respectively, and which performs display by an electrooptical change having a memory property in the liquid crystal layer at each pixel portion; and a liquid crystal display panel drive circuit for applying selection signals to the plurality of scanning electrodes and applying a data signal to the data electrode in correspondence with the selection signal of each scanning electrode to control the individual pixel portion independently, and for selectively applying, as the selection signals, a plurality of selection signals each having different selection periods for selecting one scanning electrode.

It is possible to use, as the liquid crystal layer performing an electrooptical change having a memory property, a chiral nematic liquid crystal layer, a ferroelectric liquid crystal layer, an antiferroelectric liquid crystal layer, a scattering type liquid crystal layer composed of a ferroelectric liquid crystal and a transparent solid substance containing a ferroelectric liquid crystal, and the like.

It is also possible that such a liquid crystal display device further comprises a power generating element, and the liquid crystal display panel drive circuit is a circuit for generating the selection signal and the data signal by electric energy generated by the power generating element or by discharge energy of a storage battery for storing the electric energy, and has means for changing the selection period for selecting one scanning electrode by the selection signal in accordance with an amount of power generated by the power generating element or an amount of power stored in the storage battery.

It is preferable that when the power generating element is a photovoltaic element, the photovoltaic element is provided on the visible side of the liquid crystal display panel and a reflection type polarizer is provided on the visible side of the liquid crystal display panel or the opposite side thereto to reflect incident light from outside toward the photovoltaic element by the reflection type polarizer.

It is preferable to provide the liquid crystal display panel drive circuit with means for making a potential difference between the selection signal and the data signal larger when the selection period by the selection signal is short than when the selection period is long, and to provide an operation member (selection button) for causing, from outside, the liquid crystal display panel drive circuit to select the selection signal having a different selection period.

In a liquid crystal display device provided with a power generating element, it is preferable to provide the liquid crystal display panel drive circuit with means for making a potential difference between the selection signal and the data signal larger when the selection period by the selection signal is short than when the selection period is long as well as for making the potential difference smaller when an amount of power generated by the power generating element is small than when the amount of power generation is large, and to provide an operation member (power-saving mode switching button) for forcing, from outside, the liquid crystal display panel drive circuit to increase the selection period by the selection signal and to decrease the potential difference.

The liquid crystal display panel of the liquid crystal display device according to this invention may be a liquid crystal display panel, in which transparent first and second substrates are disposed with inner faces opposing each other, a plurality of scanning electrodes and a plurality of signal electrodes are formed to be perpendicular to each other as well as a pixel electrode is formed for every isolated region surrounded by the scanning electrodes and the signal electrodes on the inner face of one of the substrates, an opposed electrode is formed on the inner face of the other of the substrates, a liquid crystal layer is sealed between the first substrate and the second substrate, portions where the pixel electrodes and the opposed electrode oppose each other with the liquid crystal layer sandwiched therebetween constitute pixel portions respectively, and a switching element which is ON/OFF controlled by the selection signal applied to each scanning electrode is provided between the signal electrode and the pixel electrode in the vicinity of an intersection of each scanning electrode and signal electrode, and which performs display by an electrooptical change having a memory property in the liquid crystal layer at each pixel portion.

Alternatively, the liquid crystal display panel may be a liquid crystal display panel, in which transparent first and second substrates are disposed with inner faces opposing each other, a plurality of signal electrodes and many pixel electrodes adjacent to the signal electrodes are formed on the inner face of one of the substrates, a plurality of scanning electrodes perpendicular to the signal electrodes and opposing the pixel electrodes are formed on the inner face of the other of the substrates, a liquid crystal layer is sealed between the first substrate and the second substrate, portions where the pixel electrodes and the scanning electrodes oppose each other with the liquid crystal layer sandwiched therebetween constitute pixel portions respectively, and a switching element is provided between the signal electrode and each pixel electrode, and which performs display by an electrooptical change having a memory property in the liquid crystal layer at each pixel portion.

The liquid crystal display panel drive circuit for driving these liquid crystal display panels is also a circuit for applying selection signals to the plurality of scanning electrodes and applying a data signal to the signal electrode in correspondence with the selection signal of each scanning electrode to control the individual pixel portion independently, and for selectively applying, as the selection signals, a plurality of selection signals each having different selection periods for selecting one scanning electrode.

It is preferable that each pixel portion of these liquid crystal display panels is provided with a storage element such as a capacitor or the like connected in series to the switching element and in parallel to the liquid crystal layer constituting the pixel portion.

It is possible to use, as the switching element, a thin film transistor with a semiconductor layer of polysilicon or a thin film diode composed of an amorphous silicon film.

BEST MODE FOR CARRYING OUT THE INVENTION

Hereinafter, preferred embodiments for carrying out the invention will be explained with reference to the drawings.

First Embodiment: FIG. 1 to FIG. 12

First of all, a configuration of a first embodiment of a liquid crystal display device according to the invention is explained using FIG. 1 to FIG. 4.

Figure 1:
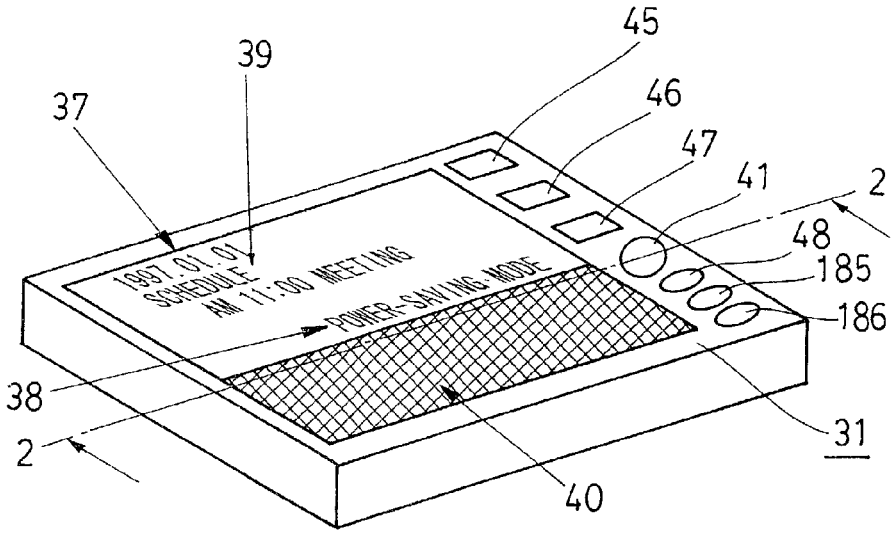
FIG. 1 is a perspective view showing an external appearance of a first embodiment of a liquid crystal display device according to the invention.
Figure 2:
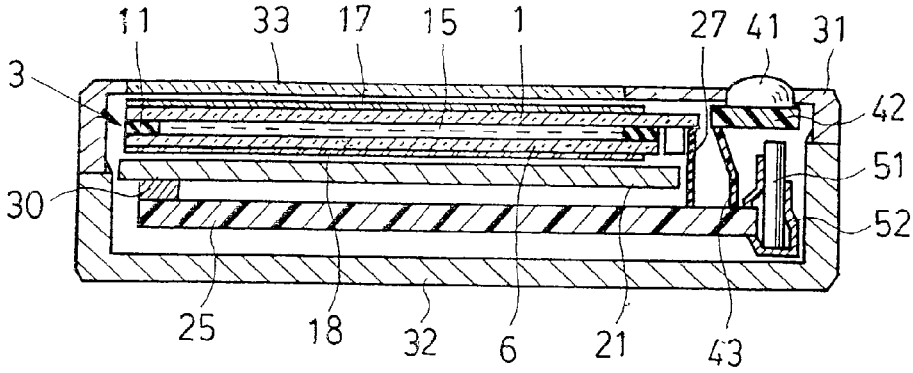
FIG. 2 is a schematic cross-sectional view taken along a line 2—2 of the liquid crystal display device.
Figure 3:
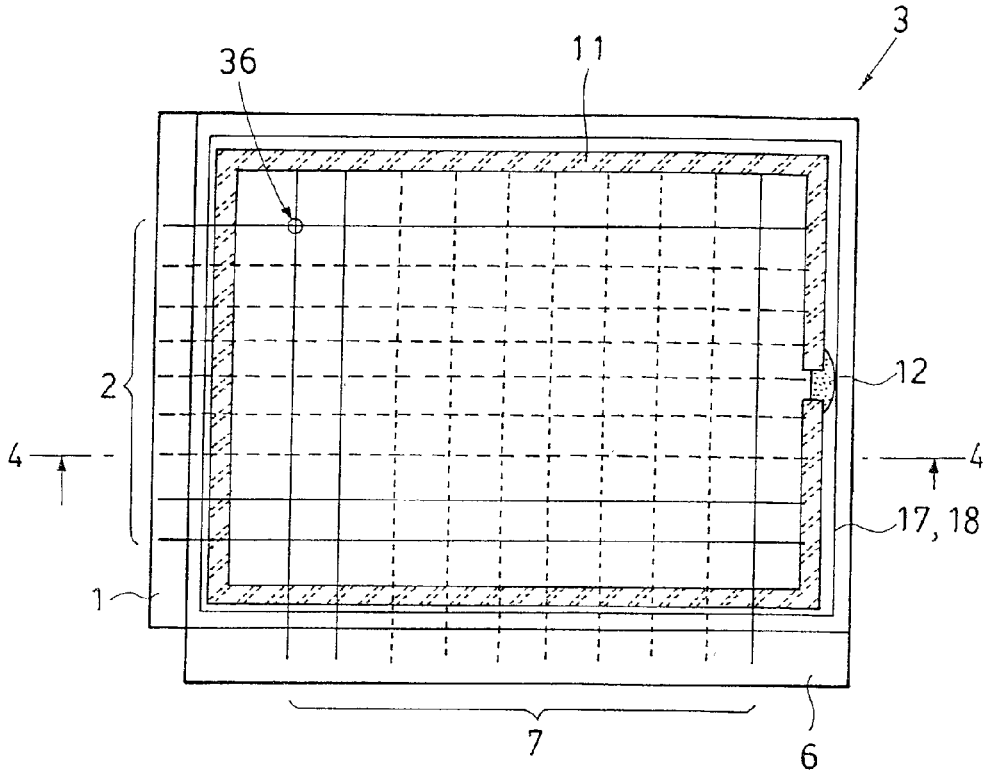
FIG. 3 is a plan view of a liquid crystal display panel provided in the liquid crystal display device.
Figure 4:
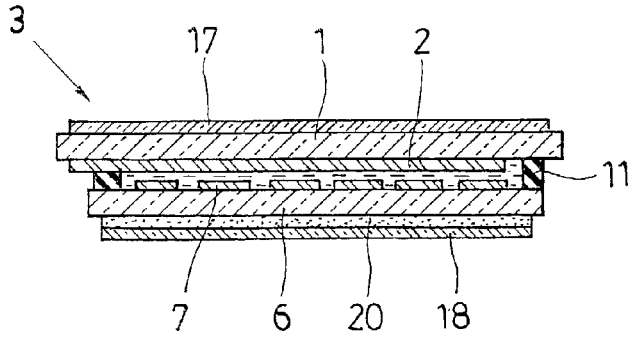
FIG. 4 is a schematic cross-sectional view of the liquid crystal display panel taken along a line 4—4.

FIG. 1 is a perspective view showing an external appearance of the liquid crystal display device, FIG. 2 is a schematic cross-sectional view taken along a line 2—2 in FIG. 1, FIG. 3 is a plan view of a liquid crystal display panel provided in the liquid crystal display device, and FIG. 4 is a schematic cross-sectional view taken along a line 4—4 in FIG. 3.

The liquid crystal display device shown in FIG. 1 is a device which performs display in a display region 37 by the liquid crystal display panel and includes a power supply switch button 41, a scroll (+) button 45, a scroll (−) button 46, a mode switching button 47, a speaker 48, a display refresh button 185, and an electric power-saving (hereinafter, referred to as "power-saving") mode switching button 186 to change the display or as input and output devices.

From among them, the power-saving mode switching button 186 is a button which switches between display by the driving signal in a standard mode and display by the driving signal in a power-saving mode which are described later.

These input and output devices are connected to a circuit board 25 through a switch substrate 42 and a switching FPC (flexible printed circuit board) 43 as shown in FIG. 2. A liquid crystal display module composed of a liquid crystal display panel 3, a battery 51, and the input and output devices are mounted on a module case 31, a glass 33 and a case back 32 to constitute the liquid crystal display device.

FIG. 1 shows a state of the liquid crystal display device in which a half of the display region 37 thereof is a power-saving display rewriting region 39 where a schedule display is being performed by a power-saving signal having a long selection period which is explained later, and the other half is a holding region 40 where no image signal is applied to hold display. In a part of the power-saving display rewriting region 39, a power-saving mode display 38 indicates the power-saving mode being in operation.

The liquid crystal display panel 3 in this liquid crystal display device is configured such that, from the glass 33 side (the observer side), a plurality of scanning electrodes 2 are provided on an inner face of a first substrate 1 in stripes in a direction parallel to the paper surface, and a plurality of data electrodes 7 are provided on an inner face of a second substrate 6, which opposes the first substrate 1 with a predetermined gap provided therebetween, in stripes in a direction perpendicular to the paper surface as shown in FIG. 4. Further, a liquid crystal layer 15 is sealed in the gap between the first substrate 1 and the second substrate 6, and the scanning electrodes 2 and the data electrodes 7 intersect with each other as shown in FIG. 3 to constitute pixel portions 36 at portions where they oppose each other with the liquid crystal layer 15 sandwiched therebetween respectively. This makes a region where many pixel portions 36 are arranged in matrix form the display region 37 shown in FIG. 1.

The first substrate 1 and the second substrate 6 are transparent glass plates respectively, and the scanning electrodes 2 and the data electrodes 7 are formed of indium tin oxide (ITO) that is transparent conductive film.

The liquid crystal layer 15 is a liquid crystal layer composed of a chiral smectic liquid crystal that is a ferroelectric liquid crystal and sealed between the first substrate 1 and the second substrate 6 with a sealing material 11 and a closing member 12 shown in FIG. 3. Further, alignment films made of silicon oxide (SiOx) for aligning the liquid crystal layer 15 in a predetermined direction are formed on the inner face of the first substrate 1 and the inner face of the second substrate 6, and these are explained later.

Furthermore, as shown in FIG. 4, a first polarizer 17, which is composed of an absorption type polarizer made by stretching a pigment in one direction, is provided on the visible side (the upper side in the figure) of the fist substrate 1, and a second polarizer 18, which is a reflection type polarizer such as RDF (trade name) manufactured by 3M Company or the like, is provided on the opposite side (the lower side in the figure) to the visible side of the second substrate 6 through a diffusing layer 20 (the illustration thereof is omitted in FIG. 2).

The absorption type polarizer has a transmission axis and an absorption axis which are perpendicular to each other to transmit linearly polarized light in the direction parallel to the transmission axis and to absorb linearly polarized light in the direction parallel to the absorption axis.

The reflection type polarizer has a transmission axis and a reflection axis which are perpendicular to each other to transmit linearly polarized light in the direction parallel to the transmission axis and to reflect linearly polarized light in the direction parallel to the reflection axis.

The first polarizer 17 that is the absorption type polarizer and the second polarizer 18 that is the reflection type polarizer are arranged such that the transmission axes thereof are perpendicular to each other.

The above components constitute the liquid crystal display panel.

Further, in the liquid crystal display device, an auxiliary light source 21 constituted by an electroluminescent element (El element) is disposed on the rear side of the liquid crystal display panel 3 to use the liquid crystal display device in a dark environment, and the circuit board 25 is disposed on the rear side of the auxiliary light source 21 as shown in FIG. 2. The connection between the liquid crystal display panel 3 and the circuit board 25 is established by a zebra-rubber connector 27, and the connection between the auxiliary light source 21 and the circuit board 25 is established at a light source terminal 30. As the light source terminal 30, the zebra-rubber connector is used, and a spring may also be used.

The battery 51 is fixed to the circuit board 25 by a battery holder spring 52, and this battery 51 becomes an energy source of the liquid crystal display device. Further, the switch substrate 42 provided with the switch buttons such as the power supply switch button 41 and the like is connected to the circuit board 25 through the switching FPC (flexible printed circuit board) 43.

The liquid crystal layer of the liquid crystal display device of this embodiment is explained next using FIG. 5 to FIG. 8.

Figure 5:
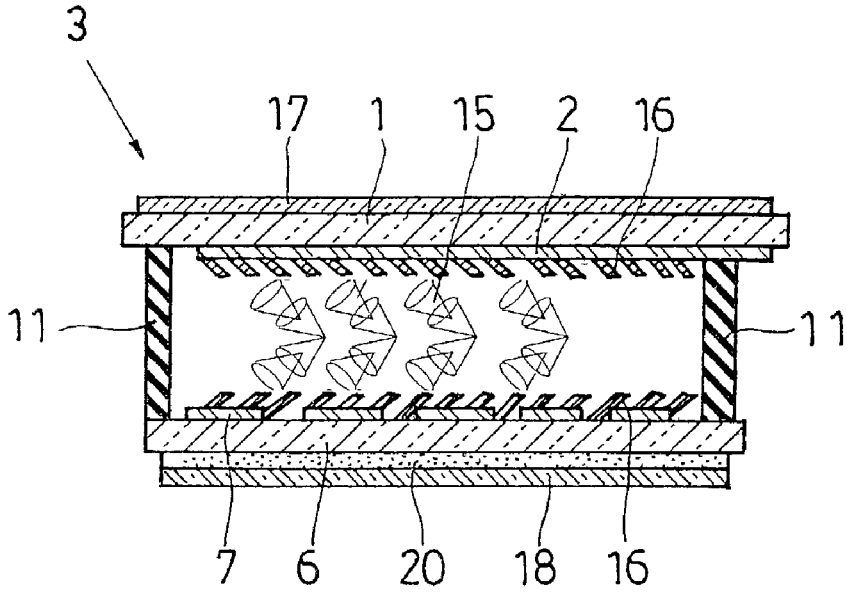
FIG. 5 is a schematic cross-sectional view for explaining a liquid crystal layer having a memory property in the liquid crystal display panel shown in FIG. 4 with the thickness thereof particularly enlarged.
Figure 6:
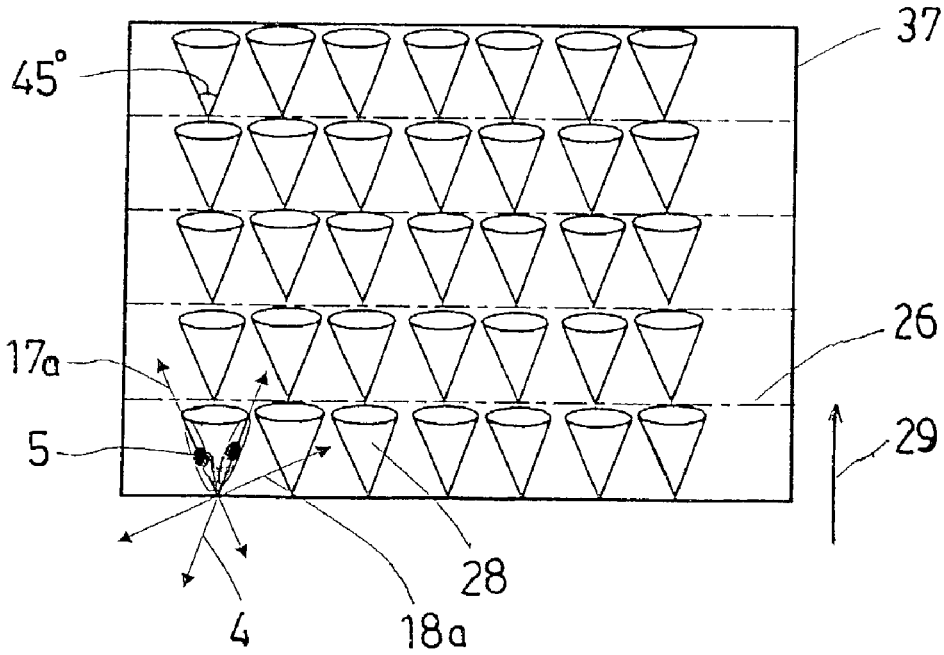
FIG. 6 is a schematic plan view for explaining the structure of the liquid crystal layer.
Figure 7:
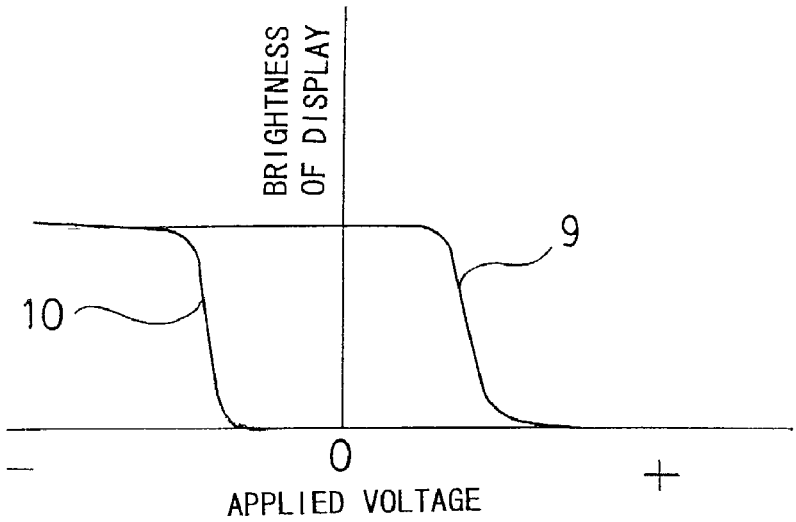
FIG. 7 is a graph showing the relationship between the applied voltage and the brightness of display when the driving signal in a standard mode is applied to the liquid crystal display panel of the liquid crystal display device shown in FIG. 1 to FIG. 6.
Figure 8:
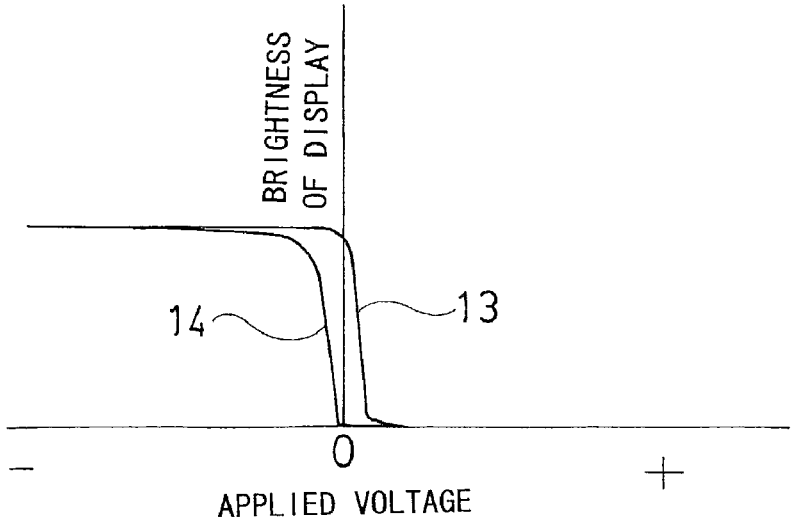
FIG. 8 is a graph showing the relationship between the applied voltage and the brightness of display when the driving signal in a power-saving mode is applied to the same.

FIG. 5 is a schematic cross-sectional view for explaining the liquid crystal layer 15 having a memory property used in the liquid crystal display panel 3 shown in FIG. 4 with the thickness thereof particularly enlarged. FIG. 6 is a schematic plan view for explaining the structure of the liquid crystal layer. FIG. 7 is a graph showing the relationship between the applied voltage and the brightness of display when the driving signal in the standard mode is applied to the liquid crystal display device of this embodiment, and FIG. 8 is a graph showing the relationship between the applied voltage and the brightness of display when the driving signal in the power-saving mode is applied to the same.

The liquid crystal display panel 3 in the liquid crystal display device of this embodiment realizes a liquid crystal display device which holds an immediately preceding display state even without a voltage applied thereto by using a ferroelectric liquid crystal as the liquid crystal having a memory property for the liquid crystal layer 15. There is a chiral smectic liquid crystal as a representative of the ferroelectric liquid crystal, and this chiral smectic liquid crystal is used in this embodiment.

A chiral smectic phase showing ferroelectricity is typically of a spiral structure, but it becomes, for example, in a cell gap thinner than 2 μm, not the spiral structure but a state in which a domain where liquid crystal molecules incline in a positive molecular direction 4 from a smectic phase normal 26 and a domain where liquid crystal molecules incline in a negative molecular direction 5 are mixed as shown in FIG. 6 due to the interface with the alignment films.

Since the display becomes best and ideal when the inclinations are +22.5° and −22.5°, the liquid crystal molecules are adjusted to have these angles by alignment films 16 shown in FIG. 5 in this embodiment.

When a voltage is applied to this chiral smectic liquid crystal layer, the directions of spontaneous polarization align in one direction to provide a state in which the directions of the molecules are aligned. Alternatively, when a voltage of the polarity opposite to the above is applied thereto, the molecules are aligned in the opposite direction to the above. Once the directions of the molecules are aligned, the state in which the directions thereof are aligned is kept even after the application of the voltage is stopped.

The above-described state can be understood as the liquid crystal molecules moving along a ridge line of a circular cone 28 forming an angle of 45° shown in FIG. 6 due to the polarity of the applied voltage, and thus it is possible to change the directions of the molecules in the liquid crystal layer by changing the polarity of the voltage so as to change the optical axes thereof.

In this embodiment, a transmission axis 17*a* of the first polarizer 17 is thus arranged parallel to the negative molecular direction 5 and a transmission axis 18*a* of the second polarizer 18 is arranged perpendicular to the negative molecular direction 5 to realize display that becomes a dark display when a voltage of positive polarity is applied to the liquid crystal layer 15 and becomes a bright display when a voltage of negative polarity is applied thereto, in the case of display using light of an external light source.

More specifically, in the state in which the molecules are aligned in the positive molecular direction 4, linearly polarized light which has passed through the transmission axis of the first polarizer 17 from the visible side is made incident on the liquid crystal molecules in a polarization direction of 45° to become circularly polarized light when passing through the liquid crystal layer 15 due to birefringence, and reflected by the second polarizer 18, which is a reflection type polarizer, to become linearly polarized light rotated 90° from the state at the time of incident when passing again through the liquid crystal layer due to the birefringence to be made incident on the absorption axis of the first polarizer 17, so that no light goes out to the visible side, resulting in a dark display.

In the state in which the molecules are aligned in the negative molecular direction 5, the linearly polarized light which has passed through the transmission axis of the first polarizer 17 from the visible side passes, as it is, through the liquid crystal layer 15 because the polarization direction thereof is parallel to the liquid crystal molecules, is made incident on the reflection axis of the second polarizer 18 that is a reflection type polarizer to be reflected, and passes again through the transmission axis of the first polarizer 17 to go out to the visible side. The diffusing layer 20 which does not change the polarization state is provided here to suppress glare of display, resulting in a bright display that is a white display.

The display when performed by the light emitted by the auxiliary light source 21 shown in FIG. 2 is inverted in brightness and darkness to the display when performed by the light of the external light source.

More specifically, in the state in which the molecules are aligned in the positive molecular direction 4, the linearly polarized light which has passed through the transmission axis of the second polarizer 18 from the auxiliary light source 21 side is made incident on the liquid crystal molecules in a polarization direction of 45° to become circularly polarized light when passing through the liquid crystal layer 15 due to birefringence, so that a part of the light passes through the transmission axis of the first polarizer 17 to go out to the visible side, resulting in a bright display.

In the state in which the molecules are aligned in the negative molecular direction 5, the linearly polarized light which has passed through the transmission axis of the second polarizer 18 from the auxiliary light source side passes, as it is, through the liquid crystal layer 15 because the polarization direction thereof is perpendicular to the liquid crystal molecules, and is made incident on the absorption axis of the first polarizer 17 to be absorbed and not to go out to the visible side, resulting in a dark display.

Accordingly, the driving signals having opposite polarities of voltages applied to the liquid crystal layer 15 are used for the reflection display using the external light source and for the transmission display using the auxiliary light source 21. An explanation will be made of the driving signal for performing the reflection display unless otherwise particularly noted, for convenience of explanation.

In the experiment by the inventor, a holding characteristic (memory property) of display was better when a silicon oxide (SiOx) film was used as the material of the alignment film 16 than when a polyimide resin was used. Further, the memory property could be improved also in a hybrid case in which the alignment film 16 to be formed on the first substrate 1 was made of a silicon oxide film and the alignment film 16 to be formed on the second substrate 6 was made of a polyimide resin.

In this embodiment, the liquid crystal molecules are aligned by the silicon oxide films formed, on the first substrate 1 including the scanning electrodes 2 and the second substrate 6 including the data electrodes 7, in a 45° direction to the substrates as shown in FIG. 5 by the oblique evaporation method.

FIG. 7 shows a graph showing the relationship between the brightness of display and the applied voltage when a standard selection signal and a standard data signal for rewriting the display region once at a frequency of typically used video rate (30 Hz) or higher are applied to the liquid crystal layer structured as described above.

In FIG. 7, the brightness of display is indicated on the vertical axis and the applied voltage is indicated on the horizontal axis. A state of low brightness here shows a dark display in the absorption state, and a state of high brightness shows a bright display with a strong reflection characteristic. Further, the right side of the graph shows a state of the applied voltage to the liquid crystal layer being positive polarity and the left side shows a state thereof being negative polarity.

In the liquid crystal display device of this embodiment, in the case of display performed in the standard mode, when the voltage applied to the liquid crystal layer 15 is changed from the bright display state in which the liquid crystal molecules are aligned in the negative molecular direction 5, the brightness of display changes as shown by a positive polarity application curved line 9. More specifically, the brightness does not change only by stopping application of the voltage to zero voltage, the state of the bright display being held, and when a large voltage of positive polarity is applied, the display decreases in brightness to a dark display.

Subsequently, when the voltage applied to the liquid crystal layer 15 is changed from this state, the brightness of display changes as shown by a negative polarity application curved line 10. More specifically, the brightness does not change only by stopping application of the voltage to zero voltage, the state of the dark display being held. When a voltage having a large absolute value of negative polarity is applied, the display increases in brightness to a bright display.

In other words, the display in the liquid crystal display device has a memory property so that it is possible to hold the state thereof last performed even if the applied voltage is brought to zero or at least one of the electrodes is set at a floating potential after a voltage having a large absolute value is applied.

In such a liquid crystal layer 15 having the memory property, it is possible to create a great optical change as in the graph shown in FIG. 8 even by a small voltage by applying the voltage for a time several tens of times or 1000 or more times longer than that in the standard selection signal.

Also in FIG. 8, the brightness of display is indicated on the vertical axis and the applied voltage is indicated on the horizontal axis. The right half of the graph shows a state of the applied voltage to the liquid crystal layer being positive polarity and the left half shows a state thereof being negative polarity.

In the case of application of voltage for a long time, when the voltage applied to the liquid crystal layer 15 is changed from the bright display state in which the liquid crystal molecules are aligned in the negative molecular direction 5, the brightness of display changes as shown by a power-saving mode positive polarity application curved line 13. Further, when the voltage applied to the liquid crystal layer 15 is changed from the dark display state in which the liquid crystal molecules are aligned in the positive molecular direction 4, the brightness of display changes as shown by a power-saving mode negative polarity application curved line 14.

In other words, even such display has a memory property so that it is possible to hold the state thereof last performed even if the applied voltage is brought to zero or at least one of the electrodes is set at a floating potential after a voltage having a somewhat large absolute value is applied.

However, since the period for applying a signal to one electrode is long, differing from the display in the standard mode, it is possible to switch the bright and dark displays by the application of a voltage greatly smaller than that in the standard mode to reduce the power consumption.

The liquid crystal display device of this embodiment realizes a liquid crystal display device having a very low power consumption by providing a power-saving mode which has a selection period for selecting each electrode longer than that of the standard mode through the use of such a characteristic so as to perform display in the power-saving mode when there is no need to switch the display to a high speed.

The driving signal in the standard mode for performing display on the liquid crystal display panel of the liquid crystal display device of this embodiment is explained next using FIG. 9.

Figure 9:
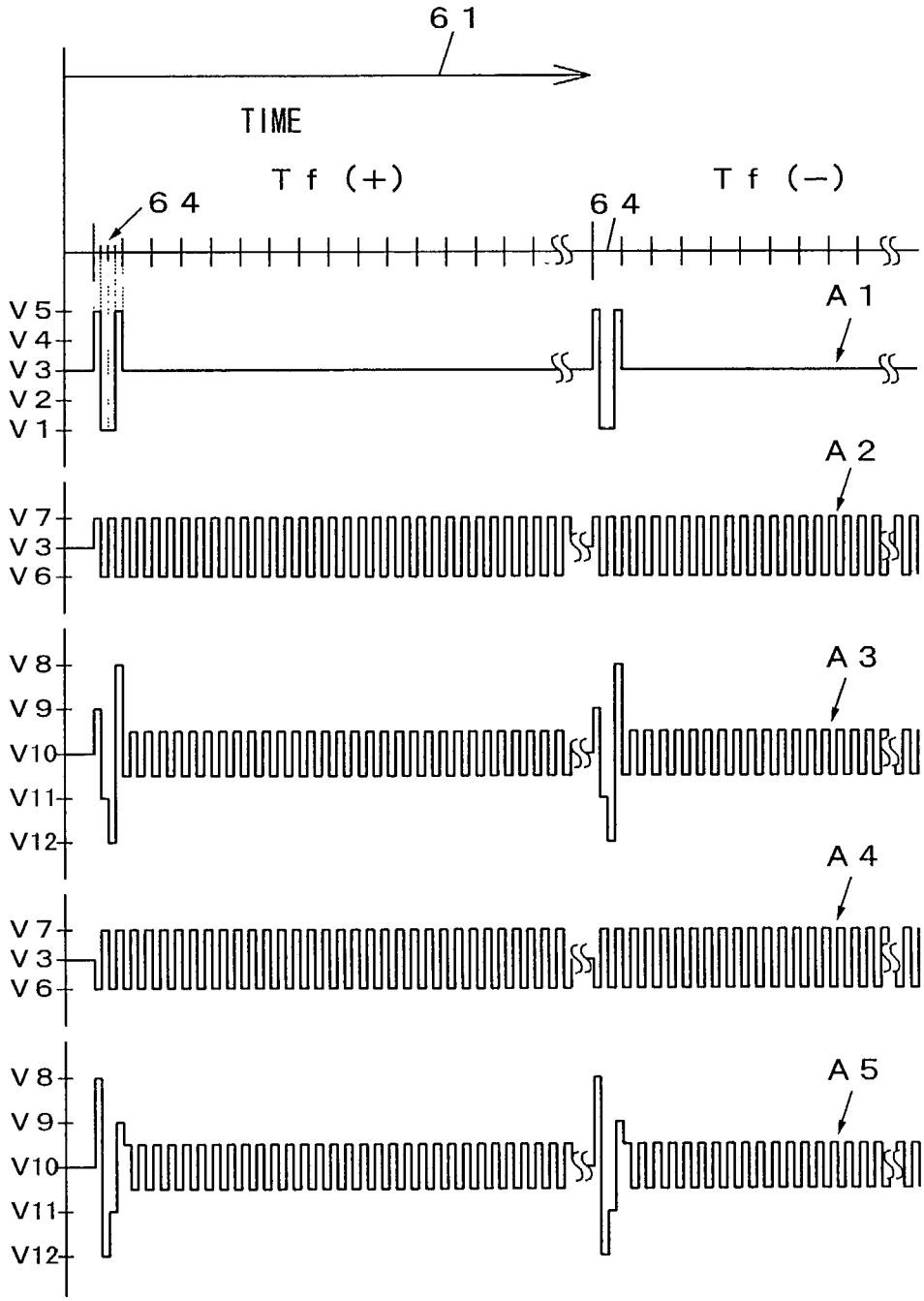
FIG. 9 is a waveform diagram showing an example of the driving signal in the standard mode used to drive the liquid crystal display panel.

FIG. 9 shows waveforms of the driving signal for performing display on the liquid crystal display panel in the standard mode. A1 is a waveform of a first standard selection signal to be applied to a first scanning electrode, A2 is a waveform of a first standard data signal to be applied to a data electrode, and A3 is a composite waveform of them which is a waveform showing a voltage to be applied to the liquid crystal layer 15 at a portion where the scanning electrode and the data electrode oppose each other.

A2 here shows an example of a signal for bringing all the pixels on the data electrode, to which the signal is applied, into the dark display.

Further, A4 is also a waveform of the first standard data signal and A5 is a composite waveform of this signal and the first standard selection signal A1, and this A4 shows an example of a signal for bringing all the pixels on the data electrode, to which the signal is applied, into the bright display.

It should be noted that, in the following explanation, the period from selection of the first scanning electrode to rewrite once display contents of each pixel portion 36 in the display region of the liquid crystal display panel 3 to reselection of the first scanning electrode to rewrite them the next time, is defined as a field.

The horizontal axis of the waveform diagram in FIG. 9 is a time axis 61, in which each of Tf(+) and Tf(−) indicates one field (write period for one picture). Each of the Tf(+) and Tf(−) shall be 1/120 of a second here to prevent flicker. Accordingly, assuming that the number of scanning electrodes is 480, the selection period for selecting one electrode is about 17 microseconds.

The vertical axis is an axis representing voltage. The first standard selection signal A1 is a signal at five levels from V1 to V5, and V3 at the middle is 0 V (volts).

To prevent a direct current component from being applied to the liquid crystal layer 15, a selection period 64, which is the period for selecting the first scanning electrode, is further divided into four parts in the fist standard selection signal A1, so that a positive voltage at V5 is applied during a first application period and a fourth application period and a negative voltage at V1 is applied during a second application period and a third application period. The voltage at V3 is applied during the other periods.

It should be noted that as for a first standard selection signal for selecting another electrode, voltages corresponding to those from the aforesaid first application period to the fourth application period are applied during the selection period for selecting the electrode, and the voltage at V3 is applied during the other periods.

Further, the first standard data signal A2 is a waveform of a signal at a high frequency of a square wave which reciprocates between voltages at V7 and V6 and is repeated two cycles in the selection period for selecting one scanning electrode.

The first standard data signal A2 is in a phase in which the high voltage at V7 is applied during the first application period in the selection period 64 to form a composite waveform like A3 with the first standard selection signal A1. Accordingly, the voltage having a large absolute value which is applied to the liquid crystal layer 15 the last time in the selection period 64 is a positive voltage at V8 (=V5−V6) applied during the fourth application period, so that a pixel to which these two signals are applied becomes a dark display. Thereafter, a voltage having a large absolute value is not applied until the first scanning electrode is selected the next time, so that the dark display is held.

On the other hand, the first standard data signal A4 is also the same square wave as that of the first standard data signal A2, but is in a phase in which the low voltage at V6 is applied during the first application period. Accordingly, the composite waveform thereof with the first standard selection signal A1 becomes like A5, and the voltage having a large absolute value which is applied to the liquid crystal layer 15 the last time in the selection period 64 is a negative voltage at V12 (=V1−V7) applied during the second application period, so that a pixel to which these two signals are applied becomes a bright display. Thereafter, a voltage having a large absolute value is not applied until the first scanning electrode is selected the next time, so that the bright display is held.

In the standard mode, such signals are applied to each of the scanning electrodes 2 and data electrodes 7 to perform display. It should be noted that since the driving waveform repeating the same display is shown here, the signals are the same in the Tf(+) field and in the Tf(−) field, and since the polarities are reversed in the selection period of each scanning electrode in the first standard selection signal to prevent the direct current from being applied to the liquid crystal layer, it is unnecessary to reverse the polarities in the Tf(+) field and in the Tf(−) field.

By the way, in such a standard mode, the optical characteristics of the liquid crystal layer 15 should be changed in a short time to write about 120 pictures per second, and it is thus necessary to increase the driving voltage. This results in an increase in power consumption.

It should be noted that the selection signal applied to the first (first row) scanning electrode will be shown as an example of the selection signal unless otherwise particularly noted, also including a waveform diagram used for the explanation of each embodiment hereafter, and selection signals having the same waveform for selecting in a time division manner are applied to other scanning electrodes. Further, the data signal applied to one of the data electrodes will be shown as an example of the data signal unless otherwise particularly noted, and different signals are applied to the data electrodes in accordance with the display contents.

The driving waveform in the power-saving mode which is the feature of this invention is explained next using FIG. 10 to FIG. 12.

Figure 10:
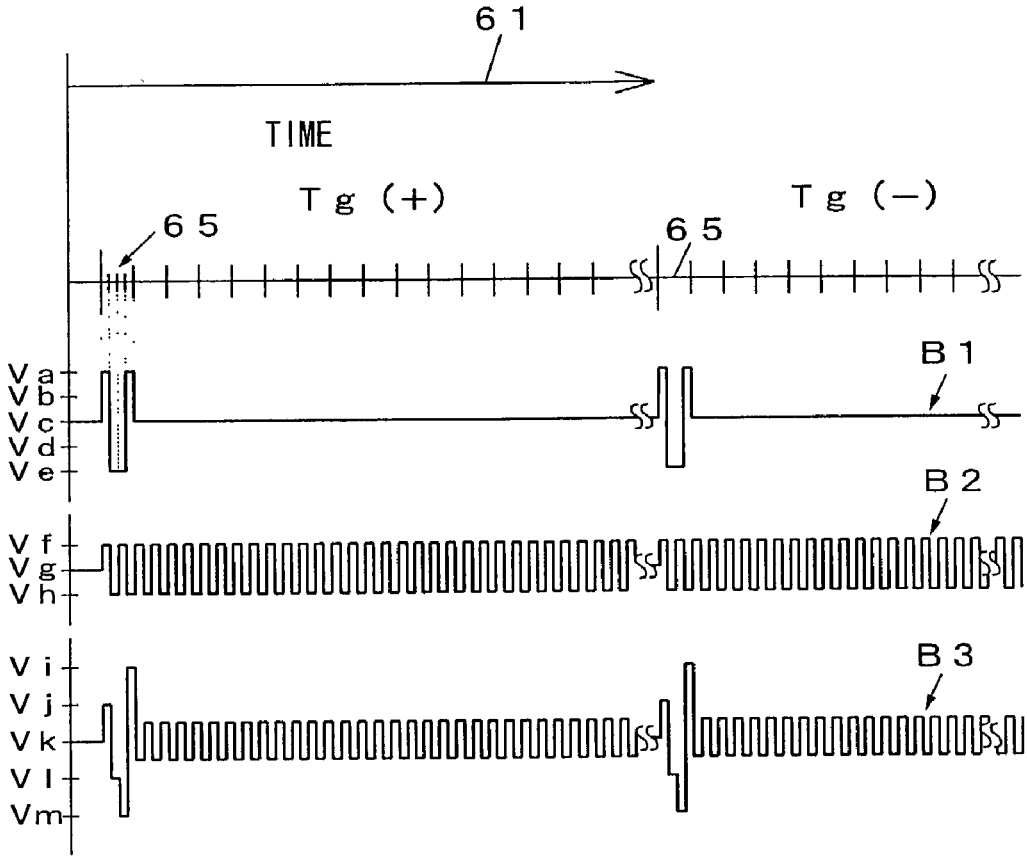
FIG. 10 is a waveform diagram showing a first example of the driving signal in the power-saving mode of the same.

FIG. 10 is a waveform diagram showing waveforms of signals for driving the liquid crystal display panel in a first power-saving mode, in which B1 is a waveform of a first power-saving selection signal, and B2 is a waveform of a first power-saving data signal. B3 is a composite waveform of them which is a waveform showing a voltage to be applied to the liquid crystal layer 15 at a portion where the scanning electrode and the data electrode oppose each other. B2 here shows an example of a signal for bringing all the pixels on the data electrode, to which the signal is applied, into the dark display.

This figure is the same as FIG. 9 in that the horizontal axis is a time axis 61, the vertical axis represents voltage, and the middle of the scale set for each waveform shows a voltage of 0 V. However, a Tg(+) field and a Tg(−) field each corresponding to a write period for displaying one picture are time periods 100 times longer than the Tf(+) field and the Tf(−) field respectively in the case of the standard mode shown in FIG. 9. Accordingly, a power-saving selection period 65 is also a period 100 times that of the selection period 64 shown in FIG. 9.

The liquid crystal layer 15 used in this embodiment has a memory property, so that even when there is an interval from the first write to the next write due to the increase in the write period as described above, the display never deteriorates during the period to enable the display with the same quality as that in the standard mode to be performed.

To prevent a direct current component from being applied to the liquid crystal layer 15, the selection period 65, which is the period for selecting the first scanning electrode, is further divided into four parts also in the fist power-saving selection signal B1, so that a positive voltage at Va is applied during a first application period and a fourth application period and a negative voltage at Ve is applied during a second application period and a third application period. A voltage at Vc is applied during the other periods.

It should be noted that as for a first power-saving selection signal for selecting another electrode, voltages corresponding to those from the aforesaid first application period to the fourth application period are applied during the selection period for selecting the electrode and the voltage at Vc is applied during the other periods.

Further, the first power-saving data signal B2 is a waveform of a signal of a square wave which reciprocates between voltages at Vf and Vh and is repeated two cycles in the selection period for selecting one scanning electrode.

The first power-saving data signal B2 is in a phase in which the high voltage at Vf is applied during the first application period in the power-saving selection period 65 to form a composite waveform like B3 with the first power-saving selection signal B1. Accordingly, the voltage having a large absolute value which is applied to the liquid crystal layer 15 the last time in the selection period 65 is a positive voltage at Vi (=Va−Vh) applied during the fourth application period, so that a pixel to which these two signals are applied becomes a dark display. Thereafter, a voltage having a large absolute value is not applied until the first scanning electrode is selected the next time, so that the dark display is held.

When the bright display is performed, it is only required to apply the low voltage at Vh during the first application period by shifting the phase of the first power-saving data signal B2 by a half wavelength.

According to each power-saving signal shown in FIG. 10, it is possible to induce the optical change in the liquid crystal layer 15 by a low voltage because the application period thereof is 100 times longer than that of the signal in the standard mode shown in FIG. 9. The potential difference between the applied potentials Va and Ve used for the first power-saving selection signal B1 can be reduced to about one-third the potential difference between V1 and V5 for the first standard selection signal A1 shown in FIG. 9.

Similarly, the signal levels Vf to Vh for the first power-saving data signal B2 and the signal levels Vi to Vm for the composite signal B3 can also be reduced to about one-third the respective potentials used for the signals in the standard mode. Therefore, the display can be performed by a power consumption lower than that in the standard mode.

In this liquid crystal display device of the first embodiment, it is also possible to further increase the selection period so as to perform display by a signal at further lower voltage. The driving waveform of a second power-saving mode is shown in FIG. 11.

Figure 11:
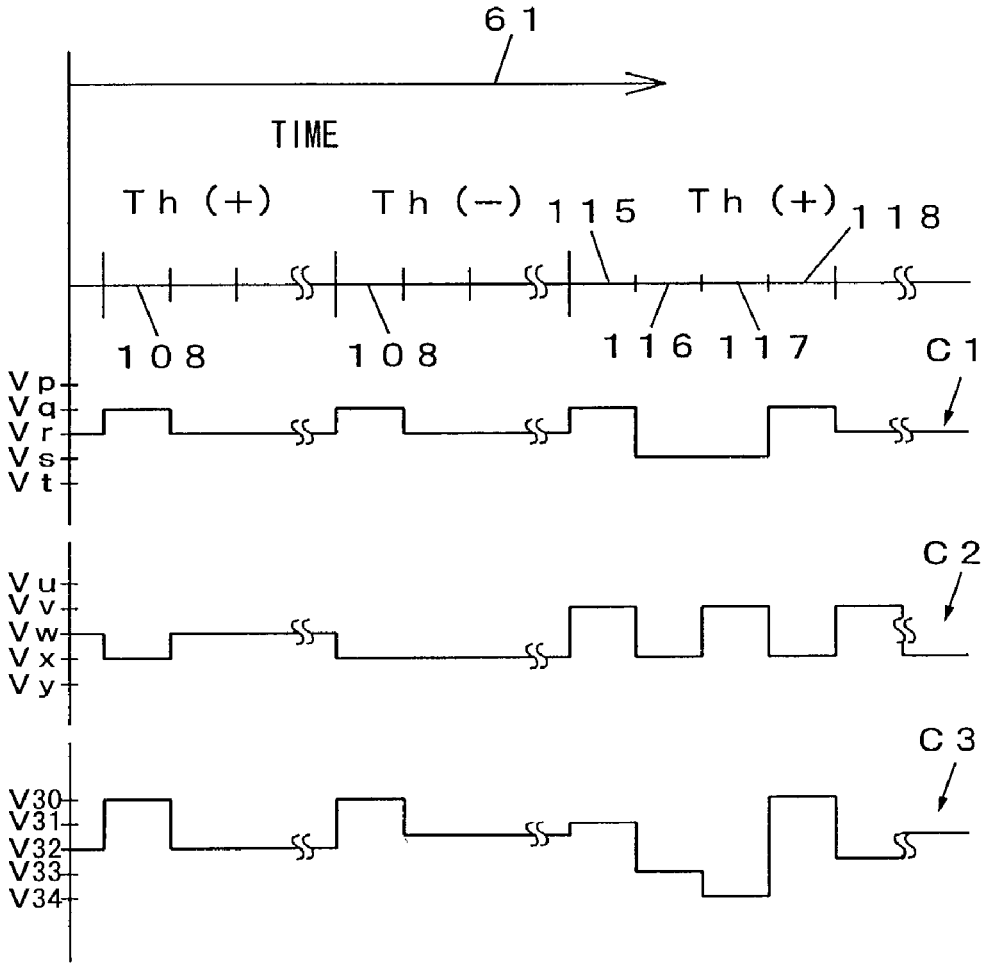
FIG. 11 is a waveform diagram showing a second example of the driving signal in the power-saving mode of the same.

FIG. 11 is the same as FIG. 9 in that the horizontal axis is a time axis 61, the vertical axis represents voltage, and the middle of the scale set for each waveform shows a voltage of 0 V. However, a Th(+) field and a Th(−) field each for performing one picture are time periods still several tens of times longer than the Tg(+) field and the Tg(−) field respectively in the case of the power-saving mode shown in FIG. 10. Accordingly, a power-saving selection period 108 is a period of about 100 milliseconds, which is also still several tens of times that of the power-saving selection period 65 shown in FIG. 10.

Further, C1 is a waveform of a second power-saving selection signal, C2 is a waveform of a second power-saving data signal, and C3 is a composite waveform of them which is a waveform showing a voltage to be applied to the liquid crystal layer 15 at a portion where the scanning electrode and the data electrode oppose each other. C2 here shows an example of a signal for bringing a pixel on the first row on the data electrode, to which the signal is applied, into the dark display and holding displays of other pixels during the first write period, and for bringing all the pixels on the data electrode, to which the signal is applied, into the dark display during the next write period.

The second power-saving selection signal C1 applies a voltage at Vq during the selection period 108 which is a period for selecting the first scanning electrode and applies a voltage at Vr during the other periods. The second power-saving data signal C2 applies a voltage at Vx during the selection period 108 and applies a voltage at Vw during the other periods in the first field Th(+). In the next field Th(−), the voltage at Vx is applied during all the periods.

As a result, the voltage to be applied to the liquid crystal layer 15 becomes like C3, and the applied voltage is thus V30 during the selection period 108, so that this pixel becomes the dark display and the display is held during the other periods due to the memory property of the liquid crystal layer 15.

When the pixel is switched to the bright display, a field (write period) is provided in which display is performed by a power-saving selection signal for applying a voltage at Vs in place of Vq during the period for selecting a scanning electrode and a power-saving data signal for applying a voltage at Vv in place of Vx during the period for selecting a pixel for performing the bright display. In this write period, it is selectable whether the pixel is switched into the bright display or the display until then is held.

Typically, the polarities are not reversed in each selection period in the second power-saving selection signal C1 and the second power-saving data signal C2, so that the voltage switching frequency can be still lower than that in the case where the selection periods of the first standard selection signal A1 and the first standard data signal A2 shown in FIG. 9 are just increased.

However, the selection period is made a period four times the selection period 108 once for every several writes, in which a first application period 115, a second application period 116, a third application period 117, and a fourth application period 118 are provided, and positive and negative voltages having large absolute values are applied during this period to prevent unbalance of charge in the liquid crystal layer 15. The second power-saving selection signal C1 applies the voltage at Vq during the first application period 115 and the fourth application period 118 and the voltage at Vs during the second application period 116 and the third application period 117. The second power-saving data signal C2 applies the voltage at Vv during the first application period 115 and the third application period 117 and the voltage at Vx during the second application period 116 and the fourth application period 118.

The provision of the selection period having a length four times as long as described above can prevent a direct current voltage from being applied to the liquid crystal layer through the use of a signal at a potential having a small absolute value which is the same as the potential used in this second power-saving mode, resulting in reduced power consumption. However, if the selection period is made to have this length in every write period, the display undesirably flicks and it is disadvantageous in terms of power consumption, and thus the period having this length shall be provided only once for every several writes.

In the second power-saving mode described above, since the selection period is increased to be several hundreds times to a thousand times longer than the standard selection period, the driving voltage can be decreased to about several volts that is about one-tenth that of the standard mode. In other words, it is possible to reduce the potential difference between the applied voltages Vp and Vt used in the second power-saving selection signal C1 to be about one-tenth the potential difference between V1 and V5 in the first standard selection signal A1. Similarly, it is also possible to reduce the potential difference between applied voltages Vu and Vy used in the second power-saving data signal C2 to be about one-tenth the potential difference between V6 and V7 in the first standard data signal. Further, it is also possible to reduce the potential difference between potentials V30 and V34 in the composite signal C3 actually applied to the liquid crystal layer 15 to be about one-tenth the potential difference between V8 and V12 in the case of the standard mode. Furthermore, as is clear from FIG. 11, the frequency of the driving signal is also very reduced, so that it is possible to extremely reduce the power consumption required for driving the liquid crystal display panel and the power consumption of the drive circuit of the liquid crystal display panel.

Figure 12:
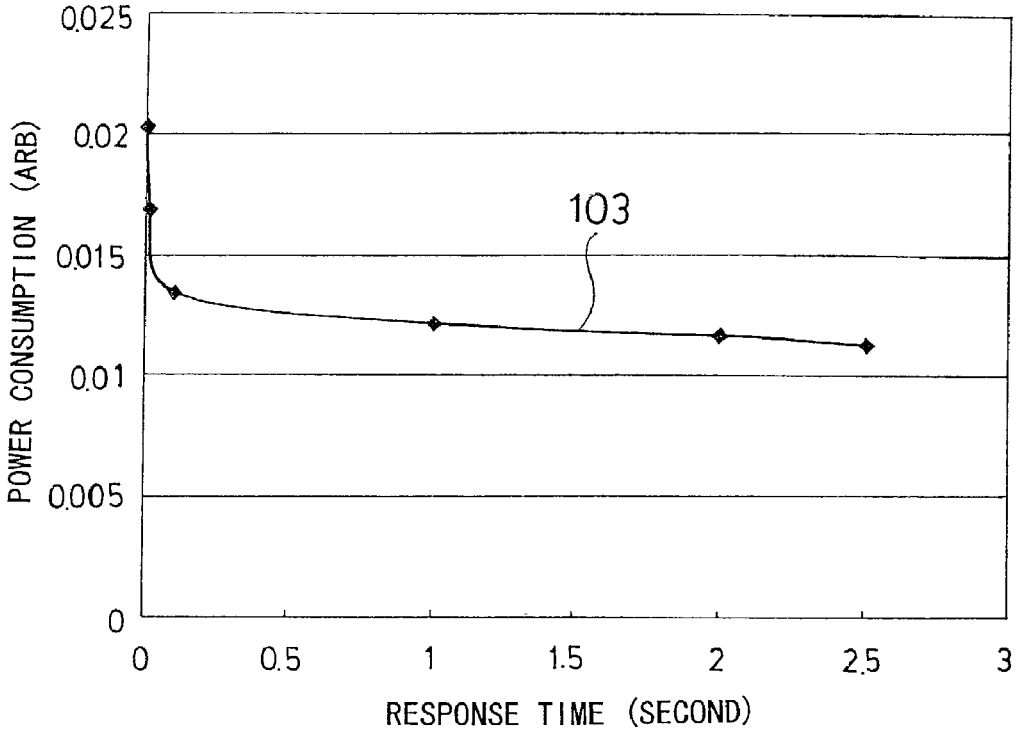
FIG. 12 is a graph showing the relationship between the power consumption of the aforesaid liquid crystal display device according to this invention and a response time of the liquid crystal layer.

The above-described signal waveforms in the power-saving mode utilize the characteristics of the liquid crystal display panel shown on a graph in FIG. 12. The horizontal axis in FIG. 12 represents a time required for the liquid crystal layer to reach predetermined optical characteristics, that is, a response time, and the vertical axis represents the power consumption in a relative value (ARB).

A curved line 103 on this graph indicates that the power consumption sharply increases when the response speed is high, that is, when the response time is reduced to be shorter than 100 milliseconds. Accordingly, the liquid crystal display panel is driven in a response time of 100 milliseconds or more to enable an extreme reduction in the amount of electric power consumed by the liquid crystal display panel.

As is clear from this graph, it becomes possible to greatly reduce the voltage which causes the liquid crystal layer to attain the predetermined optical characteristics by increasing the application time (response time) of the voltage to the liquid crystal layer 15. Therefore, it is effective in reducing the power consumption to decrease the voltage amplitude of the driving signal and the potential difference between the selection signal and the data signal which are applied to the liquid crystal layer as the selection period is increased.

Further, the power consumption shown in FIG. 12 does not include a contribution by the frequency of the drive circuit of the liquid crystal display device, and thus it can be said that the power consumption can be reduced to be still lower than the value shown on the graph in consideration of the contribution.

A reduction in the voltage for performing the optical change in the liquid crystal layer 15 effects the reduction in the power consumption in particular. For example, a potential difference of 12 V applied to the liquid crystal layer 15 is required to drive it in a response time of 1 millisecond, but the optical change can be attained by 4 V for the case of a response time of 100 milliseconds, 2.5 V for 1 second, and 1.5 V for 2.5 seconds. This enables simplification of a voltage-up converter necessary for the selection signal and the data signal applied to the liquid crystal display panel 3 and the prevention of loss of the electric power in the liquid crystal display device, which is effective in reducing the power consumption of the liquid crystal display device.

The selection period for selecting each scanning electrode is allowed to be selected from a plurality of periods, and the signal waveform is allowed to be selected from a plurality of waveforms so as to select an appropriate selection period and signal waveform in accordance with the operation state and the necessary write frequency as in this embodiment, which makes it possible to realize the reduction in power consumption while the display quality is maintained.

In this case, the same selection period and signal waveform shall be used in one write period, and a change shall be performed between one write period and the next write period. The same applies to the following embodiments.

Figure 13:
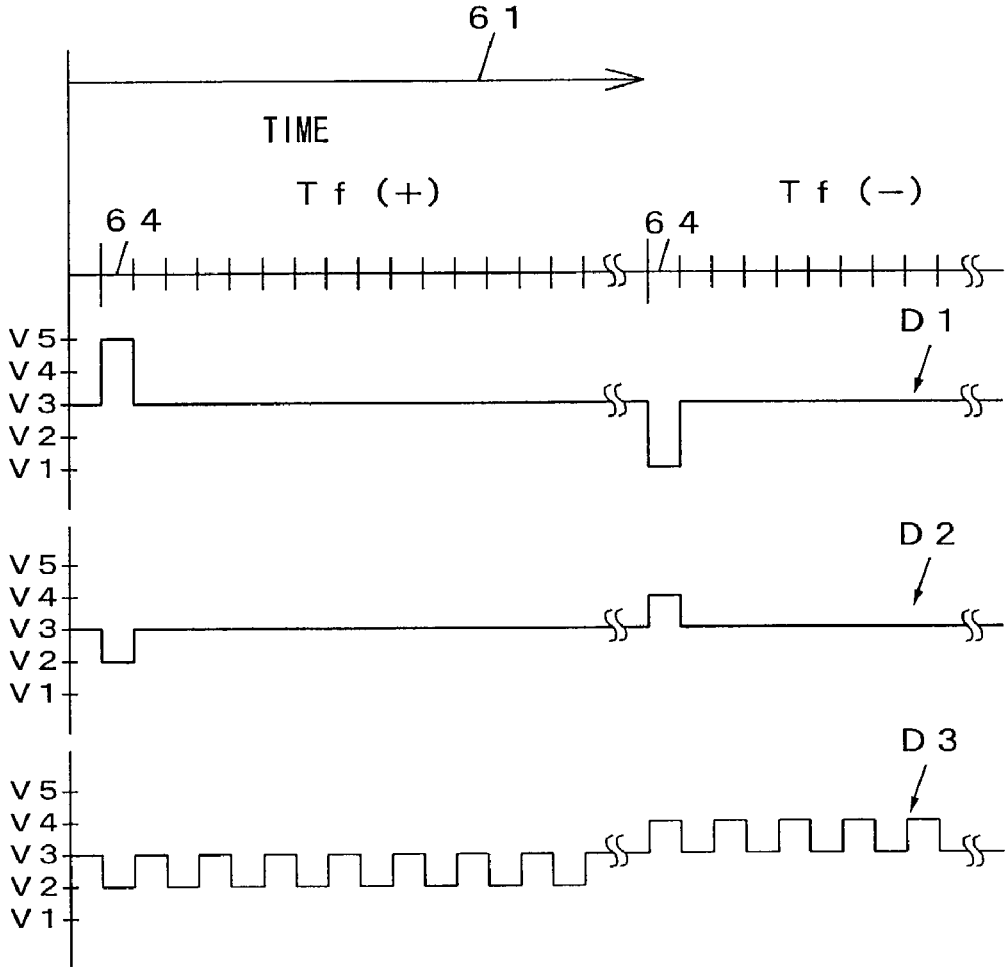
FIG. 13 is a waveform diagram showing an example of the driving signal in the standard mode used in a second embodiment of the invention.
Figure 14:
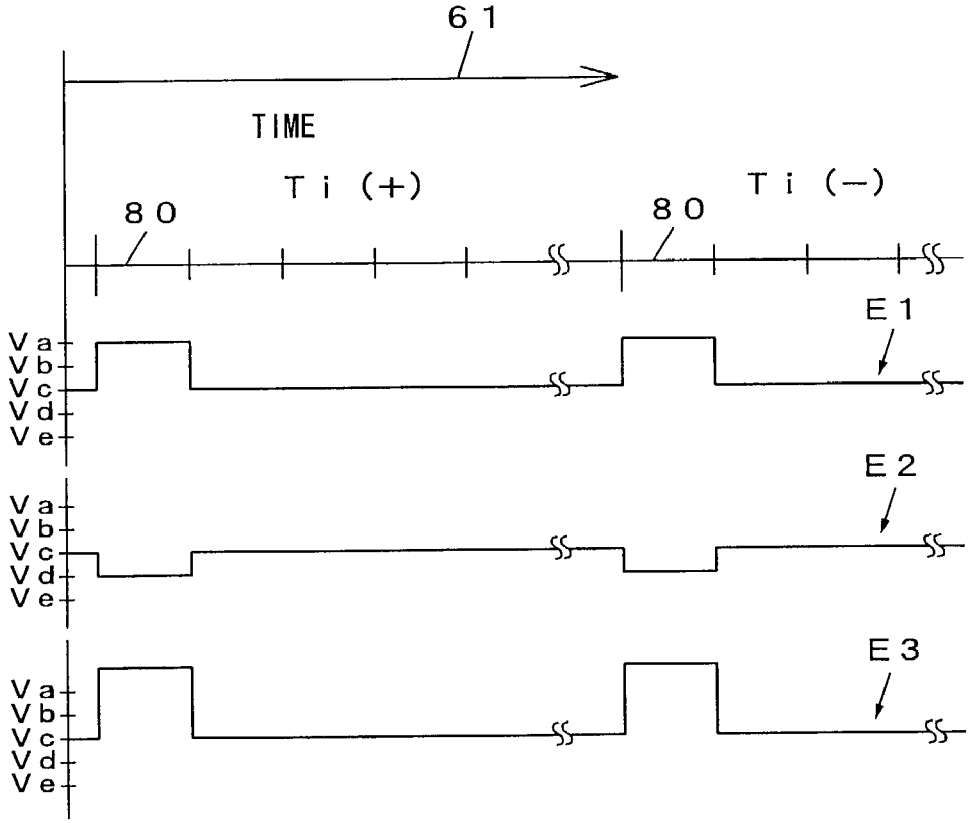
FIG. 14 is a waveform diagram showing another example of the driving signal in the power-saving mode of the same.

Second Embodiment: FIG. 13 and FIG. 14

The driving waveform of a liquid crystal display device in the second embodiment of the invention is explained next using FIG. 13 and FIG. 14. The liquid crystal display device to which the driving waveform in this embodiment is applied is the same as that explained in the first embodiment using FIG. 1 to FIG. 6, and thus the explanation thereof is omitted.

FIG. 13 shows a second standard selection signal D1 and second standard data signals D2 and D3, which are the driving waveform in the standard mode in this embodiment.

FIG. 13 is also the same as FIG. 9 in that the horizontal axis is a time axis 61, the vertical axis represents voltage, and the middle of the scale set for each waveform shows a voltage of 0 V.

Each standard signal of the second embodiment of this invention applies an alternate current waveform by switching between signals of positive polarity and negative polarity for each field of Tf(+) and Tf(−). A voltage of positive polarity is applied in the Tf(+) field, and a voltage of negative polarity is applied in the Tf(−) field.

To prevent flicker, one field is set 16 milliseconds (msec.) to several msec. in the case of the display sequentially updated, and it shall be 1/120 of a second (about 8 milliseconds) here. In the case of a short write period, an increase in the frequency for driving the liquid crystal and an increase in the voltage applied to the liquid crystal cause an increase in the electric current consumed by the liquid crystal display device.

A second standard selection signal D1 is composed of a five-level signal of V1, V2, V3, V4 and V5. In the Tf(+) field, during a selection period 64 for selecting a first scanning electrode, a first selection signal voltage at the voltage level V5 is applied to the scanning electrode and a first non-selection signal voltage at the voltage level V3 is applied during the other selection periods. In the Tf(−) field, a second selection signal voltage at the voltage level V1 is applied to the scanning electrode during the selection period 64 for selecting the first scanning electrode, and a second non-selection signal voltage at the voltage level V3 is applied during the other selection periods.

The second standard selection signal to be applied to a second scanning electrode applies, in the Tf(+) field, the first selection signal voltage at the voltage level V5 during a selection period for selecting the second scanning electrode and the first non-selection signal voltage at the voltage level V3 during the other selection periods.

Similarly, the second standard selection signal to be applied to a third scanning electrode applies, in the Tf(+) field, the first selection signal voltage at the voltage level V5 during a selection period for selecting the third scanning electrode and the first non-selection signal voltage at the voltage level V3 during the other selection periods.

To other scanning electrodes, the selection signal voltage for selecting the scanning electrodes and the non-selection voltage are similarly applied in a time division manner.

On the other hand, a ternary signal at V2, V3 and V4 is applied to a data electrode to perform ON/OFF display. A second standard data signal D2 is shown here.

This second standard data signal D2 applies, in the Tf(+) field, a first data voltage at V2 during the selection period 64 and a voltage at V3 during the other periods. In the Tf(−) field, a second data voltage at V4 is applied during the selection period 64.

The second standard data signal D2 is a waveform for applying a large voltage (V5−V2) only to the liquid crystal layer 15 at a pixel on a first row on the data electrode, to which the signal is applied, to bring the pixel into the dark display and not applying a voltage having a large absolute value to the pixels formed by the data electrode and other scanning electrodes to hold the display in the Tf(+) field, and for applying a negative voltage having a large absolute value (V1−V4) only to the liquid crystal layer 15 at the pixel on the first row on the data electrode, to which the signal is applied, to bring the pixel into the bright display and not applying a voltage having a large absolute value to the other pixels to hold the display in the Tf(−) field.

A second standard data signal D3 is also shown as a signal to be applied to another data electrode. On the data electrode to which this signal is applied, in the Tf(+) field, a large voltage is applied to the liquid crystal layer 15 at pixels on odd-numbered rows so that the pixels become the dark display, and a voltage having a large absolute value is not applied to the liquid crystal layer 15 at pixels on even-numbered rows so that the display is held. In the Tf(−) field, a negative voltage having a large absolute value is applied to the liquid crystal layer 15 at the pixels on the odd-numbered rows so that the pixels become the bright display, and a voltage having a large absolute value is not applied to the liquid crystal layer 15 at the pixels on the even-numbered rows so that the display is held.

Assuming that the number of scanning electrodes is 480, the selection period 64 shown in FIG. 13 is 17 microseconds as one field Tf is 1/120 of a second, and further a potential difference between the voltages V5 and V1 of 30 volts is required, which requires switching of a large voltage in a short time, resulting in a state of a large amount of electric power being consumed by the circuit for generating the selection signal and the data signal and the liquid crystal display panel 3. In other words, the liquid crystal display device is in a state of consuming a large amount of electric power.

FIG. 14 shows a third power-saving selection signal E1 and a third power-saving data signal E2, and E3 which is a composite waveform of them and a waveform showing a voltage to be applied to the liquid crystal layer 15 at a portion where the scanning electrode and the data electrode oppose each other, which are the driving signal in the power-saving mode in this embodiment.

FIG. 14 is also the same as FIG. 9 in that the horizontal axis is a time axis 61, the vertical axis represents voltage, and the middle of the scale set for each waveform shows a voltage of 0 V. However, a Ti(+) field and a Ti(−) field each for displaying one picture shall be 1 second which is a time period 120 times longer than each of the Tf(+) field and the Tf(−) field in the case of the standard mode shown in FIG. 13. Accordingly, a power-saving selection period 80 is a period of about 2 milliseconds which is also 120 times longer than the selection period 64 shown in FIG. 13.

The third power-saving selection signal E1 applies a voltage at Va during the power-saving selection period 80 for selecting the first scanning electrode and a voltage at Vc during the other periods. The third power saving data signal E2 is an example of a data signal for bringing the pixel on the first row on the data electrode, to which the signal is applied, into the dark display, and applies a voltage at Vd during the power-saving selection period 80 and a voltage at Vc during the other periods.

As a result, in the power-saving selection period 80, a relatively large plus voltage is applied to the liquid crystal layer 15 at the pixel on the first row on the data electrode to which the third power-saving data signal E2 is applied, so that the pixel becomes the dark display.

Since the increase in selection period enables an optical change to be induced in the liquid crystal layer 15 by a signal having a small voltage amplitude, the driving voltage becomes five levels from Va to Ve, so as to make the potential difference about 10 volts that is a fraction of the potential difference between V5 and V1 shown in FIG. 13. This only requires switching of an extremely small voltage, resulting in a state of an extremely small electric power consumed by the circuit for generating the selection signal and the data signal, and the liquid crystal display panel. In other words, the liquid crystal display device can be in a state of consuming an extremely small amount of electric power.

Further, the third power-saving selection signal E1 and the third power-saving data signal E2 shown in FIG. 14 are not reversed in polarity in each of the fields Ti(+) and Ti(−). In other words, when the display is performed in the power-saving mode, switching of voltage of the signal waveform is reduced in number as small as possible for prevention of disorder of display and for power saving. When writing is performed to bring a pixel into the bright display, however, the display is performed using a signal which is reversed in polarity.

It is possible to attain the optical change at a low voltage by employing the liquid crystal layer 15 which is composed of a liquid crystal with a memory property for attaining the optical change by accumulating applied electric power, and preparing a plurality of switching frequencies of the selection signal and the data signal to select in accordance with the driving condition as described above, particularly by increasing each field to be the order of a second or more, so that the amount of electric power consumed by the liquid crystal display panel can be reduced to enable a further reduction in the power consumption of the liquid crystal display device.

Figure 15:
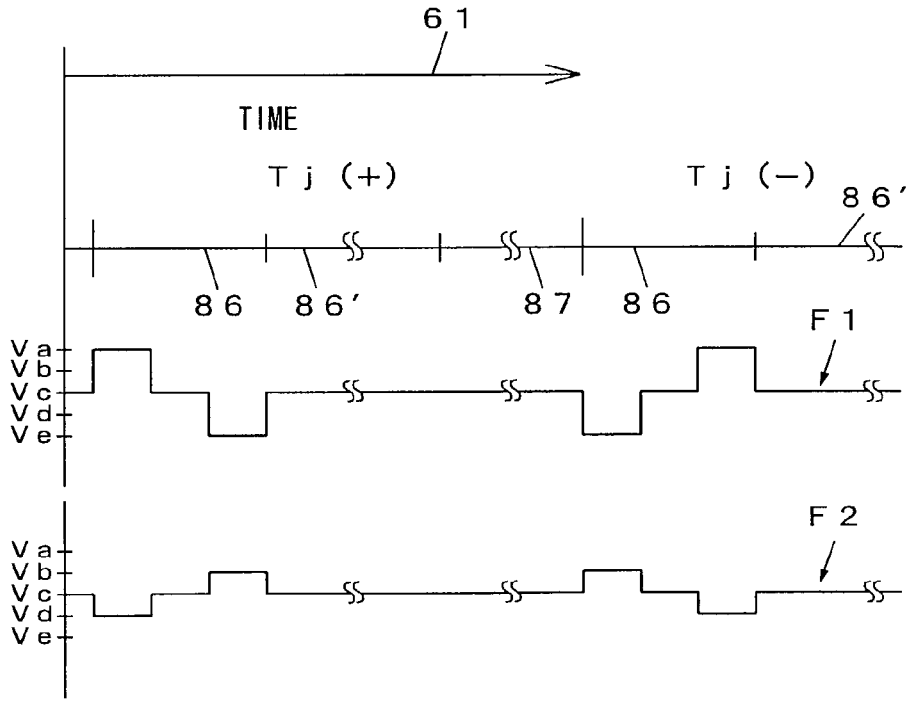
FIG. 15 is a waveform diagram showing an example of the driving signal in the power-saving mode used in a third embodiment of the invention.

Third Embodiment: FIG. 15

The driving waveform of a liquid crystal display device in the third embodiment of this invention is explained next using FIG. 15.

The liquid crystal display device to which the driving waveform in this embodiment is applied is the same as that explained in the first embodiment using FIG. 1 to FIG. 6, and thus the explanation thereof is omitted. Further, the driving waveforms in the standard mode explained in the first and second embodiments may be used for the driving waveform in the standard mode in this embodiment, and thus the explanation thereof is also omitted.

FIG. 15 shows a fourth power-saving selection signal F1 and a fourth power-saving data signal F2 which are the driving waveforms in the power saving mode in this embodiment.

FIG. 15 is also the same as FIG. 9 in that the horizontal axis is a time axis 61, the vertical axis represents voltage, and the middle of the scale set for each waveform shows a voltage of 0 V. However, write periods in a Tj(+) field and a Tj(−) field are very long as compared to those of the standard selection signal, and they are periods of 100 milliseconds to the order of a second.

The third embodiment is characterized in that, to prevent an unbalance of charge in the liquid crystal layer 15, a selection signal and a data signal, each of which is a group of three voltages composed of a positive voltage, a zero voltage and a negative voltage, are applied in the selection period for selecting one scanning electrode such that the potential difference between the selection signal and the data signal has positive and negative values symmetrical with respect to the ground potential. It is another characteristic that a liquid crystal layer charge memory period 87, during which the selection signal and the data signal are at the same potential without potential difference therebetween, is provided in addition to the selection period for selecting each scanning electrode to allow the liquid crystal layer to hold the charge during this period.

In the fields Tj(+) and Tj(−) of this embodiment, in addition to a power-saving selection period 86 representing a period for selecting the first scanning electrode and a power-saving selection period 86' which is a period for selecting the other scanning electrodes, the liquid crystal layer charge memory period 87 is provided for holding the display at the point of time when the voltage applied to the liquid crystal layer 15 is brought to zero in the whole display region. Therefore, the fields Tj(+) and Tj(−) are called write periods for convenience, which does not mean that a write is being performed at any scanning electrode all the time during the periods.

The fourth power-saving selection signal shown by F1 sequentially applies voltages at three levels Va, Vc and Ve during the power-saving selection period 86 in the Tj(+) field. The voltage at Vc is applied during the other periods including the liquid crystal layer charge memory period 87. On the other hand, the fourth power-saving data signal F2 is an example of a data signal for bringing the pixel on the first row on the data electrode into the dark display, and sequentially applies voltages at three levels Vd, Vc and Vb during the power-saving selection period 86. The voltage at Vc is applied during the other periods including the liquid crystal layer charge memory period 87.

As a result, during the power-saving selection period 86, a positive voltage (Va−Vd), a zero voltage (Vc−Vc), and a negative voltage (Ve−Vb) are sequentially applied to the liquid crystal layer 15 at the pixel on the first row on the data electrode to which the fourth power-saving data signal F2 is applied, resulting in the bright display at last. During the other periods, a zero voltage is applied to the liquid crystal layer 15, so that the display is held.

In the Tf(−) field, the fourth power-saving selection signal F1 sequentially applies voltages at three levels Ve, Vc and Va during the power saving selection period 86. The voltage at Vc is applied during the other periods including the liquid crystal layer charge memory period 87. On the other hand, the fourth power-saving data signal F2 is an example of a data signal for bringing the pixel on the first row on the data electrode into the dark display, and sequentially applies the voltages at three levels Vb, Vc and Vd during the power-saving selection period 86. The voltage at Vc is applied during the other periods including the liquid crystal layer charge memory period 87.

As a result, during the power-saving selection period 86, a negative voltage (Ve−Vb), a zero voltage (Vc−Vc), and a positive voltage (Va−Vd) are sequentially applied to the liquid crystal layer 15 at the pixel on the first row on the data electrode to which the fourth power-saving data signal F2 is applied, resulting in the dark display at last. During the other periods, a zero voltage is applied to the liquid crystal layer 15, so that the display is held.

The positive and negative voltages symmetrical with respect to the ground potential are applied during the selection period for selecting one scanning electrode as described above to prevent unbalance of charge in the liquid crystal layer 15.

Accordingly, Tf(+) is a field for writing the bright display and Tf(−) is a field for writing the dark display. Further, it is not always necessary to provide the Tf(+) field and the Tf(−) field alternately, and, for example, when only the bright display needs to be written, only the Tf(+) filed may be provided in succession. Furthermore, the length of each field is not necessarily fixed, and the liquid crystal layer charge memory period 87 may be continued after a write is performed until rewriting of the display becomes necessary next.

Further, it is also applicable to provide the liquid crystal layer charge memory period 87 after a field provided with no liquid crystal layer charge memory period 87 is repeated a plurality of times.

If the same display is continued in succession for a long time, for example, for several minutes to several hours, and more than that, for several days, until the display is rewritten, the selection of the first scanning electrode in the display region to the selection of the last scanning electrode are implemented in serial to write the same display again every predetermined time, for example, every minute or every hour, but the power consumption increases.

In the case of the same display continued for a long time, the power consumption can be reduced here by counting the time period of the liquid crystal layer charge memory period 87 or by providing an environment sensor provided in the liquid crystal display device, particularly, an optical sensor for sensing the brightness in the external environment to select the number of implementation of rewriting the display depending on the brightness.

The above configuration is very effective particularly in the case of a reflection-type liquid crystal display device, which has a solar cell as a photovoltaic element and performs display utilizing light from the external environment in a normal use condition of the liquid crystal display device, because the brightness in the external environment is sensed based on the amount of power generated by the solar cell to conduct power saving when the amount of power generation decreases to thereby attain the reduction in power consumption of the liquid crystal display device.

Such an embodiment will be described later in detail.

Figure 16:
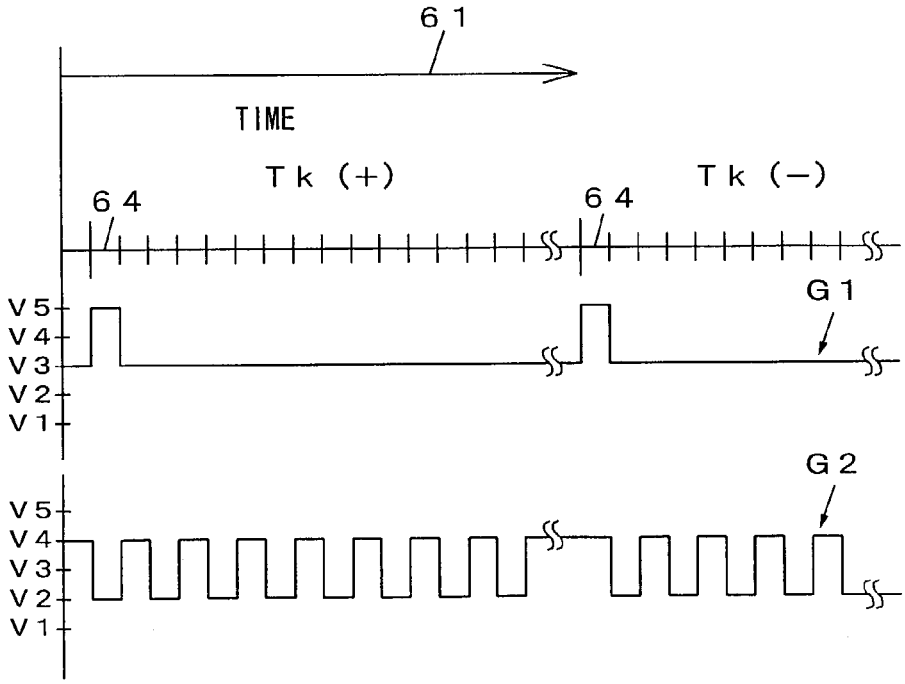
FIG. 16 is a waveform diagram showing an example of the driving signal in the standard mode used in a fourth embodiment of the invention.
Figure 17:
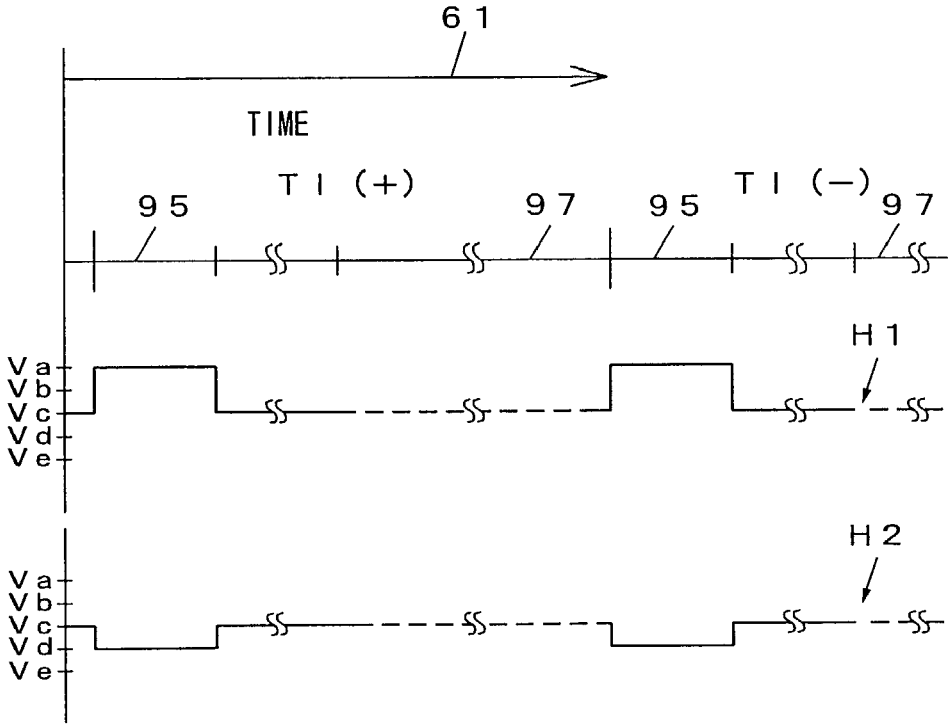
FIG. 17 is a waveform diagram showing a first example of the driving signal in the power-saving mode used in the fourth embodiment of the invention.
Figure 18:
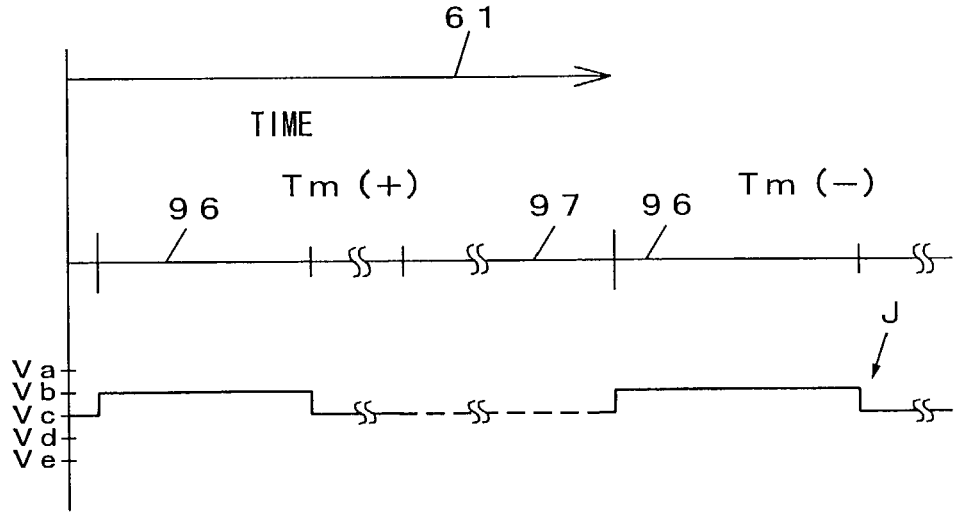
FIG. 18 is a waveform diagram showing a second example of the driving signal in the power-saving mode of the same.

Fourth Embodiment: FIG. 16 to FIG. 18

The driving waveform of a liquid crystal display device in the fourth embodiment of the invention is explained next using FIG. 16 to FIG. 18. This embodiment is characterized in that, after selection of scanning electrodes corresponding to the entire display region, a period is provided during which the electrodes are set at the floating potential, or that, after selection of scanning electrodes corresponding to a region where the display is updated within the display region, a period is provided during which the electrodes are set at the floating potential, in the power-saving mode.

The liquid crystal display device to which the driving waveform in this embodiment is applied is the same as that explained in the first embodiment using FIG. 1 to FIG. 6, and thus the explanation thereof is omitted.

FIG. 16 shows a third standard selection signal G1 and a third standard data signal G2 which are the driving waveform in the standard mode in this embodiment.

FIG. 16 is also the same as FIG. 9 in that the horizontal axis is a time axis 61, the vertical axis represents voltage, and the middle of the scale set for each waveform shows a voltage of 0 V.

Each of fields Tk(+) and Tk(−) is 1/120 of a second, and the entire picture is rewritten at 120 Hz.

The third standard selection signal G1 applies a voltage at V5 to select a first scanning electrode during a selection period 64 and a voltage at V3 during the other periods.

This third standard data signal G2 applies, in the Tk(+) field, a voltage at V2 during periods for selecting odd-numbered scanning electrodes and a voltage at V4 during periods for selecting even-numbered scanning electrodes. Accordingly, a large voltage is applied to the odd-numbered rows to write the dark display, and a voltage having a large absolute value is not applied to the even-numbered rows to hold the display as it is. In the Tk(−) field, the voltage at V4 is applied during the periods for selecting the odd-numbered scanning electrodes and the voltage at V2 is applied during the periods for selecting the even-numbered scanning electrodes. Accordingly, a voltage having a large absolute value is not applied to the odd-numbered rows to hold the display as it is, and a large voltage is applied to the even-numbered rows to produce the dark display.

In this embodiment, the selection signals applied in Tk(+) and Tk(−) are of the same polarity to reduce the power consumption also when the standard signals are in use. When the bright display is written in the pixel, however, a period is also provided during which a signal of reversed polarity is applied.

Assuming that the number of scanning electrodes is 480, the selection period 64 in the third standard selection signal G1 shown in FIG. 16 is 17.4 microseconds as each of the Tk(+) field and the Tk(−) field is 1/120 of a second, and further the difference between voltages V5 and V1 is 30 volts, which requires switching of a large voltage in a short time, resulting in a state of a large amount of electric power consumed by the circuit for generating the selection signal and the data signal, and the liquid crystal display panel. In other words, the liquid crystal display device is in a state of consuming a large amount of electric power.

FIG. 17 shows a fifth power-saving selection signal H1 and a fifth power-saving data signal H2, which are the driving signal in the power-saving mode in this embodiment.

FIG. 17 is also the same as FIG. 9 in that the horizontal axis is a time axis 61, the vertical axis represents voltage, and the middle of the scale set for each waveform shows a voltage of 0 V.

Each of fields Tl(+) and Tl(−) shall be a time period several tens of times longer than each of the fields Tk(+) and Tk(−) in the standard mode. This enables the voltage levels for use to be equal to or less than one-third V1 to V5 of the standard signal, so that Va to Ve are used. Further, after selection of scanning electrodes corresponding to the entire display region, a floating period 97, during which the scanning electrodes and the data electrodes are set at the floating potential, is provided as a liquid crystal layer charge memory period. Accordingly, each of the T1(+) field and the T1(−) field are called a write period for convenience, which does not mean that a writing is being performed at any scanning electrode all the time during the periods.

The fifth power-saving selection signal H1 applies the voltage at Va during a power-saving selection period 95 for selecting the first scanning electrode and the voltage at Vc during periods for selecting the other scanning electrodes. Further, the scanning electrode is set at the floating potential during the floating period 97 thereafter, the signal during the period being shown by a broken line (the same applying to waveform diagrams illustrated hereafter).

The fifth power-saving data signal H2 applies the voltage at Vd during the power-saving selection period 95 to thereby apply a large voltage to the liquid crystal layer at the pixel on the first row on the data electrode to which the signal is applied so as to bring the pixel into the dark display, and applies the voltage at Vc during the other power-saving selection periods to hold the display contents. The data electrode is set at the floating potential during the floating period 97 thereafter.

The floating period 97 is preferably provided after the display is written once until the display needs to be written next. The potentials of the scanning electrodes and the data electrodes are set at the floating potential when there is no updating of the display as described above, which makes it possible to stop the drive circuit in a state in which a predetermined display is presented, resulting in a possibility of almost no power consumption of the liquid crystal display device.

Further, the liquid crystal display device can also be driven in a power-saving mode in which the selection period is increased to be still several tens of times longer than that of the fifth power-saving selection signal H1. FIG. 18 shows a sixth power-saving selection signal J. In the sixth power-saving selection signal J, it becomes possible to use a voltage level still lower than that of the fifth power-saving selection signal H1 in accordance with the increase in the selection period. It is possible to use a voltage level still lower than that of the fifth power-saving data signal H2, for a sixth power-saving data signal though the illustration thereof is omitted, In this power-saving mode, the display can be performed at a voltage level equal to or less than one-tenth that of the standard signal, which makes it possible to further reduce the power consumption.

As for the signals shown here, the selection signals applied in the fields Tl(+) and Tm(+), and Tl(−) and Tm(−) are of the same polarity to reduce the power consumption, but when the bright display is written in the pixel, a period is also provided during which a signal of reversed polarity is applied.

Further, the example is explained here in which the floating period 97 is provided after performance of a whole display rewriting that the scanning electrodes within the entire display region 37 are sequentially selected to rewrite the display contents of all the pixel portions. However, when there is no need to update the display of the entire display region 37, it is also possible that the scanning electrodes corresponding to a display updating region that is a part of the display region 37 are sequentially selected, and a data signal is applied to associated data electrodes to thereby perform a partial display rewriting, and thereafter the electrodes are set at the floating potential. In this event, the electrodes to which no signal is applied are preferably set at the floating potential. This can further reduce the power consumption.

Figure 19:
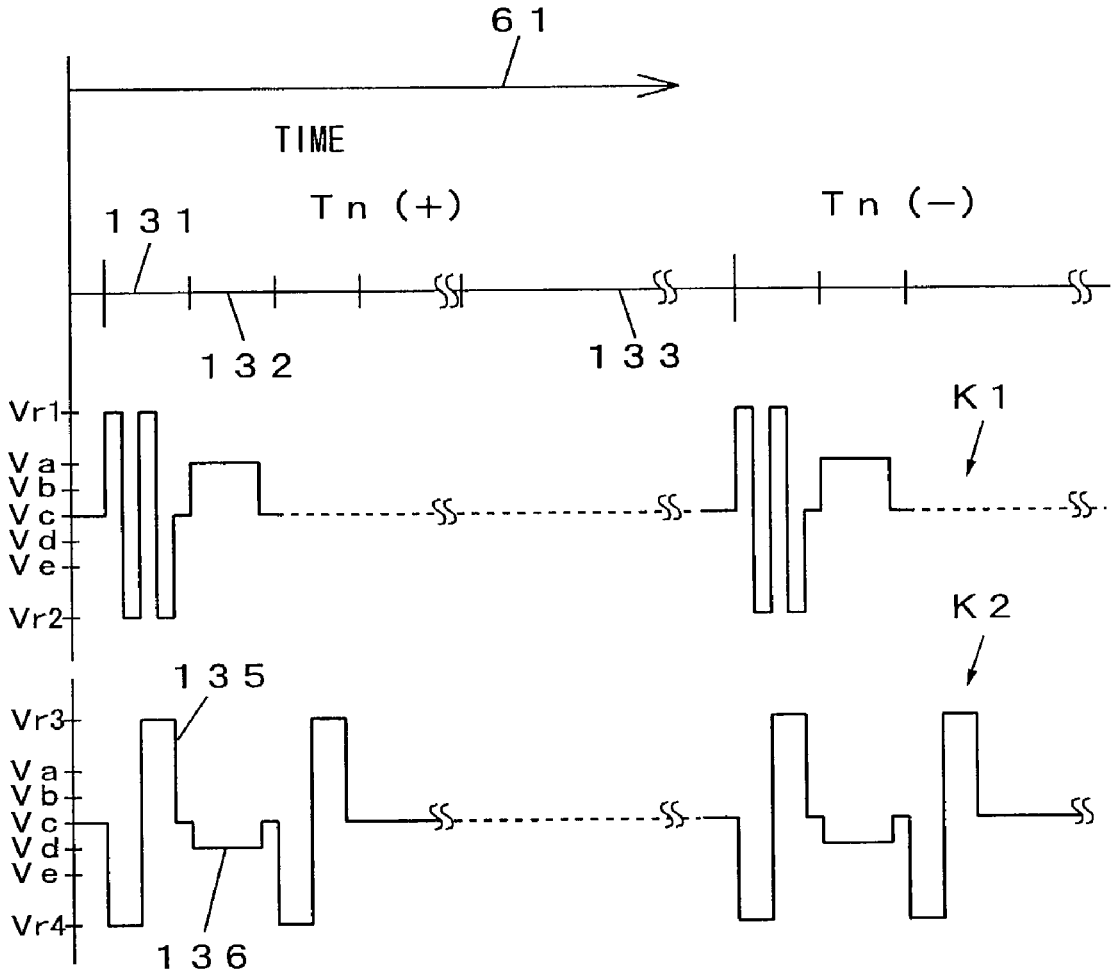
FIG. 19 is a waveform diagram showing an example of the driving signal in the power-saving mode used in a fifth embodiment of the invention.

Fifth Embodiment: FIG. 19

The driving waveform of a liquid crystal display device in the fifth embodiment of the invention is explained next using FIG. 19.

The liquid crystal display device to which the driving waveform in this embodiment is applied is the same as that explained in the first embodiment using FIG. 1 to FIG. 6, and thus the explanation thereof is omitted. Further, the driving waveforms in the standard mode explained in the first, second, and fourth embodiments may be appropriately selected for use for the driving waveform in the standard mode in this embodiment, and thus the explanation thereof is also omitted.

FIG. 19 shows a seventh power-saving selection signal K1 and a seventh power-saving data signal K2 which are the driving waveform in the power-saving mode in this embodiment. FIG. 19 is also the same as FIG. 9 in that the horizontal axis is a time axis 61, the vertical axis represents voltage, and the middle of the scale set for each waveform shows a voltage of 0 V.

In this power-saving mode, in each of fields Tn(+) and Tn(−), a refresh period 131 is provided before a power-saving selection period 132 for applying the selection signal to each scanning electrode, and further, a floating period 133 for setting the scanning electrodes and the data electrodes at the floating potential is provided, as a liquid crystal layer charge memory period, after completion of selection of all the scanning electrodes within the display region. Accordingly, each of the Tn(+) field and the Tn(−) field is called a write period for convenience, which does not mean that a writing is being performed at any scanning electrode all the time during the periods.

The power-saving selection period 132 is several ten of times or more longer than the selection period of the standard signal, and therefore a voltage level of the applied signal is equal to or less than a fraction of that of the standard signal. Further, each of the fields Tn(+) and Tn(−) shall be a period of 100 milliseconds to the order of a second, but they are not necessarily the same length, and further they can also be a very long period such as one minute, one hour, or one day when there is no need to rewrite the display.

The seventh power-saving selection signal K1 alternately applies voltages having large absolute values at potentials Vr1 and Vr2 of opposite polarities plural times during the refresh period 131 which is provided before the power-saving selection period 132 for selecting the first scanning electrode, and a voltage at Va during the power-saving selection period 132 to select the scanning electrode, and the scanning electrode shall be set at the floating potential during the other periods. Since there is no need here to apply a voltage to the first scanning electrode except for the refresh period 131 and the power-saving selection period 132, the first scanning electrode is set at the floating potential during not only the floating period 133 but also all the periods other than the refresh period 131 and the power-saving selection period 132.

The power-saving selection signals are also applied to the other scanning electrodes to select them in a time division manner, and in each of the signals, the scanning electrode shall be set at the floating potential during the periods other than the power-saving selection period corresponding to the scanning electrode to which the signal is applied and the refresh period.

The seventh power-saving data signal K2 alternately applies voltages having large absolute values at Vr3 and Vr4 of opposite polarities during the refresh period corresponding to each scanning electrode, a voltage at Vd during the selection period 132, and a voltage at Vc during the other selection periods. Further, the scanning electrode shall be set at the floating potential during the floating period 133.

By applying such signals, positive and negative voltages having large absolute values are applied to the liquid crystal layer 15 during the refresh period to cancel unbalance of charge, resulting in prevention of a decrease in the display quality such as an afterimage due to the unbalance of charge. A negative voltage is applied at the end of the refresh period to produce the bright display. During the selection period thereafter, the pixel, in which the voltage at Vd is applied to the data electrode thereof by the seventh power-saving data signal, can be brought into the dark display by applying a large positive voltage thereto.

In this embodiment, the same waveform is repeated in the fields Tk(+) and Tk(−) in the seventh power-saving selection signal, and it is also applicable to reverse both polarities of the seventh power-saving selection signal and the seventh power-saving data signal so as to bring the state after the refresh into the dark display and thereafter write the bright display.

Further, the scanning electrode is set at the floating potential during the periods other than the power-saving selection period corresponding to the scanning electrode to which the seventh power-saving selection signal is applied and the refresh period, and thus if a large voltage is applied to the data electrode during the refresh period, there is no influence exerted on the display.

Furthermore, since the floating period 133 is provided after the completion of selection of all the scanning electrodes, the power consumption can be reduced.

It should be noted that the example in which the positive and negative voltages having large absolute values are alternately applied during the refresh period is explained in this embodiment, and it is also applicable to apply a voltage larger than the voltage applied to the liquid crystal layer in displaying or a voltage which sweeps from a large voltage to a small voltage or from a large voltage to a small voltage and further to a smaller voltage.

Sixth Embodiment: FIG. 20 to FIG. 23

A liquid crystal display device that is the sixth embodiment of the invention is explained next using FIG. 20 and FIG. 21.

This liquid crystal display device is a liquid crystal display device provided with a photovoltaic element as a power generating element, and is different from the liquid crystal display device explained in the first embodiment using FIG. 1 to FIG. 6 only in this point and in that the diffusing layer 20 is not provided, and thus the explanation except for these points is omitted.

Figure 20:
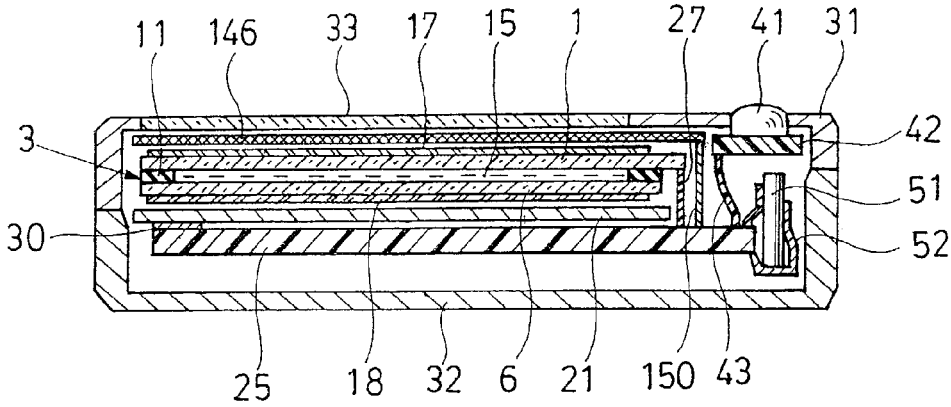
FIG. 20 is a cross-sectional view, similar to FIG. 2, of a liquid crystal display device provided with a photovoltaic element that is a sixth embodiment of the invention.

FIG. 20 is a cross-sectional view, corresponding to FIG. 2, of the liquid crystal display device of this embodiment. FIG. 21 is an enlarged cross-sectional view showing the enlarged cross section of a liquid crystal display panel thereof.

In this liquid crystal display device, as shown in FIG. 20, a solar cell unit 146 that is a photovoltaic element is provided at a position overlapping the display portion on a glass 33 side (visible side) of the liquid crystal display panel, and is connected to a circuit board 25 by a solar cell connecting FPC 150. In this liquid crystal display device, electric power generated by the solar cell unit 146 is an energy supply, and a battery 51 is used as a secondary battery.

Figure 21:
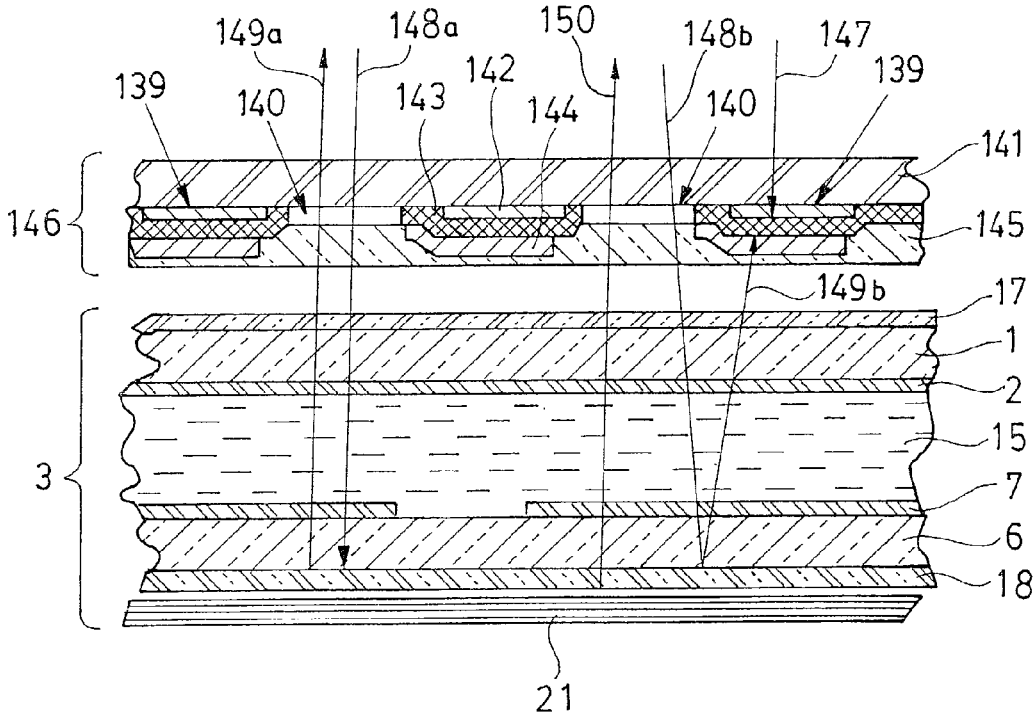
FIG. 21 is a partially enlarged cross-sectional view of a liquid crystal display panel of the liquid crystal display device.

In the solar cell unit 146, as shown in FIG. 21, power generating portions 139 and transmitting portions 140 are alternately provided on a solar cell substrate 141 that is a transparent substrate. The power generating portions 139 and the transmitting portions 140 are arranged in stripes, and although the area of the power generating portion 139 is shown large for convenience of illustration, the ratio of the area of the transmitting portions 140 to the total area of the power generating portions 139 and the transmitting portions 140 (the transmittance ratio) is actually 80%. Therefore, an observer can recognize display on the liquid crystal display panel through the transmitting portions 140 of the solar cell unit 146.

The power generating portion 139 has a configuration in which a semiconductor layer (power generating layer) 143 having a PIN junction constituted by a P-type, an I-type and an N-type amorphous silicon (a-Si) is provided between a first solar cell electrode 142 and a second solar cell electrode 144 which are transparent conductive films respectively.

Further, a protective layer 145 made of a polyimide resin is provided on the solar cell substrate 141 to prevent the power generating portions 139 from deteriorating.

Further, on the opposite side to the observer of the liquid crystal display panel, an auxiliary light source 21 composed of an EL element is provided to form a transflective liquid crystal display device which can perform a reflection-type display using incident light from a use environment of the liquid crystal display device as a main light source and a transmission-type display by light emitted from the auxiliary light source. Since the liquid crystal display device of this embodiment is not provided with the diffusing layer 20, the bright display of the reflection-type display becomes a mirror display.

The direction of the light when the external light source (not shown) and the auxiliary light source 21 are in use is explained here with FIG. 21.

A first incident light 147 which is made incident on the power generating portion 139 of the solar cell unit 146 from the external light source is used for photovoltaic generation and is not made incident on the liquid crystal display panel. A second incident light 148*a* which is made incident on the transmitting portion 140 is reflected by a second polarizer 18 that is a reflection-type polarizer and then made incident on the transmission axis of a first polarizer 17 to go out to the observer side as a first outgoing light 149*a* when the pixel is in the bright display due to a liquid crystal layer 15. In the case of the dark display, the light is reflected and then made incident on the absorption axis of the first polarizer 17 to be absorbed.

In the case of the above bright display, an incident light 148*b* which is a part of light incident from the external light source is reflected by the second polarizer and then reaches the power generating portion 139 as an outgoing light 149*b*, which makes it possible to increase the amount of power generation.

On the other hand, an auxiliary light source outgoing light 150 outgoing from the auxiliary light source 21 outgoes to the observer side when the pixel is in the transmission state due to the liquid crystal layer 15 and the first and second polarizers 17 and 18, and outgoes to the observer side in a small amount in the absorption state. Therefore, the amount of light incident on the power generating element is small. Further, because of insufficient light emission efficiency of the auxiliary light source 21 and power generation efficiency of the photovoltaic element, it has not been realized yet to update the display contents of the liquid crystal display panel by the power generated in the power generating element only by the light emission of the auxiliary light source 21 of the liquid crystal display device in the status quo.

However, the power generation is performed by utilizing the main light source in the external environment, and the driving signal to be applied is selected such that the amount of power consumed by the liquid crystal display device becomes a value matching the amount of power generation, so as to attain a self-standing liquid crystal display device without necessity of being supplied with electric energy from other means.

Figure 22:
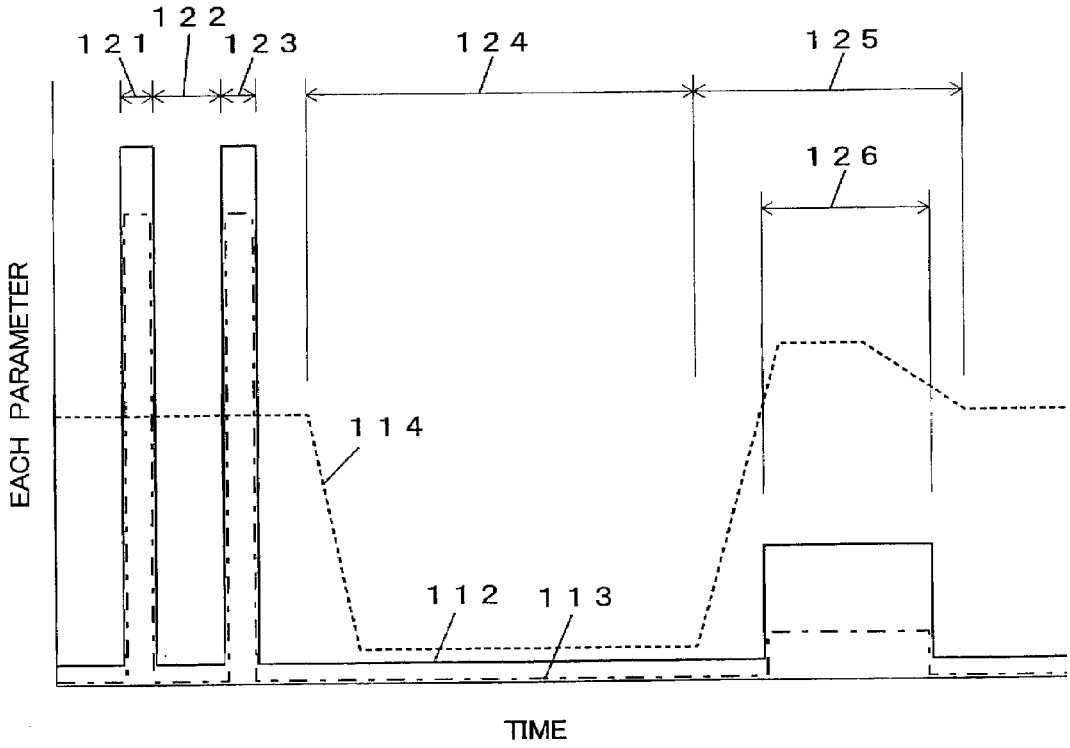
FIG. 22 is a graph showing the relationship between the amount of power generation in the liquid crystal display device and the response time and the power consumption of the liquid crystal display panel.
Figure 23:
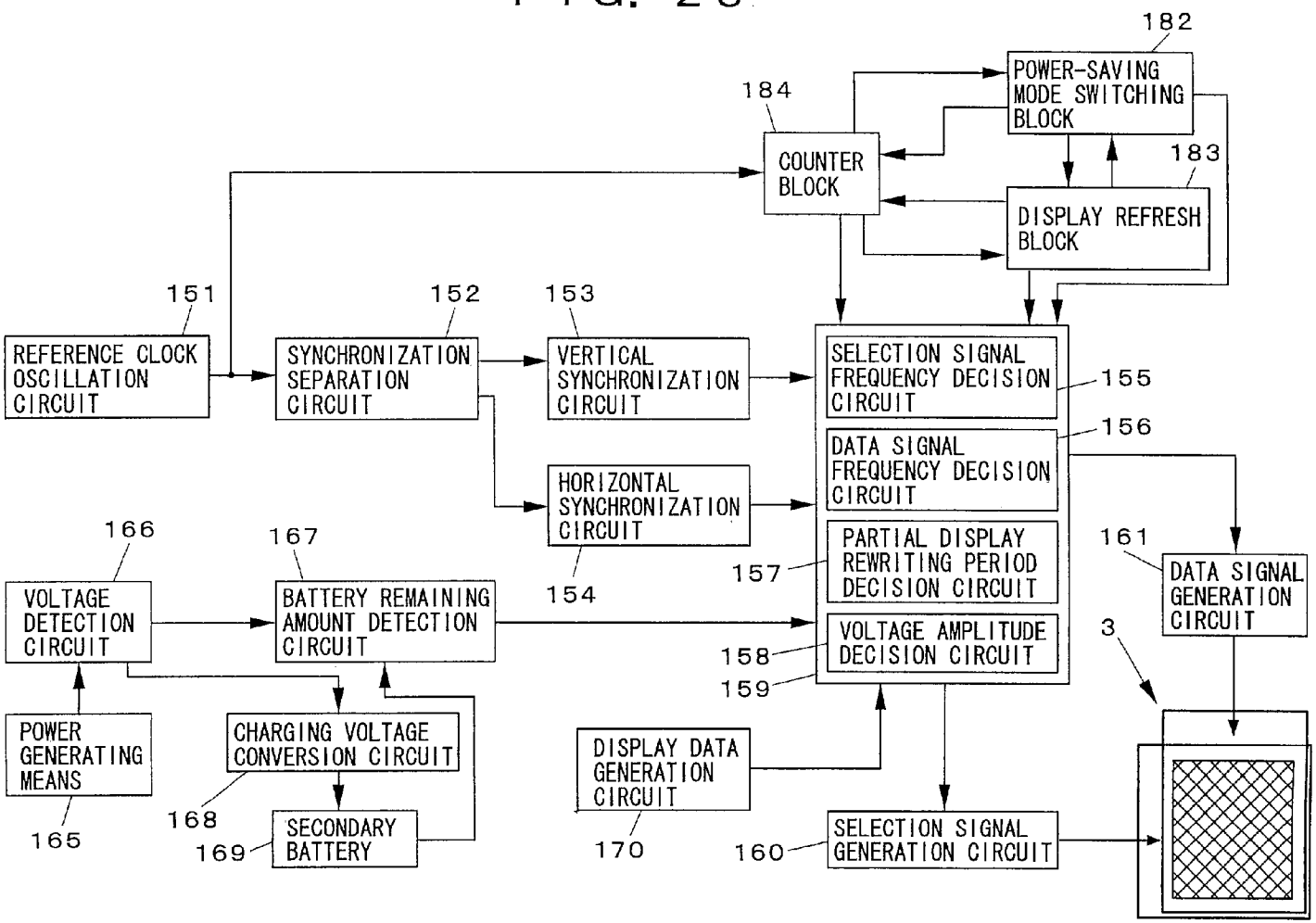
FIG. 23 is a system block diagram of a drive circuit of the liquid crystal display device.

A method for selecting such a driving signal and a control circuit thereof are explained here using FIG. 22 and FIG. 23.

FIG. 22 is a diagram showing the relationship between the amount of power generation in the liquid crystal display device of this embodiment and the response time and the power consumption of the liquid crystal display panel. FIG. 23 is a system block diagram of the drive circuit of the liquid crystal display device.

In the graph in FIG. 22, the horizontal axis represents elapse of time and the vertical axis represents the magnitude of each parameter at the point of time. A curved line 114 shows the amount of power generated by the solar cell, a curved line 113 shows the power consumption of the liquid crystal display device, and a curved line 112 shows the frequency of updates of the display contents of the liquid crystal display device.

When the amount of power generated by the solar cell and the amount of power remained in the storage battery (secondary battery) are large, the display contents of the liquid crystal display panel are intermittently rewritten during rewriting periods 121 and 123. During these periods, a signal at a relatively high voltage is applied to rewrite at a relatively high speed. A holding period 122, however, is provided between the rewriting periods 121 and 123, so that the scanning electrode and the data electrode are set at the same potential or at least one of them is set at the floating potential to hold the display contents by the memory effect of the liquid crystal layer during this period. It is preferable to select an appropriate signal from among the signals explained in the embodiments (hereafter, such an explanation including signals explained in the following embodiments (except those explained in twelfth and fourteenth embodiments)) for use as the driving signal.

Although the amount of power generated by the solar cell depends on the illumination of the use environment of the liquid crystal display device, in the case the liquid crystal display device is irradiated with about 1000 lux of light in a typical office environment so that assuming that the area of the photovoltaic element is 2 $cm^2$ and the efficiency is about 20%, the amount of power generation is about 70 μW. Further, when the solar cell unit is provided on the observer side of the liquid crystal display panel, the amount of power generation is not so large, about 14 μW, because the area of the power generating portion 139 is about 20% of the photovoltaic element.

Therefore, it is very effective to use not the driving signal in the standard mode but the driving signal in the power-saving mode having a selection period of each scanning electrode of about 1 millisecond also during the rewriting periods 121 and 123 so as to decrease the voltage required for the optical change in the liquid crystal layer.

When the use environment of the liquid crystal display device becomes dark to greatly decrease the amount of power generated by the solar cell unit (during a period 124), it is also necessary to greatly decrease the power consumption of the liquid crystal display device. Accordingly, in such a state, the updating of the display contents is stopped and the scanning electrode and the data electrode are set at the same potential or at the floating potential to hold the display contents, thereby greatly reducing the power consumption without deleting the display.

Further, when the display contents need to be updated in such a state, the signals are applied only to the scanning electrodes and the data electrodes corresponding to the updating region and further an update is performed extremely slowly with the selection period being about one second per one electrode so as to suppress the signal voltages low for control of the power consumption.

The visibility of the liquid crystal display panel is lowered in the state of a dark use environment of the liquid crystal display device, and thus the display contents do not need to be updated in serial, so that the liquid crystal display device is usable even with a minimum update.

In this embodiment, a display "Energy management ON" is performed at a part of the display as a notice of the display contents being updated at a low speed, and this display is made possible with almost no power consumption by holding the display once written without new application of a signal.

When the use environment of the liquid crystal display device becomes bright to increase the amount of power generated by the solar cell (during a period 125), the battery remaining amount of the secondary battery is detected. When the remaining amount is large, the display contents are updated by signals having a large potential difference at a high speed (about a millisecond per scanning electrode). When the remaining amount is small, the display contents are updated by signals having a relatively small potential difference at an intermediate speed (about 100 milliseconds per scanning electrode) to suppress the power consumption low, thereby increasing the battery remaining amount. In the example shown here, the update of the display contents is performed by display rewriting at an intermediate speed during a period 126 since the battery remaining amount is small.

Such switching of the driving signal is performed by a circuit shown in a block diagram in FIG. 23.

This circuit includes a reference clock oscillation circuit 151, a synchronization separation circuit 152, a vertical synchronization circuit 153, a horizontal synchronization circuit 154, a display management block 159, a selection signal generation circuit 160, a data signal generation circuit 161, a voltage detection circuit 166, a battery remaining amount detection circuit 167, a charging voltage conversion circuit 168, a display data generation circuit 170, a counter block 184, a power-saving mode switching block 182, and a display refresh block 183.

A signal of the reference clock oscillation circuit 151 is divided to the vertical synchronization circuit 153 and the horizontal synchronization circuit 154 via the synchronization separation circuit 152, and the vertical synchronization circuit 153 and the horizontal synchronization circuit 154 input a vertical synchronization signal and a horizontal synchronization signal to the display management block 159 respectively.

On the other hand, the power generating condition of a power generating means 165 that is the solar cell unit 146 is detected by the voltage detection circuit 166. The generated energy from the solar cell charges a secondary battery 169 by means of the voltage detection circuit 166 through the charging voltage conversion circuit 168. Further, the battery remaining amount detection circuit 167 detects the conditions of the voltage detection circuit 166 and the secondary battery 169, and sends a signal to the display management block 159.

The display management block 159 is constituted by a selection signal frequency decision circuit 155, a data signal frequency decision circuit 156, a partial display rewriting period decision circuit 157, and a voltage amplitude decision circuit 158, and decides the mode and waveforms of the selection signal and the data signal to be applied in accordance with the conditions of the voltage detection circuit 166 and the secondary battery 169 inputted from the battery remaining amount detection circuit 167 and display data inputted from the display data generation circuit 170. Then, predetermined signals are transferred to the selection signal generation circuit 160 and the data signal generation circuit 161, so that the liquid crystal display panel 3 is driven by the selection signal and the data signal generated by these circuits to perform display.

The signal waveform to be applied to the liquid crystal display panel is divided into the rewriting period, the holding period, the refresh period, the floating period and the like to control the voltage and time by the display management block 159, which makes it possible to greatly reduce the power consumption of the display by the liquid crystal display panel. Further, the amount of power generated by the power generating means 165 and the remaining amount of the secondary battery 169 are detected to control the signal waveform by the display management block 159, which makes it possible to continue the display even if the amount of power generation decreases.

Further, the power-saving mode switching block 182 forcedly sets the power-saving mode or the standard mode in the display management block 159. The power-saving mode includes a plurality of modes, so that the signal waveforms explained in the embodiments are controlled by the display management block 159. Further, it is also possible to set the cycle of updates of the display by the display refresh block 183.

It is also possible that signals from the power-saving mode switching block 182 and the display refresh block 183 are transferred to the counter block 184, and the counter block measures the operating time thereof and controls the power-saving mode switching block 182, the display refresh block 183 and the display management block 159 to perform the power-saving mode switching or the refresh operation at a previously set time.

When the power-saving mode switching button 186 or the display refresh button 185 shown in FIG. 1 are pushed, the signals thereof are inputted into the power-saving mode switching block 182 or the display refresh block 183 respectively, so that it is also possible to switch the mode of the display signal (the power-saving mode or the like) or to perform the display refresh operation by the user operation.

By conducting the above-described driving control, the power consumption can be reduced to realize a self-standing liquid crystal display device.

It is naturally possible to use a thermal power generating element which generates power utilizing temperature difference as a power generating element other than the solar cell or a method of converting kinetic energy into electric energy in the liquid crystal display device of this embodiment. In addition, for example, when the liquid crystal display device is a fixed and self-standing type, there is a method of generating temperature difference utilizing ventilation around the liquid crystal display device or the like, but the use of the photovoltaic element is the most effective.

The use of the photovoltaic element is effective in reducing the thickness and weight, and more particularly, the provision of the power generating element on the observer side of the liquid crystal display panel can increase the area of the power generating element and eliminate the necessity of consideration given to the position of the power generating element. As for the shape of the power generating element, a transmission-type power generating element is effective in which transparent portions and power generating portions are alternately arranged.

Further, the use of a reflection-type polarizer for the polarizer constituting the liquid crystal display panel enables the reflectance from the liquid crystal display panel side to increase and a part of the reflected light to be made incident on the solar cell, resulting in efficient power generation.

It should be noted that a circuit made by removing the power generating means 165, the voltage detection circuit 166, and the charging voltage conversion circuit 168 from the circuit shown in FIG. 23 is applicable to the liquid crystal display device explained in the first embodiment. Furthermore, this circuit is also applicable to liquid crystal display devices of embodiments described below. The circuit shown in FIG. 23 can be applied, as it is, to modifications of those liquid crystal display devices provided with power generating elements.

Figure 24:
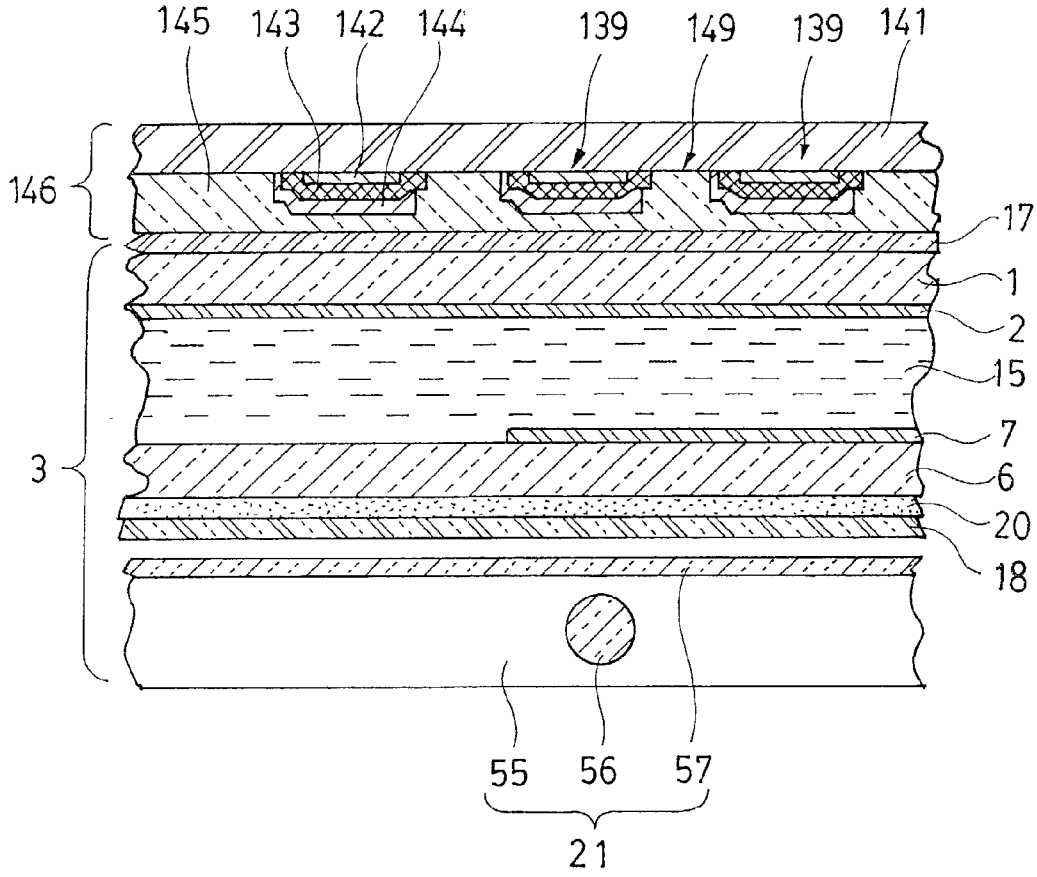
FIG. 24 is a partially enlarged cross-sectional view of a liquid crystal display panel in a liquid crystal display device provided with a photovoltaic element that is a seventh embodiment of the invention.

Seventh Embodiment: FIG. 24

A liquid crystal display device of the seventh embodiment of this invention is explained next using FIG. 24.

FIG. 24 is an enlarged cross-sectional view, corresponding to FIG. 21, of a liquid crystal display panel of the liquid crystal display device of this embodiment, and the same numerals are assigned to portions corresponding to those in FIG. 21.

This liquid crystal display device is the same as the liquid crystal display device of the sixth embodiment explained using FIG. 20 except that a solar cell unit 146 is provided on a first polarizer 17 by bonding thereto, that a diffusing layer 20 is provided between a second substrate 6 and a second polarizer 18, that a cold-cathode tube 56 is used for an auxiliary light source 21 and that a color layer 57 is provided between the auxiliary light source 21 and the second polarizer 18, and thus the explanation except for these points is omitted.

In the solar cell unit 146 of this embodiment, as for power generating portions 139 and transmitting portions 140 arranged in stripes, the ratio of the area of the transmitting portions 140 to the total area of the power generating portions 139 and the transmitting portions 140 (the transmittance ratio) is set 70%. Even in such a configuration, it is possible to recognize the display on the liquid crystal display panel through the transmitting portions 140 of the solar cell unit 146 as in the sixth embodiment.

In this embodiment, there occurs no reflection at interfaces between the solar cell unit 146 and the first polarizer 17 and a gap therebetween because the solar cell unit 146 is provided bonded to the first polarizer 17 with an acrylic adhesive, resulting in improvement of the display quality. Further, it becomes easy to hold the solar cell unit, resulting in a structure with high strength.

Moreover, the diffusing layer 20 is provided to suppress glare of display in the reflection display, so that the bright display in the reflection display becomes a white display.

Moreover, in this embodiment, the auxiliary light source 21 is constituted by the cold-cathode tube 56 that is a light emitting means, a lamp house 55, a scattering plate (not shown), and the color layer 57. An EL plate, however, may be used as in the sixth embodiment.

Also with the liquid crystal display device of this embodiment, the power generation is performed by utilizing the main light source in the external environment, and the driving signal to be applied is selected such that the amount of power consumed by the liquid crystal display device becomes a value matching the amount of power generation, which enables to attain a self-standing liquid crystal display device without necessity of being supplied with electric energy from other means.

The control thereof can be conducted in the same manner as that explained in the sixth embodiment using FIG. 22 and FIG. 23.

The configuration of the solar cell unit and the liquid crystal display device explained here are only examples, and it is also preferable, for example, to dispose the solar cell unit 146 between the first polarizer 17 and the first substrate 1 or on a face on the liquid crystal layer 15 side of the first substrate 1. Further, it is also possible to form the first polarizer 17 with the solar cell unit 146 to serve as both of them.

Such a change is also applicable to the liquid crystal display device of the sixth embodiment.

Figure 25:
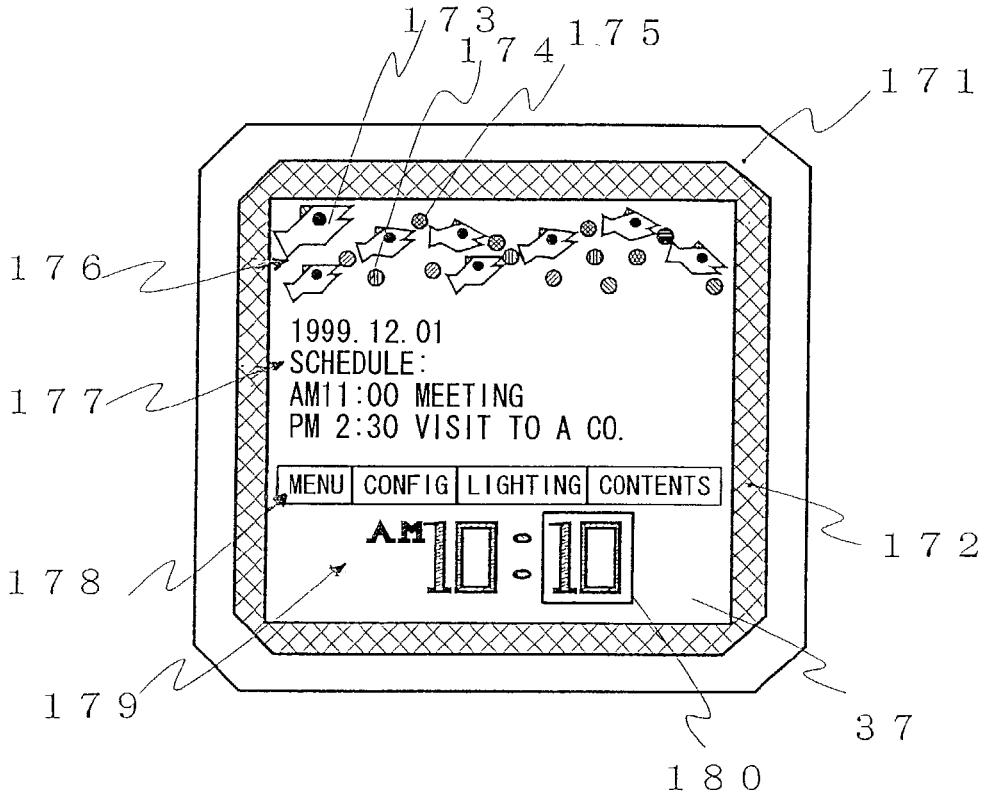
FIG. 25 is a plan view of a liquid crystal display device of an eighth embodiment of this invention.

Eighth Embodiment: FIG. 25

A liquid crystal display device of the eighth embodiment of this invention is explained next using FIG. 25. FIG. 25 is a plan view showing an external appearance of a digital timepiece using the liquid crystal display device of this embodiment.

As shown in FIG. 25, this timepiece 171 has a display region 37 composed of the same liquid crystal display panel as that explained in the sixth or the seventh embodiment, and a panel cover portion 172 provided therearound. The display region 37 has a character display portion 176, a schedule display portion 177, a menu display portion 178, and a time display portion 179 to display a plurality of kinds of information. Further, the character display portion 176 has a first character display 173 for displaying fish and a second and a third character display 174 and 175 for displaying polka dots. Furthermore, the time display portion 179 has a partial display switching portion 180. Moreover, this timepiece 171, which is provided with a solar cell unit through the illustration thereof is omitted, has a power generating function.

By the way, some of the display contents of the display region 37 need to be updated in serial and the others have only to be displayed as is without update of the display for a fixed time. More specifically, for example, the character display portion 176 has no problem as information even if it continues the same display for days for a reduction in power consumption. In the schedule display portion 177, if it is capable of displaying much information, the display thereof does not need to be updated in several hours or several days, or in several months in some cases. Furthermore, in the menu display portion 178, there is no need to update the display in particular if all of the information content of menu is always being displayed. In the time display portion 179, however, the display needs to be updated every minute if it has a minute display portion and every second if it has a second display portion.

In other words, in the timepiece 171 of this embodiment, frequent updates of the display are required only for the time display portion 179, in which if the display is updated every minute at the portion which performs the minute display, every hour at the portion which performs the hour display, and every half-day at the portion which performs the AM/PM display, each display has only to be held as is during other times. Accordingly, only when there occurs necessity to update the above display, the driving signal is applied to scanning electrodes and signal electrodes corresponding to a region which needs to be updated, and further a driving signal having a long selection period in the power-saving mode is used to decrease the driving voltage, which enables a display with a very low power consumption, which enables to attain a self-standing liquid crystal display device using a power generating element with a small amount of power generation.

Figure 26:
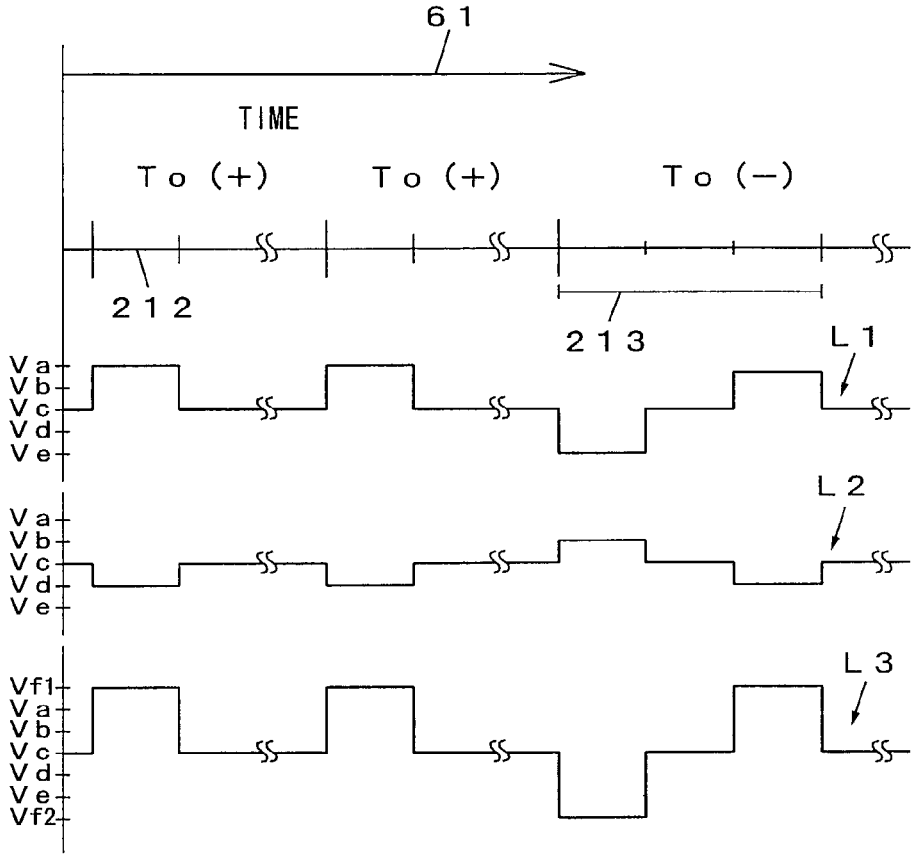
FIG. 26 is a waveform diagram showing an example of the driving signal in the power-saving mode used in a ninth embodiment of the invention.

Ninth Embodiment: FIG. 26

The driving waveform of a liquid crystal display device in the ninth embodiment of the invention is explained next using FIG. 26.

The liquid crystal display device to which the driving waveform in this embodiment is applied is the same as that explained in the first embodiment using FIG. 1 to FIG. 6, and thus the explanation thereof is omitted. Further, the driving waveforms in the standard mode explained in the first, second, and fourth embodiments may be appropriately selected for use for the driving waveform in the standard mode in this embodiment, and thus the explanation thereof is also omitted.

FIG. 26 shows an eighth power-saving selection signal L1 and an eighth power-saving data signal L2, and L3 which is a composite waveform of them and a waveform showing a voltage to be applied to a liquid crystal layer 15 at a portion where the scanning electrode and the data electrode oppose each other, which are the driving waveform in the power-saving mode in this embodiment.

FIG. 26 is also the same as FIG. 9 in that the horizontal axis is a time axis 61, the vertical axis represents voltage, and the middle of the scale set for each waveform shows a voltage of 0 V.

In this embodiment, different signals are applied in a To(+) field and in a To(−) field. During periods in the To(+) field, the eighth power-saving selection signal L1 applies a voltage at Va during a power-saving selection period 212 for selecting the first scanning electrode and a voltage at Vc during the other periods. The eighth power-saving data signal L2 applies a voltage at Vd during the power-saving selection period 212 and the voltage at Vc during the other periods.

Accordingly, a voltage at Vfl larger than Va is applied to the liquid crystal layer 15 at the pixel in a portion where the electrodes, to which these signals are applied, oppose each other, so that the pixel becomes the dark display.

As for periods in the To(−) field, the power-saving selection period for selecting one scanning electrode has a length three times the period in the To(+) field. The eighth power-saving selection signal L1 sequentially applies voltages at three levels Ve, Vc and Va for equal time during a power-saving selection period 213 for selecting the first scanning electrode. The voltage at Vc is applied during the other periods. The eighth power-saving data signal L2 sequentially applies voltages at three levels Vb, Vc and Vd for equal time during the power-saving selection period 213. The voltage at Vc is applied during the other periods.

Accordingly, during the power-saving selection period 213, a negative voltage, a zero voltage, and a positive voltage are applied to the liquid crystal layer 15 at the pixel in the portion where the electrodes, to which these signals are applied, oppose each other. A large positive voltage is applied the last time, so that the pixel becomes the dark display. The absolute values of the voltages applied here are the same as those applied during the periods in the To(+) field.

The voltages of different polarities are sequentially applied to the liquid crystal layer as described above to cancel unbalance of charge in the liquid crystal layer. Since an unbalance of charge occurs in the liquid crystal layer when the To(+) field is repeated for a long time, the To(−) field is sometimes provided to cancel this.

It should be noted that the signal waveforms shown here are waveforms for writing the dark display, and thus a selection signal and a data signal of reversed polarities are used to write the bright display.

As has been described, the eighth power-saving selection signal and the eighth power-saving data signal are used to reduce the power consumption of the liquid crystal display device so as to prevent unbalance of the charge in the liquid crystal layer. Further, the signal waveforms and the selection period are made different in the To(+) field and in the To(−) field, which enables driving at the same voltage level, resulting in a simple circuit system of the liquid crystal display device.

Figure 27:
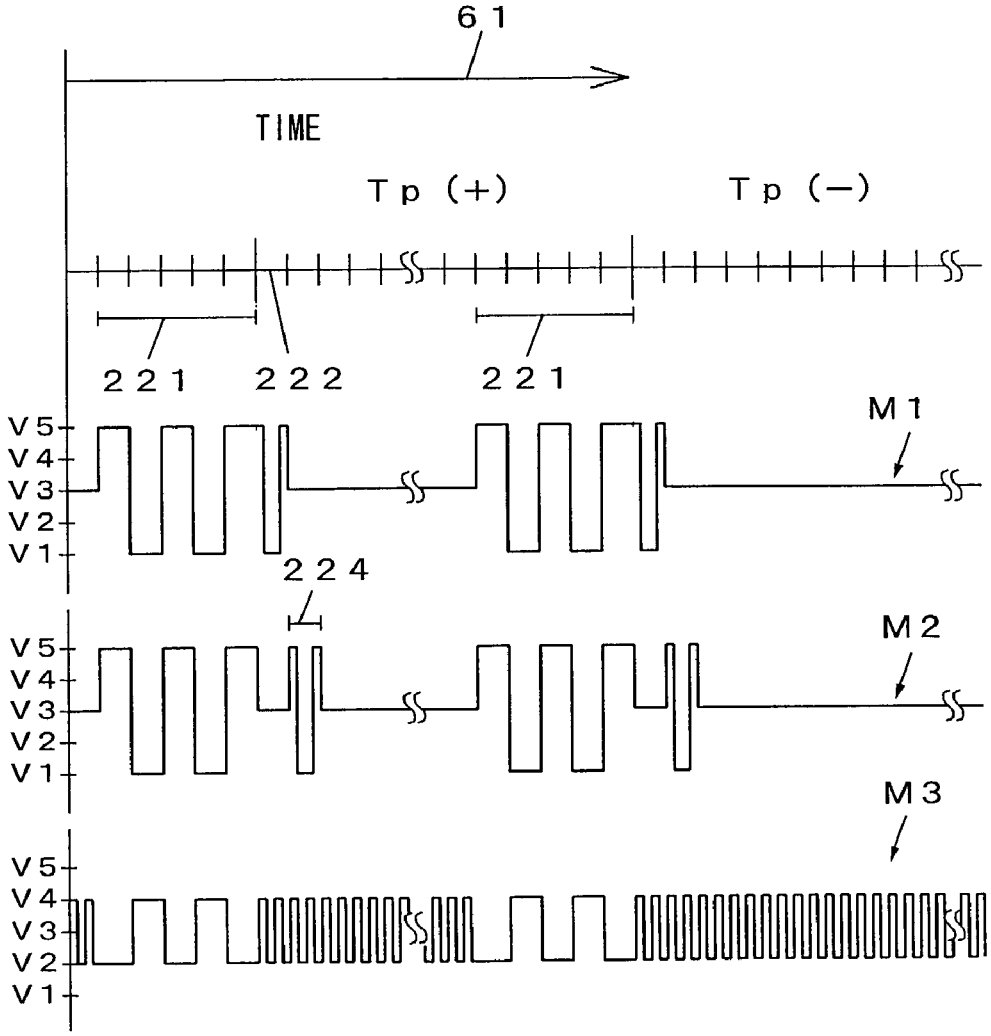
FIG. 27 is a waveform diagram showing an example of the driving signal in the standard mode used in a tenth embodiment of the invention.
Figure 28:
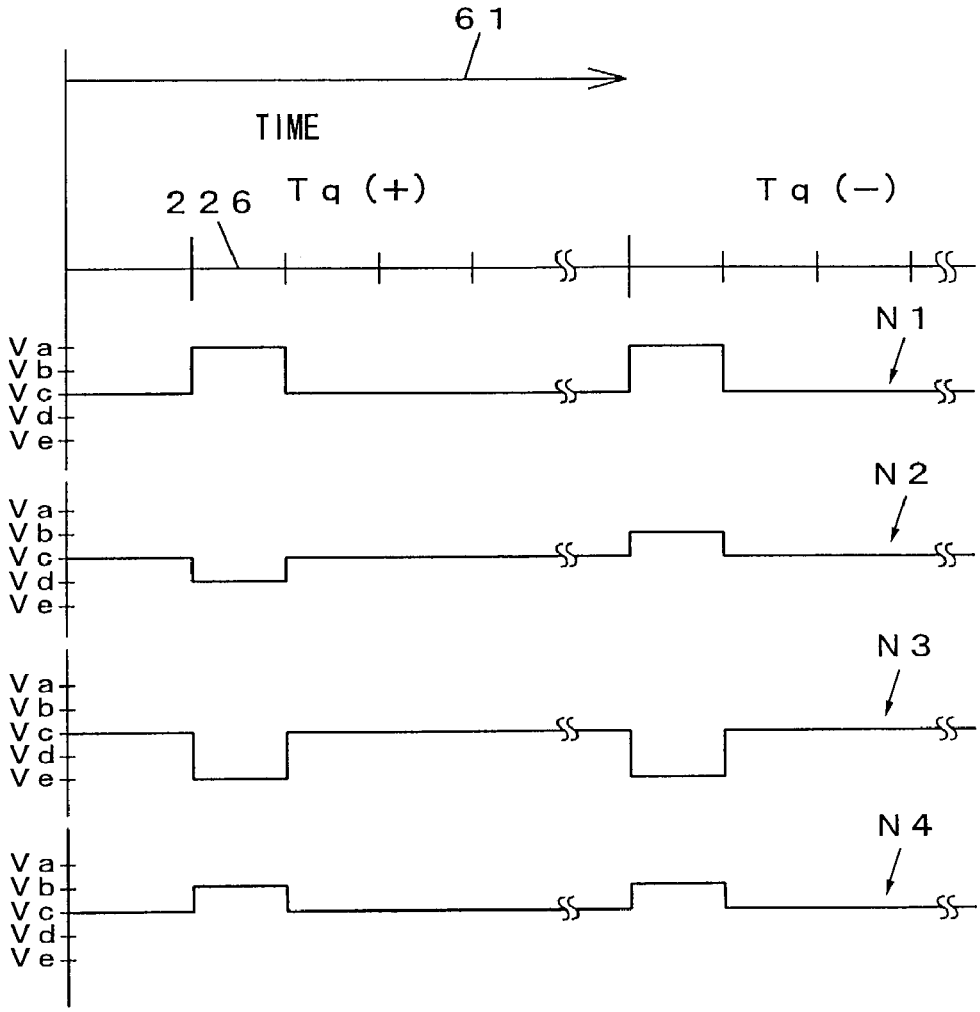
FIG. 28 is a waveform diagram showing an example of the driving signal in the power-saving mode used in the tenth embodiment of the invention.

Tenth Embodiment: FIG. 27 and FIG. 28

The driving waveform of a liquid crystal display device in the tenth embodiment of the invention is explained next using FIG. 27 and FIG. 28.

The liquid crystal display device to which the driving waveform in this embodiment is applied is the same as that explained in the first embodiment using FIG. 1 to FIG. 6, and thus the explanation thereof is omitted.

FIG. 27 shows fourth standard selection signals M1 and M2 and a fourth standard data signal M3 which are the driving waveform in the standard mode of this embodiment.

FIG. 27 is also the same as FIG. 9 in that the horizontal axis is a time axis 61, the vertical axis represents voltage, and the middle of the scale set for each waveform shows a voltage of 0 V.

The tenth embodiment is characterized in that refresh periods 221 are provided at once for each scanning electrode in each of fields Tp(+) and Tp(−) to prevent unbalance of charge in a liquid crystal layer 15 in display in the standard mode. This refresh period 221 shall be provided immediately before a selection period 222 for selecting the first scanning electrode.

The fourth standard selection signal M1 is a selection signal to be applied to the first scanning electrode, and the fourth standard selection signal M2 is a selection signal to be applied to the second scanning electrode. As shown in FIG. 27, either signal alternately applies voltages at V5 and V1 during the refresh period 221. The same voltages are applied to other scanning electrodes. On the other hand, the fourth standard data signal M3 alternately applies voltages at V2 and V4 to all the data electrodes during the refresh period 221.

Accordingly, a positive voltage (V5−V2) and a negative voltage (V1−V4) which have large absolute values are alternately applied to the liquid crystal layer 15 at all the pixels within the display region during the refresh period 221 to cancel unbalance of charge and ion component in the liquid crystal layer 15 as well as to refresh the display.

Since the voltages are alternately applied at high frequencies during the refresh period 221, the voltage at VS and the voltage at V2 are applied to the scanning electrodes and the data electrodes respectively at the end of the refresh periods 221, and after they are stabilized, the selection period 222 for selecting the first scanning electrode is started.

The display during each selection period is the same as that in the standard mode of the first embodiment explained using FIG. 9 except that the applied voltages of the fourth standard data signal are not at V7 and V6 but at V4 and V2, and thus the explanation thereof is omitted.

Signal waveforms used in the power-saving mode are explained next.

FIG. 28 shows ninth power-saving selection signals N1 and N3 and ninth power-saving data signals N2 and N4, which are the driving waveform in the power-saving mode in this embodiment.

FIG. 28 is also the same as FIG. 9 in that the horizontal axis is a time axis 61, the vertical axis represents voltage, and the middle of the scale set for each waveform shows a voltage of 0 V.

Each of fields Tq(+) and Tq(−) and the power-saving selection period for selecting each scanning electrode here is several hundreds of times or more longer than that in the standard mode shown in FIG. 27, and in addition, the refresh period 221 is not provided.

The ninth power-saving selection signal N1 and the ninth power-saving data signal N2 are examples of signals for writing the dark display into a pixel, so that a large positive voltage (Va−Vd) is applied to the liquid crystal layer at the pixel to bring the pixel into the dark display. When the ninth power-saving data signal N2 applies Vc, the display does not change and is held.

The ninth power-saving selection signal N3 and the ninth power-saving data signal N4 are examples of signals for writing the bright display into a pixel, so that a negative voltage (Ve−Vb) having a large absolute value is applied to the liquid crystal layer at the pixel to bring the pixel into the bright display. When the ninth power-saving data signal N4 applies Vc, the display does not change and is held.

It is applicable to repeatedly apply the same signal of these signals or to appropriately combine them for rewriting.

The liquid crystal display device is driven with the signals in the standard mode and the signals in the power-saving mode of this embodiment appropriately switched, thereby attaining a great reduction in power consumption when the display is not frequently updated. Further the picture is sometimes rewritten at a low voltage and a low speed, which makes it possible to prevent deterioration in the display quality also when a liquid crystal layer with an insufficient memory property is used for the liquid crystal layer. Furthermore, it becomes possible that the unbalance of ions and the like in the liquid crystal layer due to a fixed display in the power-saving mode for a long time is cancelled by the refresh period provided in the standard mode, which enables the display to be updated at a high speed.

Figure 29:
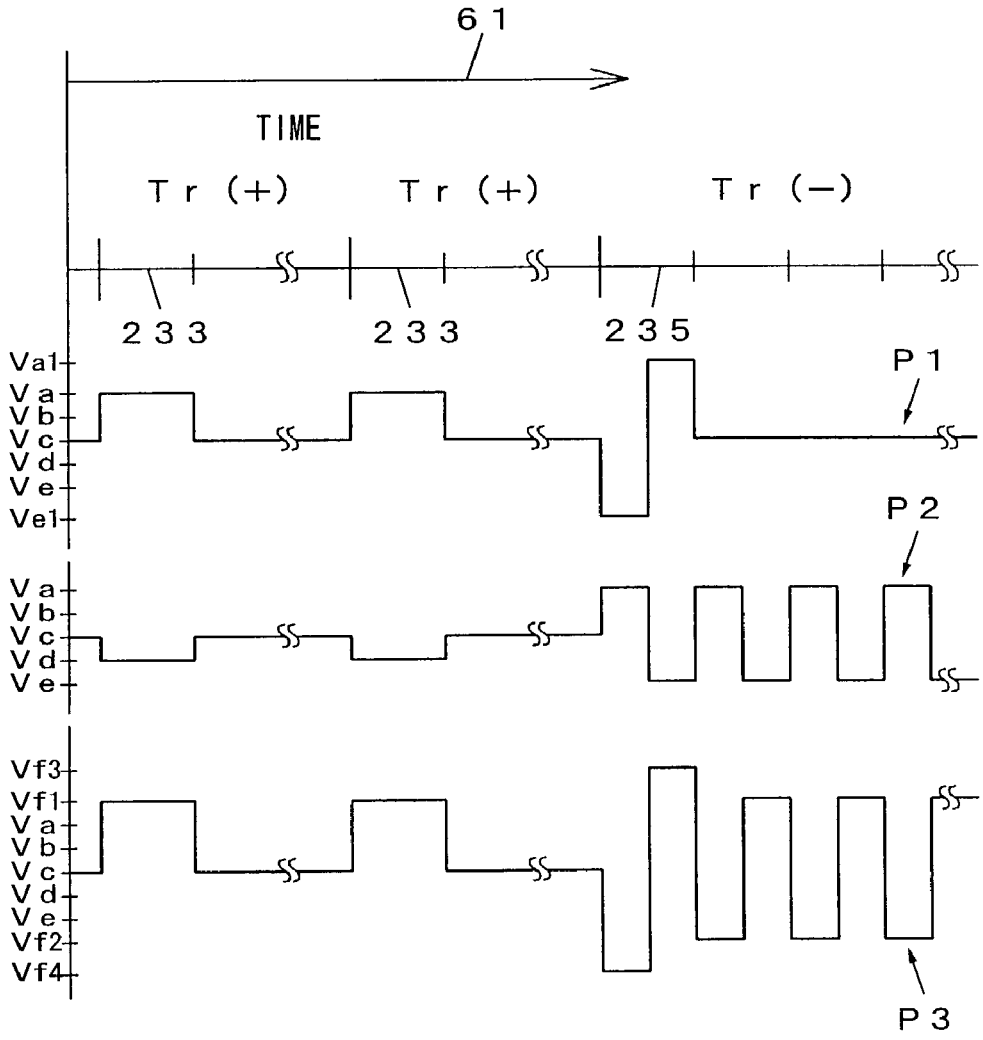
FIG. 29 is a waveform diagram showing an example of the driving signal in the power-saving mode used in an eleventh embodiment of the invention.

Eleventh Embodiment: FIG. 29

The driving waveform of a liquid crystal display device in the eleventh embodiment of this invention is explained next using FIG. 29.

The liquid crystal display device to which the driving waveform in this embodiment is applied is the same as that explained in the first embodiment using FIG. 1 to FIG. 6, and thus the explanation thereof is omitted. Further, the driving waveforms in the standard mode explained in the embodiments may be appropriately selected for use for the driving waveform in the standard mode in this embodiment, and thus the explanation thereof is also omitted.

FIG. 29 shows a tenth power-saving selection signal P1 and a tenth power-saving data signal P2, and P3 which is a composite waveform of them and a waveform showing a voltage to be applied to a liquid crystal layer 15 at a portion where the scanning electrode and the data electrode oppose each other, which are the driving waveform in the power-saving mode in this embodiment.

This embodiment is characterized in that a single voltage is applied during each selection period in a Tr(+) field to perform display and a Tr(−) field is used as a refresh period in which positive and negative voltages having large absolute values are alternately applied during each selection period.

FIG. 29 is also the same as FIG. 9 in that the horizontal axis is a time axis 61, the vertical axis represents voltage, and the middle of the scale set for each waveform shows a voltage of 0 V.

In the Tr(+) field, the tenth power-saving selection signal P1 applies a voltage at Va during a power-saving selection period 233 for selecting the first scanning electrode to select the scanning electrode, and applies a voltage at Vc during the other periods. The tenth power-saving data signal P2 is a data signal for bringing only the pixel on the first row on the data electrode, to which the signal is applied, into the dark display and applies a voltage at Vd during the power-saving selection period 233 and the voltage at Vc during the other periods.

Accordingly, the voltage to be applied to the liquid crystal layer during the power-saving selection period 233 becomes Vf1, which is a large positive voltage, so that the pixel becomes the dark display.

In the Tr(−) field, the tenth power-saving selection signal P1 sequentially applies Va1 which is a voltage higher than Va and Ve1 which is a voltage lower than Ve during a power-saving selection period 235 for selecting the first scanning electrode. The voltage at Vc is applied during the other periods. The tenth power-saving data signal P2 sequentially applies the voltages at Va and Ve to all the data electrodes during all the power-saving selection periods.

As a result, during the periods in the Tr(−) field, the positive and negative voltages Vf4 and Vf3 having large absolute values are sequentially applied to the liquid crystal layer at all the pixels on the scanning electrode to cancel the unbalance of ions and the like in the liquid crystal layer 15, and thus the periods serve as refresh periods.

The display is performed using the Tr(+) field, and the Tr(−) field is used from once every several tens of times to once every several thousands of times to cancel the unbalance of ions and the like to thereby refresh the display.

In this embodiment, the signals in the Tr(+) field here shown in the figure are also signals for writing the dark display, and thus when the bright display is written, signals of reversed polarities are used.

Figure 30:
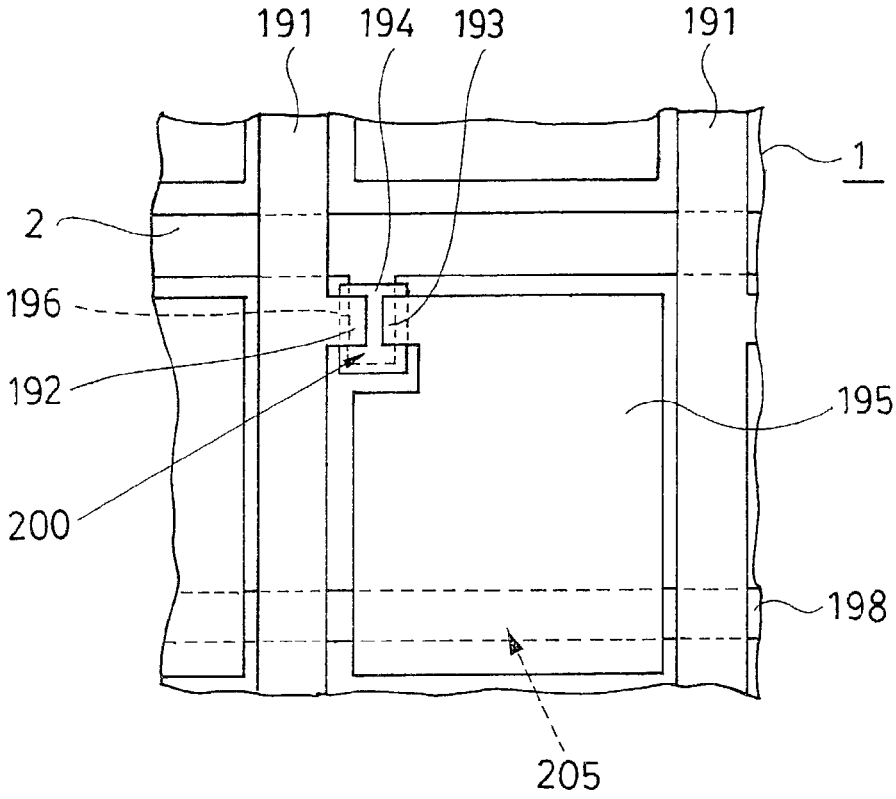
FIG. 30 is a partial plane view showing a liquid crystal display panel of a liquid crystal display device that is a twelfth embodiment of the invention with a pixel portion having a thin film transistor and the surroundings enlarged.
Figure 31:
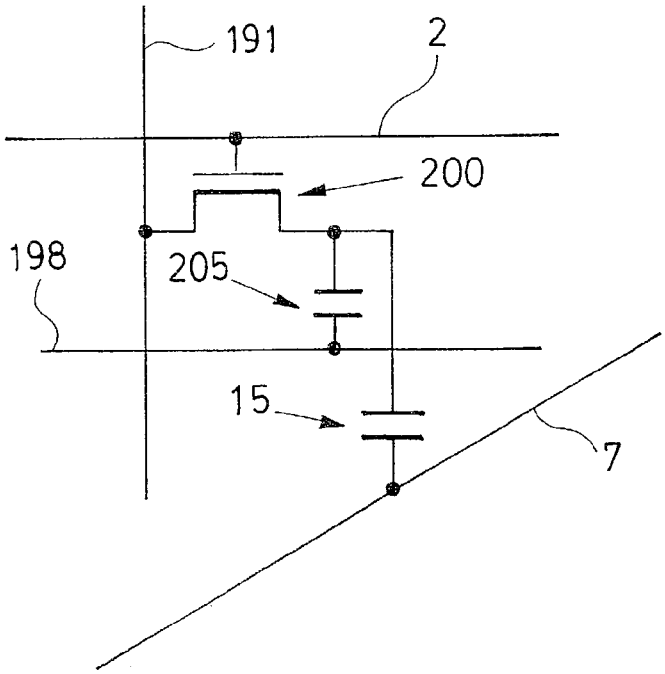
FIG. 31 is an equivalent circuit diagram showing the pixel portion, a switching element, and a storage element of the liquid crystal display device.
Figure 32:
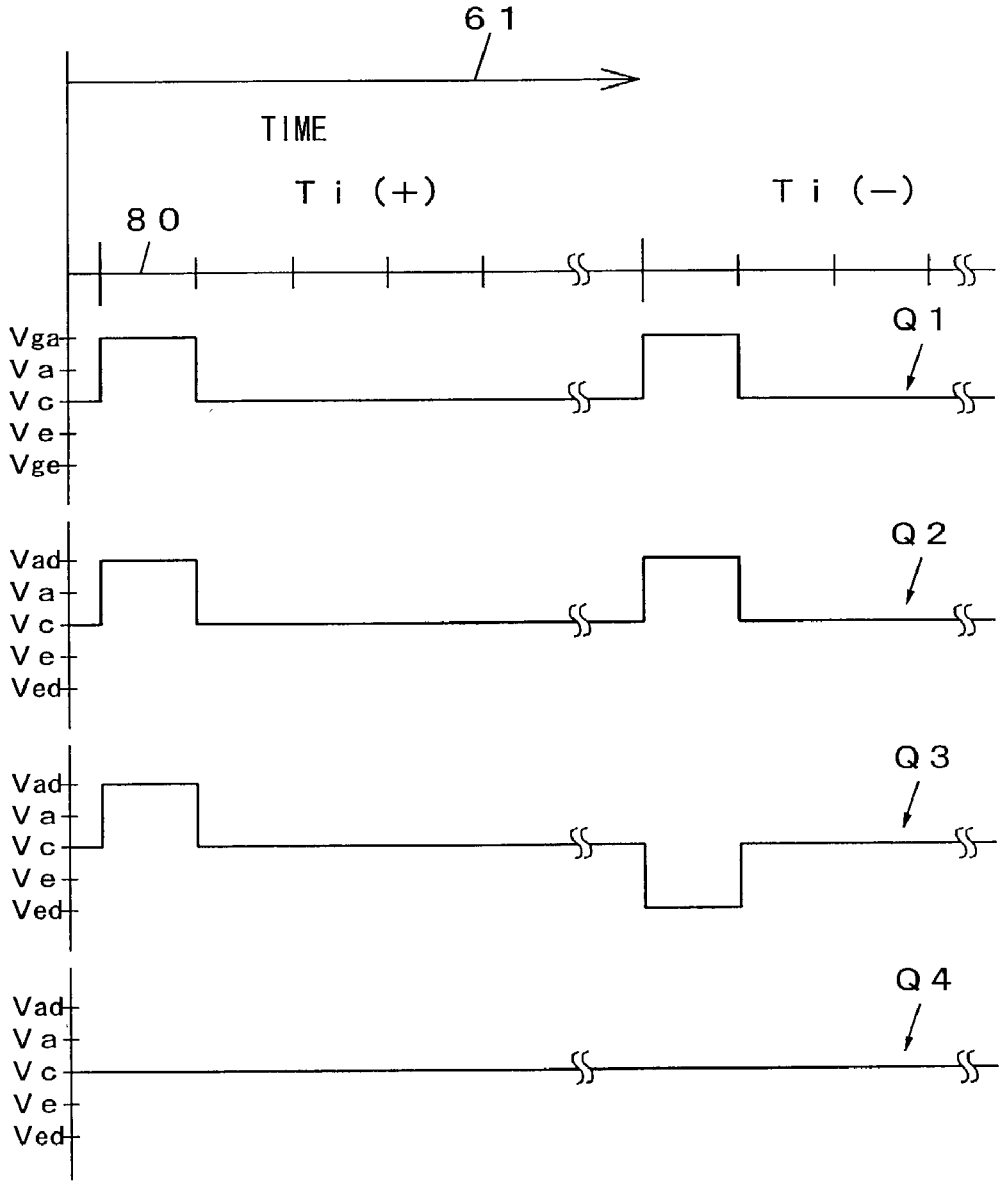
FIG. 32 is a waveform diagram showing an example of the driving signal in the power-saving mode for driving the liquid crystal display device.

Twelfth Embodiment: FIG. 30 to FIG. 32

A liquid crystal display device of the twelfth embodiment of this invention is explained next using FIG. 30 and FIG. 31.

FIG. 30 is a plan view showing a liquid crystal display panel of the liquid crystal display device of this embodiment with a pixel portion and the surroundings enlarged, and FIG. 31 is an equivalent circuit diagram showing its pixel portion, switching element, and storage element.

The twelfth embodiment is characterized in that each pixel portion has a three-terminal type thin film transistor (TFT) as a switching element which is connected in series to a liquid crystal layer constituting the pixel portion, and further, in that a storage element is provided which is connected in series to the switching element and connected in parallel to the liquid crystal layer constituting the pixel portion.

The liquid crystal display device of this embodiment is different from the liquid crystal display device in the first embodiment explained using FIG. 1 to FIG. 6 only in the configuration of electrodes, and thus the explanation except for this point is omitted.

FIG. 30 shows a state of a liquid crystal display panel 3 viewed from a second substrate 6 side with the second substrate 6 removed therefrom.

In the liquid crystal display device of this embodiment, on a first substrate 1, scanning electrodes 2 in stripes are provided and a gate electrode 196 connected to the scanning electrode 2 is provided for every pixel. A gate insulating film (not shown) is provided on each gate electrode 196, and a polysilicon (p-Si) film 194 is provided on the gate insulating film. A source electrode 192 connected to a signal electrode 191 is provided on the polysilicon film 194, and a pixel electrode 195 is connected to a drain electrode 193 which is provided to have a predetermined gap with the source electrode 192. This pixel electrode 195 is provided for every isolated region surrounded by the scanning electrodes 2 and the signal electrodes 191.

Polysilicon films (not shown) containing impurity ions are provided between the polysilicon film 194 and the source electrode 192, and between the polysilicon film 194 and the drain electrode 193, respectively. These source electrode 192, drain electrode 193, gate electrode 196, gate insulating film, and polysilicon film 194 form a three-terminal type TFT 200 in the vicinity of the intersection of the scanning electrode 2 and the signal electrode 191 for every pixel.

The insulating film is provided at least between the signal electrode 191 and the scanning electrode 2 to prevent these electrodes from conducting to each other.

On the second substrate 6, a data electrode 7 is provided over the entire face of a display region 37, and a portion where the pixel electrode 195 and the data electrode 7 oppose each other with a liquid crystal layer 15 sandwiched therebetween becomes a pixel portion, so that a voltage applied to the pixel electrode 195 via the TFT 200 induces an optical change in the liquid crystal layer to perform display.

Further, a storing electrode 198 is provided on the first substrate 1 side of the pixel electrode 195 through a storing insulating film (not shown). The pixel electrode 195, the storing insulating film, and the storing electrode 198 form a storing capacitor 205. A predetermined potential is applied to the storing capacitor 205 through the storing electrode 198 at the outer periphery of the display region 37 of the liquid crystal display device. This forms the storing capacitor 205 which is connected in parallel to a liquid crystal capacitance constituted by the liquid crystal layer 15.

The provision of the storing capacitor 205 makes it possible to store charge in a short time in the storing capacitor 205 from the TFT 200 that is the switching element and to slowly supply the charge (electric current) to the liquid crystal layer 15, so that the provision becomes effective when the liquid crystal layer 15 is great in viscosity or slow in response. Furthermore, it is also possible to supply charge again from the storing capacitor 205 when a tiny amount of charge is internally consumed from the liquid crystal layer 15, and thus the provision is effective.

Moreover, the consumption of the charge can be reduced by providing a switching element with a high resistance at the pixel portion also when the pixel portion is set at the floating from an external circuit during a liquid crystal layer charge memory period, and thus the provision is effective.

By the way, it is impossible to use the driving signals explained in the embodiments so far, as they are, to drive the liquid crystal display device of this embodiment.

First of all, since the selection signal is a signal for conducting the TFT, selection has to be conducted by a signal at a positive potential. In addition, the data electrode shall be at the ground potential at all times. Then, a signal corresponding to a composite waveform of the selection signal and the data signal is applied to the signal electrode 191 during each selection period, whereby the same voltages as those in the embodiments so far can be applied to the liquid crystal layer. The signals explained in the embodiments are modified for use as described above, which enables to drive the liquid crystal display panel 3 of the liquid crystal display device of this embodiment.

Examples of such signal waveforms are shown in FIG. 32. FIG. 32 shows waveforms made by modifying the waveforms shown in FIG. 14 to use them to drive the liquid crystal display device of this embodiment. FIG. 32 is also the same as FIG. 9 in that the horizontal axis is a time axis 61, the vertical axis represents voltage, and the middle of the scale set for each waveform shows a voltage of 0 V.

Each of Ti(+) field and Ti(−) field is 1 second which is a period 120 times each of the Tf(+) field and the Tf(−) field in the case of the standard mode. Accordingly, the selection period for selecting each scanning electrode is also a period 120 times that in the standard mode.

A waveform Q1 shown in FIG. 32 is a scanning signal to be applied to the first scanning electrode, that is, a signal waveform to be applied to the gate electrode 196 of the TFT 200 connected to the scanning electrode. Further, it is a signal waveform which turns ON and OFF the TFT 200. A voltage at Vga is applied at a timing of turning ON and a voltage at Vc is applied during the other periods.

A waveform Q4 is a signal to be applied to the data electrode, a signal waveform for applying a zero voltage at Vc at all times.

Waveforms Q2 and Q3 are signals to be applied to the signal electrode, that is, signal waveforms to be applied to the source electrode 192 of the TFT. Further, they are signals which turn ON and OFF the liquid crystal layer 15. Q2 is a signal waveform which writes the dark display of ON into the pixel on the first row and causes the others to hold the display without update. Q3 is a signal waveform which causes only the pixel on the first row to repeat the dark display of ON and the bright display of OFF every field Ti(+) and Ti(−) and the others to hold the display without update.

These signals apply a large positive voltage Vad (=Va−Vd) to the source electrode 192 when the TFT is in the ON state, that is, in a low resistance state to charge the liquid crystal layer and the storage element with charge. The storage element is sufficiently charged, which makes it possible to turn OFF the TFT 200 in a short time and thereafter to turn ON the liquid crystal layer 15 spending time. Therefore, the TFT 200 slowly turns ON and OFF as compared to the standard frequency to be able to sufficiently charge the storing capacitor 205 at a low voltage. Further, also when the liquid crystal layer 15 is slow in response and thus requires a long selection period, the operating time of the circuit can be decreased by the TFT 200 and the storing capacitor 205, so as to reduce the power consumption of the liquid crystal display device.

Furthermore, a large negative voltage Ved (=Ve−Vb) is applied to the source electrode 192 when the TFT 200 is in the ON state, that is, in a low resistance state, which makes it possible to turn the liquid crystal layer 15 into the OFF state. The storing capacitor 205 is sufficiently charged, which makes it possible to turn OFF the TFT 200 in a short time and thereafter to turn OFF the liquid crystal layer 15 spending time. Therefore, the TFT 200 slowly turns ON and OFF as compared to the standard frequency to be able to sufficiently charge the storing capacitor 205 at a low voltage. Further, also when the liquid crystal layer 15 is slow in response and thus requires a long selection period, the operating time of the circuit can be decreased by the TFT 200 and the storing capacitor 205, so as to reduce the power consumption of the liquid crystal display device.

It should be noted that although the example without providing a power generating means has been explained in this embodiment, a power generating means may be provided as in the liquid crystal display devices explained in the sixth embodiment and the seventh embodiment to perform driving by the energy supplied therefrom.

Figure 33:
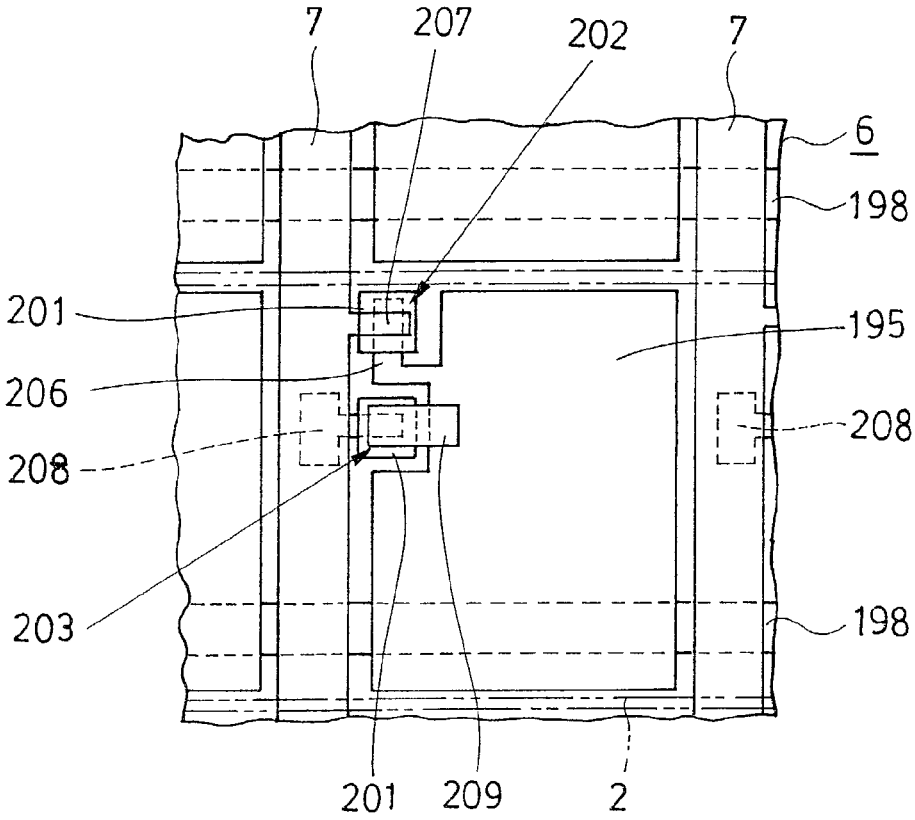
FIG. 33 is a partial plan view showing a liquid crystal display panel of a liquid crystal display device that is a thirteenth embodiment of the invention with a pixel portion having a thin film PIN diode and the surroundings enlarged.
Figure 34:
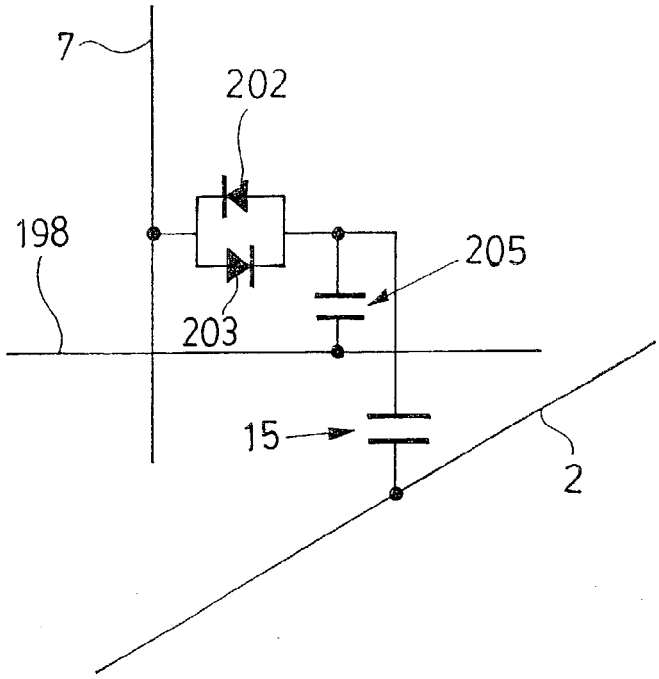
FIG. 34 is an equivalent circuit diagram showing the pixel portion, a switching element, and a storage element of the liquid crystal display device.

Thirteenth Embodiment: FIG. 33 and FIG. 34

A liquid crystal display device of the thirteenth embodiment of this invention is explained next using FIG. 33 and FIG. 34.

FIG. 33 is a plane view showing a liquid crystal display panel of the liquid crystal display device of this embodiment with a pixel portion and the surroundings enlarged, and FIG. 34 is an equivalent circuit diagram showing its pixel portion, switching element, and storage element.

The thirteenth embodiment is characterized in that each pixel portion has a two-terminal type thin film PIN diode (TFD) composed of an amorphous silicon (a-Si) film as a switching element which is connected in series to a liquid crystal layer 15 constituting the pixel portion, and further, in that a storage element is provided which is connected in series to the switching element and connected in parallel to the liquid crystal layer constituting the pixel portion.

The liquid crystal display device of this embodiment is different from the liquid crystal display device in the first embodiment explained using FIG. 1 to FIG. 6 only in the configuration of electrodes, and thus the explanation except for this point is omitted.

FIG. 33 shows a state of a liquid crystal display panel 3 viewed from a first substrate 1 side with the first substrate 1 removed therefrom.

In the liquid crystal display device of this embodiment, on the first substrate 1, scanning electrodes 2 composed of a transparent conductive film are provided in stripes. On a second substrate 6, a pixel electrode 195 composed of a transparent conductive film, a first diode lower electrode 206 connected to the pixel electrode 195, and an isolated second diode lower electrode 208 are provided for every pixel. Amorphous silicon (a-Si) films 201, which are separated and have PIN connections, are provided on the first and second diode lower electrodes 206 and 208, respectively. The P-type amorphous silicon provided on the second substrate 6 uses a film low in impurity concentration of boron (B) and high in resistance.

On the amorphous silicon films 201, a first diode upper electrode 207 and a second diode upper electrode 209 are provided respectively. Data electrodes 7 in stripes are also provided here, and the first diode upper electrode 207 is provided connected to a data electrode 7.

Further, since the data electrode 7 is provided to partially overlap the second diode lower electrode 208, they conduct to each other, and since the second diode upper electrode 209 is provided to partially overlap the pixel electrode 195, they conduct to each other.

These first diode lower electrode 206, amorphous silicon film 201, and first diode upper electrode 207 form a first diode 202. Similarly, the second diode lower electrode 208, amorphous silicon film 201, and second diode upper electrode 209 form a second diode 203.

According to the above configuration, as shown in FIG. 34, the switching element in which the first and second diodes 202 and 203 are connected in ring form is arranged between the data electrode 7 and the pixel electrode 195. The PIN diode composed of the amorphous silicon film is effective in flowing a large electric current at a low voltage.

Furthermore, a storing electrode 198 is provided through a storing insulating film (not shown) on the second substrate 6 side of the pixel electrode 195. Thus, the pixel electrode 195, the storing insulating film, and the storing electrode 198 form a storing capacitor 205. A predetermined potential is applied to the storing capacitor 205 through the storing electrode 198 at the outer periphery of the display region of the liquid crystal display device. This forms the storing capacitor 205 connected in parallel to a liquid crystal capacitance constituted by the liquid crystal layer 15.

It is possible to drive the liquid crystal display device of this embodiment using the driving waveforms explained in the embodiments.

The provision of the storing capacitor 205 makes it possible to store charge in the storing capacitor 205 from the TFD that is the switching element in a short time and to slowly supply the charge (electric current) to the liquid crystal layer 15, so that the provision becomes effective when the liquid crystal layer 15 is great in viscosity or slow in response. Furthermore, it is also possible to supply charge again from the storing capacitor 205 when a tiny amount of charge is internally consumed from the liquid crystal layer 15, and thus the provision is effective.

Moreover, the provision of a switching element with a high resistance at the pixel portion enables a reduction in the consumption of charge also when the pixel portion is set at the floating from an external circuit during a liquid crystal layer charge memory period, and thus the provision is effective.

It is possible to apply the driving waveforms explained in the embodiments except the twelfth embodiment to the liquid crystal display device of this embodiment.

It should be noted that although the example without providing a power generating means has been explained in this embodiment, a power generating means may be provided as in the liquid crystal display devices explained in the sixth embodiment and the seventh embodiment to perform driving by the energy supplied therefrom.

Fourteenth Embodiment: FIG. 35 to FIG. 38

Waveforms for driving a liquid crystal display device of the fourteenth embodiment of the invention and waveforms for driving a liquid crystal display panel thereof are explained next.

The liquid crystal display device of this embodiment is characterized in that an antiferroelectric liquid crystal, which has a short memory time as compared to the ferroelectric liquid crystal but is capable of AC drive, is used for a liquid crystal layer 15. This liquid crystal display device is the same as that of the first embodiment explained using FIG. 1 to FIG. 6 except this point, and thus the explanation except for this point is omitted.

Figure 35:
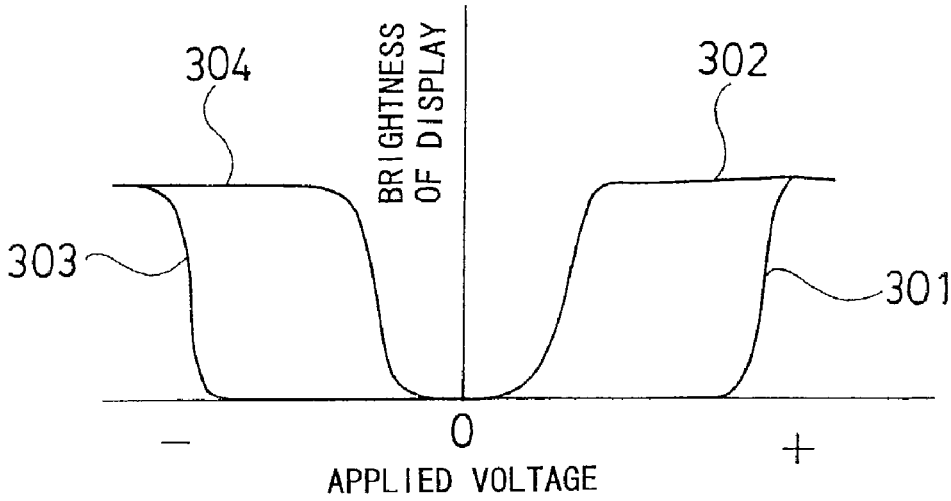
FIG. 35 is a graph showing the relationship between the applied voltage and the brightness of display when the driving signal in the standard mode is applied to a liquid crystal display device of a fourteenth embodiment of the invention.
Figure 36:
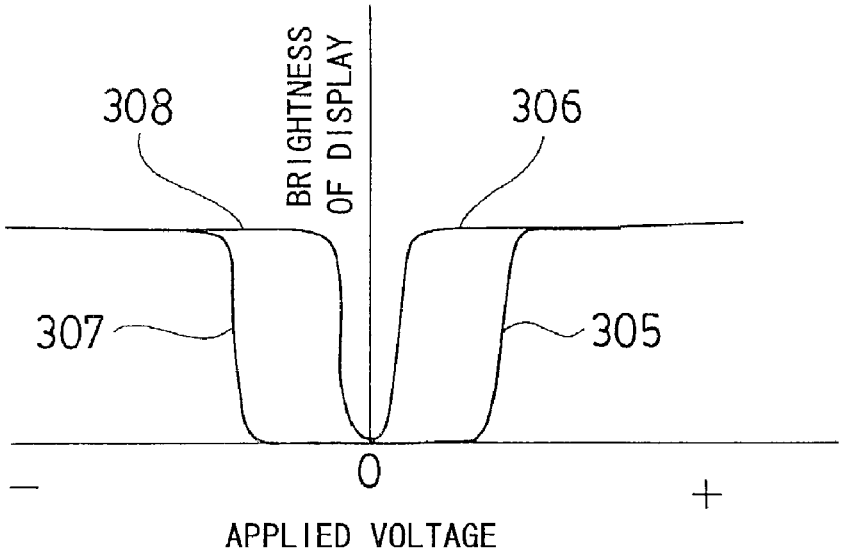
FIG. 36 is a graph showing the relationship between the applied voltage and the brightness of display when the driving signal in the power-saving mode is applied to the same.

First of all, the characteristics of the antiferroelectric liquid crystal are explained using FIG. 35 and FIG. 36. FIG. 35 and FIG. 36 are graphs showing the relationship between the applied voltage and the brightness of display when the driving signals in the standard mode and in the power-saving mode are applied to the liquid crystal display device of this embodiment respectively, and are graphs corresponding to FIG. 7 and FIG. 8.

In FIG. 35 and FIG. 36, the brightness of display is indicated on the vertical axis and the applied voltage is indicated on the horizontal axis. The right side of the graph shows a state of the applied voltage to the liquid crystal layer being positive polarity and the left side shows a state of the applied voltage being negative polarity.

As shown in FIG. 35, the pixel is in a dark state (dark display) with the applied voltage being zero in the standard mode in which a display region is rewritten once at a frequency of typically used video rate (30 Hz) or higher. When a voltage of positive polarity is applied from this state, the brightness of display increases along a curved line 301, and a large voltage of positive polarity is applied to bring the pixel into a bright state (bright display).

Subsequently, when the applied voltage is decreased from this bright display state, the brightness of display decreases along a curved line 302. When the applied voltage is decreased here to zero voltage, the display becomes dark, but the brightness of the bright display is held even if the voltage is decreased to some extent. In other words, the liquid crystal layer 15 composed of an antiferroelectric liquid crystal also has the memory property.

Similarly, when a negative voltage is applied from a state of the applied voltage being zero, the brightness of display increases along a curved line 303, and when a voltage having a large absolute value of negative polarity is applied, the display becomes bright.

Subsequently, when the applied voltage is decreased in absolute value keeping negative polarity from this bright display state, the brightness of display decreases along a curved line 304. When the absolute value of the applied voltage is decreased here to zero, the display becomes dark, but the brightness of the bright display is held even if the absolute value of the voltage is decreased to some extent. In other words, the liquid crystal layer has the same memory property also in the negative polarity as that in the case of positive polarity.

More specifically, once a voltage having a large absolute value is applied to bring the pixel into the bright display, predetermined brightness can be held thereafter by applying a holding voltage having a small absolute value.

In such a liquid crystal layer 15 having the memory property, even a small voltage can create a great optical change as shown in FIG. 36 by applying the voltage for a period several tens of times or 1000 times or longer than that in the standard selection signal.

In the case of applying the voltage for a long time, when a voltage of positive polarity is applied from the state of the applied voltage being zero, the brightness of display changes as shown by a curved line 305. Then, when the applied voltage is decreased from the state of the bright display by the voltage of positive polarity, the brightness of display changes as shown by a curved line 306.

Further, when a voltage of negative polarity is applied from a state of the applied voltage being zero, the brightness of display changes as shown by a curved line 307. Then, when the applied voltage is decreased in absolute value keeping negative polarity from the bright display state by the voltage of negative polarity, the brightness of display changes as shown by a curved line 308.

In other words, such a display also has the memory property, and once a voltage having a somewhat large absolute value is applied to bring the pixel into the bright display, predetermined brightness can be held thereafter by applying a holding voltage having a smaller absolute value.

However, since the period for applying a signal to one electrode is long, different from the display in the standard mode, the bright and dark displays can be switched by applying a voltage far smaller than that in the standard mode, resulting in reduced power consumption.

In the liquid crystal display device of this embodiment, a power-saving mode is provided which has a selection period for selecting each electrode of 100 times to 1000 times or more longer than that in the standard mode using such characteristics, and the display is performed in the power-saving mode when there is no need to switch the display in a high speed, which enables to realize a liquid crystal display device having a very low power consumption.

Since the liquid crystal display device of this embodiment is different from the liquid crystal display devices explained in the embodiments so far in relationship between the applied voltage and the brightness of display, the driving signals explained in the embodiments cannot be applied thereto. Hence, signals for driving the liquid crystal display device of this embodiment are explained using FIG. 37 and FIG. 38.

Figure 37:
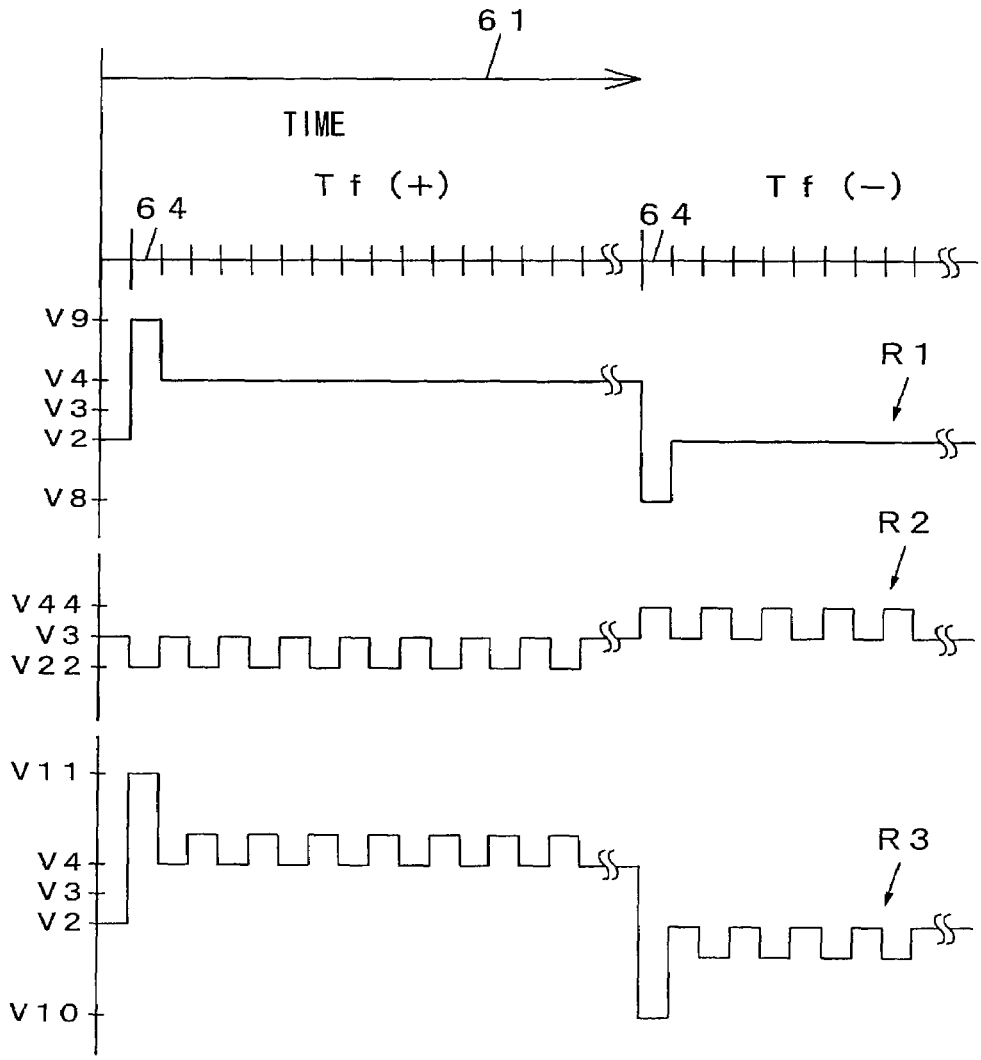
FIG. 37 is a waveform diagram showing an example of the driving signal in the standard mode used in the fourteenth embodiment of the invention.

FIG. 37 shows a fifth standard selection signal R1 and a fifth standard data signal R2, and a waveform R3 which is a composite waveform of them and shows a voltage to be applied to a liquid crystal layer 15 at a portion where the scanning electrode and the data electrode oppose each other, which are the driving waveform in the standard mode of this embodiment.

FIG. 37 is also the same as FIG. 9 in that the horizontal axis is a time axis 61, the vertical axis represents voltage, and the middle of the scale set for each waveform shows a voltage of 0 V.

In each standard signal of this embodiment, signals of positive and negative polarities are switched every field of Tf(+) and Tf(−) to thereby apply an alternating current waveform. Each write period shall be 1/120 of a second (about 8 milliseconds) to prevent flicker.

The fifth standard selection signal R1 applies, in the Tf(+) field, a voltage at V9 during a selection period 64 that is a period for selecting the first scanning electrode to select the first scanning electrode, and a voltage at V4 during the other periods to hold the display. In the Tf(−) field, a voltage at V8 is applied during the selection period 64 to select the first scanning electrode, and a voltage at V2 is applied during the other periods to hold the display.

The fifth standard selection signal to be applied to a scanning electrode other than the first one applies a voltage at V2 until the selection period for selecting the scanning electrode to hold the display in the Tf(+) field, and applies a voltage at V4 until the selection period for selecting the scanning electrode to hold the display in the Tf(−) field. The reason is that the display needs to be held by a voltage having the same polarity as that of the voltage which has performed write.

The fifth standard data signal R2 is a signal example which brings the pixels on odd-numbered rows into the bright display and the pixels on even numbered rows into the dark display. In the Tf(+) field, a voltage at V22 is applied during a selection period for selecting the scanning electrode on the row to be brought into the bright display, and a voltage at V3 is applied during a selection period for selecting the scanning electrode on the row to be brought into the dark display. In the Tf(−) field, a voltage at V44 is applied during a selection period for selecting the scanning electrode on the row to be brought into the bright display, and the voltage at V3 is applied during a selection period for selecting the scanning electrode on the row to be brought into the dark display.

Accordingly, to the liquid crystal layer 15, voltages having large absolute values V11 and V10 are applied in the Tf(+) field and the Tf(−) field respectively as shown by R3 during the selection period for bringing the pixel into the bright display. Further, the bright display by the voltage at V11 is held by applying a voltage of V4−V44 (<V4) to V4−V22 (>V4), and the bright display by the voltage at V10 is held by applying a voltage of V2−V44 (<V2) to V2−V22 (>V2). During the selection period for bringing the pixel into the dark display, the voltages at V9 and V8 are applied in the Tf(+) field and the Tf(−) field, respectively.

Further, voltages which are symmetrical with respect to V3 and have the same absolute value are applied to the liquid crystal layer 15 in the Tf(+) field and the Tf(−) field to prevent a direct current component from being applied.

The driving waveform in the power-saving mode that is a feature of the invention is explained next.

Figure 38:
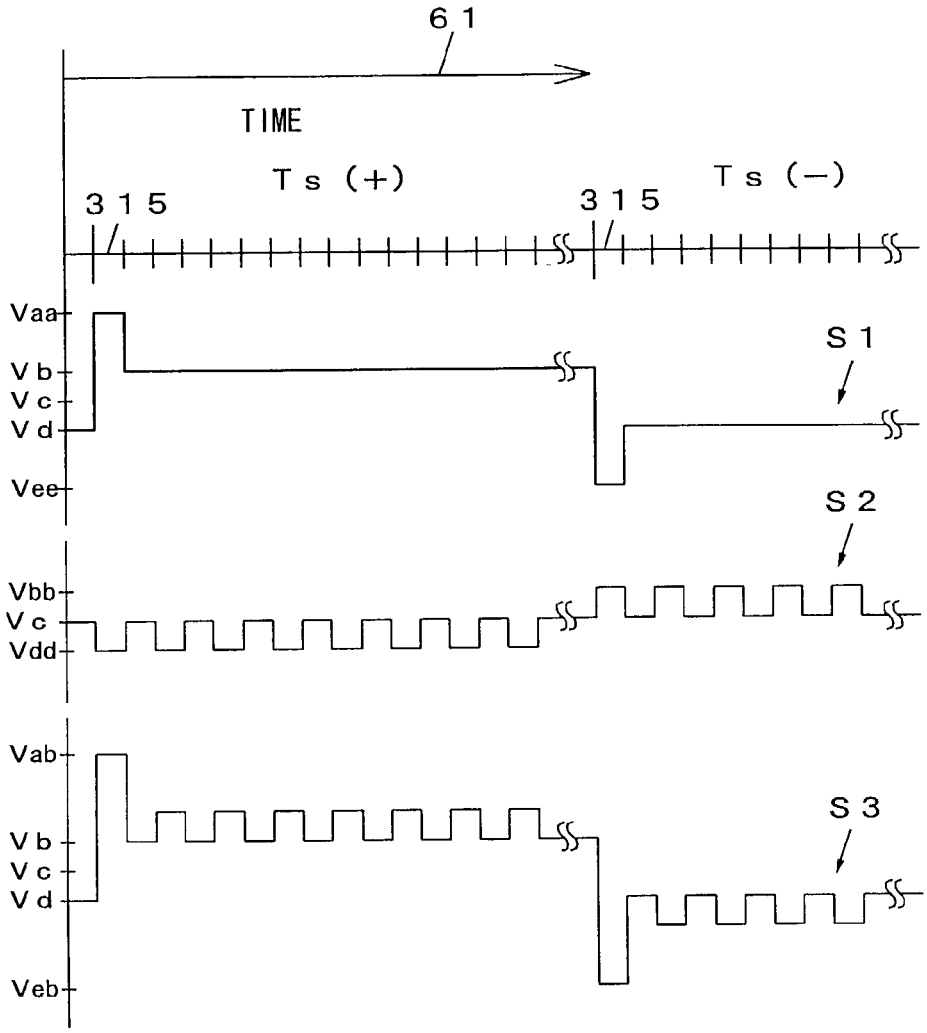
FIG. 38 is a waveform diagram showing an example of the driving signal in the power-saving mode of the same.

FIG. 38 shows an eleventh power-saving selection signal S1 and an eleventh power-saving data signal S2, and a waveform S3 which is a composite waveform of them and shows a voltage to be applied to a liquid crystal layer 15 at a portion where the scanning electrode and the data electrode oppose each other, which are the driving waveform in the power-saving mode of this embodiment.

FIG. 38 is also the same as FIG. 9 in that the horizontal axis is a time axis 61, the vertical axis represents voltage, and the middle of the scale set for each waveform shows a voltage of 0 V.

Each of fields Ts(+) and Ts(−) is, however, a time period 1000 times longer than that of each of the fields Tf(+) and Tf(−) shown in FIG. 37. Therefore, a power-saving selection period 315 that is a period for selecting the first scanning electrode is also a period having a length 1000 times the selection period 64 shown in FIG. 37.

The eleventh power-saving selection period S1 applies, in the Ts(+) field, a voltage at Vaa during the power-saving selection period 315 to select the first scanning electrode, and applies a voltage at Vb during the other periods to hold the display. In the Ts(−) field, a voltage at Vee is applied during the selection period 315 to select the first scanning electrode, and a voltage at Vd is applied during the other periods to hold the display.

The eleventh power-saving selection signal to be applied to a scanning electrode other than the first one applies the voltage at Vd until the selection period for selecting the scanning electrode to hold the display in the Ts(+) field, and applies the voltage at Vb until the period for selecting the scanning electrode to hold the display in the Ts(−) field. The reason is that the display needs to be held by a voltage having the same polarity as that of the voltage which has performed write.

The eleventh power-saving data signal S2 is a signal example which brings the pixels on odd-numbered rows into the bright display and the pixels on even-numbered rows into the dark display. In the Ts(+) field, a voltage at Vdd is applied during a selection period for selecting the scanning electrode on the row to be brought into the bright display, and a voltage at Vc is applied during a selection period for selecting the scanning electrode on the row to be brought into the dark display. In the Ts(−) field, a voltage at Vbb is applied during a selection period for selecting the scanning electrode on the row to be brought into the bright display, and the voltage at Vc is applied during a selection period for selecting the scanning electrode on the row to be brought into the dark display.

Accordingly, to the liquid crystal layer 15, voltages having relatively large absolute values Vab and Veb are applied in the Ts(+) field and the Ts(−) field, respectively, as shown by S3 during the selection period for bringing the pixel into the bright display. Further, the bright display by the voltage at Vab is held by applying a voltage of Vb−Vbb (<Vb) to Vb−Vdd (>Vb), and the bright display by the voltage at Veb is held by applying a voltage of Vd−Vbb (<Vd) to Vd−Vdd (>Vd). During the selection period for bringing the pixel into the dark display, the voltages at Vaa and Vee are applied in the Ts(+) field and the Ts(−) field respectively.

Further, the voltages which are symmetrical with respect to Vc and have the same absolute value are applied to the liquid crystal layer 15 in the Ts(+) field and the Ts(−) field to prevent a direct current component from being applied.

Since each application period (power-saving selection period) is 1000 times as long as that in the standard mode, the potential difference between the applied potentials Vaa and Vee used for the eleventh power-saving selection signal can be reduced to about one-fifth the potential difference between V8 and V9 of the fifth standard selection signal.

Similarly, a range of the applied voltage of the eleventh power-saving data signal from Vbb to Vdd and a range of the applied voltage to the liquid crystal layer 15 from Vab to Veb can also be reduced to about one-fifth each potential used in the standard mode.

As described above, the selection period is increased to be about 1000 times as long as the standard selection period, which makes it possible to reduce the driving voltage to about several volts.

The display is performed by using the driving signal in the standard mode when the display needs to be updated frequently and quickly, and using the driving signal in the power-saving mode when the display has only to be updated slowly, thereby realizing a liquid crystal display device with a low power consumption.

It should be noted that the liquid crystal display device of this embodiment can be driven by an alternating current waveform because the antiferroelectric liquid crystal is employed for the liquid crystal layer 15, so that unbalance of charge and the like is never accumulated in the liquid crystal layer without providing the refresh period.

Further, in each write period, a period for holding the display by continuing the application of the holding voltage may be provided after completion of selection of all the scanning electrodes.

Further, although the example without providing a power generating means has been explained in this embodiment, a power generating means may be provided as in the liquid crystal display devices explained in the sixth embodiment and the seventh embodiment to perform driving by the energy supplied therefrom.

Figure 39:
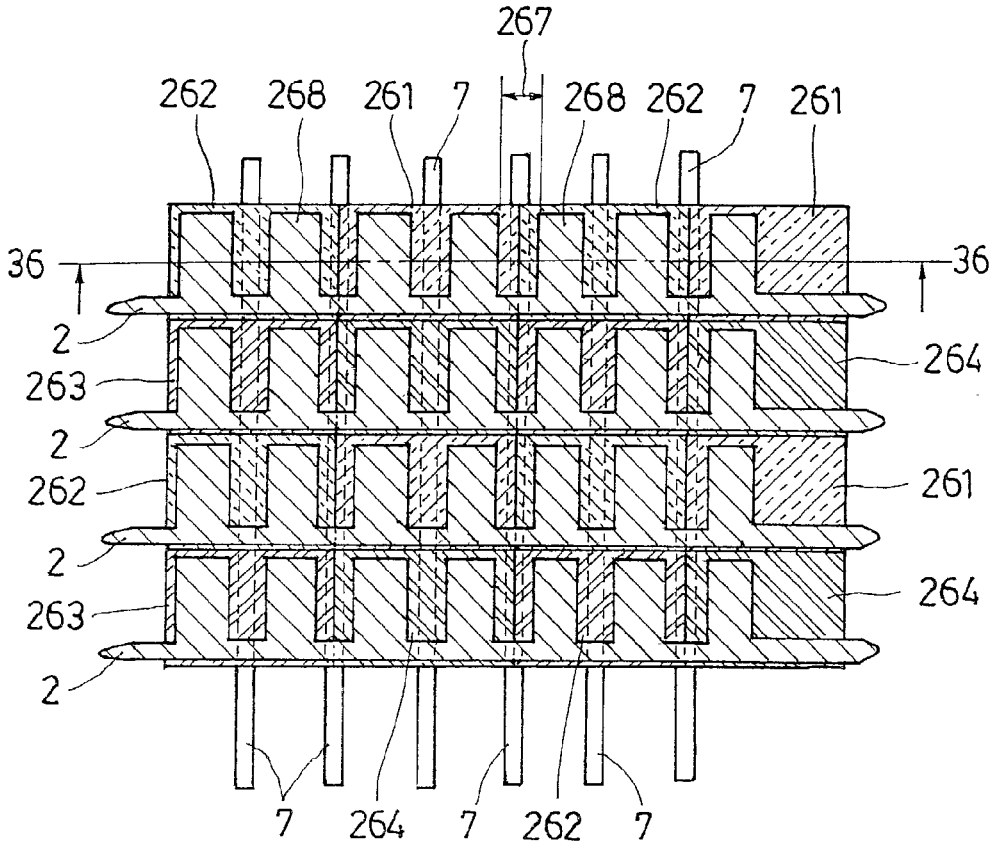
FIG. 39 is a schematic plane view showing the positional relationship between electrodes and alignment films of a liquid crystal display panel provided in a liquid crystal display device that is a fifteenth embodiment of the invention.
Figure 40:
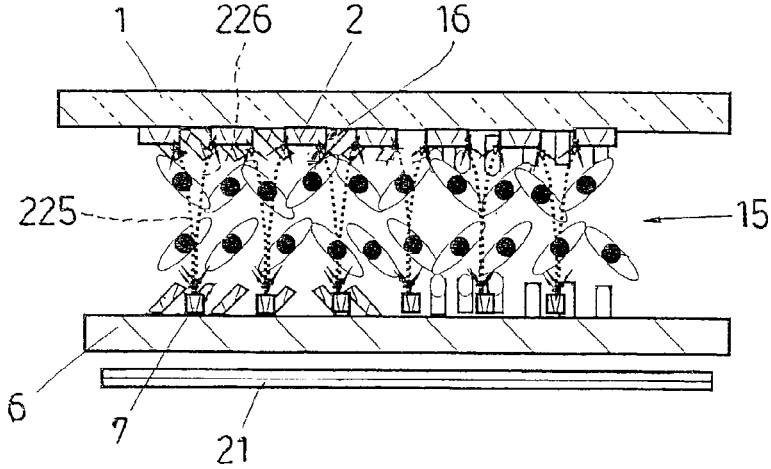
FIG. 40 is a cross-sectional view schematically showing the arrangement of liquid crystal molecules in the liquid crystal display panel of the liquid crystal display device.

Fifteenth Embodiment: FIG. 39 and FIG. 40

A liquid crystal display device of the fifteenth embodiment of the invention is explained next using FIG. 39 and FIG. 40.

FIG. 39 is a plan view showing only electrodes and alignment films of the liquid crystal display device of this embodiment, and FIG. 40 is a cross-sectional view schematically showing the arrangement of liquid crystal molecules in a liquid crystal display panel of the liquid crystal display device.

The liquid crystal display device of this embodiment is different from the liquid crystal display device in the first embodiment explained using FIG. 1 to FIG. 6 only in that the polarizers and the diffusing layer are not used and in the configuration of the alignment films and the electrodes, and thus the explanation except for these points is omitted.

This embodiment is characterized in that alignment films of four types of alignment directions are arranged in mosaic form to cause the alignment directions of the liquid crystal molecules to be nonuniform and that a projecting portion is provided at the scanning electrode in such a manner to shift in the lateral direction in the figure from an opposing data electrode to form a pixel portion so as to cause a lateral electric field at the application of voltage. This configuration brings about a structure in which an application of voltage to the liquid crystal layer produces scattering by minute domains of the liquid crystal layer, which enables display in a scattering state and a transmission state without using the polarizer and the diffusing layer.

As shown in FIG. 39, scanning electrodes 2 in stripes provided on a first substrate 1 of the liquid crystal display device are provided with predetermined gap portions 267 in stripes. Portions sandwiched between the gap portions 267 become projecting portions 268, and the portions of the projecting portions 268 become pixel portions.

Further, data electrodes 7 are provided on a second substrate 6 in a direction perpendicular to the scanning electrodes 2 at positions opposing the gap portions 267 to the extent that they may slightly overlap the projecting portions 268.

On the first substrate 1 including the scanning electrodes 2, a first alignment region 261, a second alignment region 262, a third alignment region 263, and a fourth alignment region 264 for alignment in directions different by 90 degrees are provided as an alignment film 16 composed of a silicon oxide (SiOx) film. In this embodiment, the size of each alignment region shall be an area of about two pixels in a rectangular, and four alignment regions shall be provided arranged in mosaic form, but the size and arrangement are not limited to these.

The first alignment region 261 is formed in such a manner that a mask having an opening at a portion corresponding to the alignment region is disposed on the first substrate 1 and the silicon oxide film (SiO) 16 is evaporated in a slanting direction of the first substrate 1 by the vacuum evaporation method. The above evaporation is repeatedly performed four times with the first substrate 1 rotated by 90 degrees using masks for forming the alignment regions so as to form the first to the fourth alignment region.

The above alignment regions in four directions are similarly provided also on the second substrate 6 including the data electrodes 7. The above first substrate 1 and second substrate 6 are bonded together with a sealing material (not shown) with a predetermined gap provided therebetween, and filing the gap with the ferroelectric liquid crystal to form the liquid crystal layer 15, so that the liquid crystal layer 15 has four types of alignments to cause reflection to occur at each boundary therebetween into a scattering state.

Further, as shown in FIG. 40, voltage is applied to the scanning electrode 2 and the data electrode 7 to create oblique electric fields 265 and 266 to the liquid crystal molecules in the liquid crystal layer 15, so that the molecules in the liquid crystal layer 15 move also in the directions of the electric fields so as to enhance scattering intensity.

In the liquid crystal display device having the above-described configuration, the relationship between the applied voltage to the liquid crystal layer 15 and the brightness of display is the same as that of the liquid crystal display device explained in the fourteenth embodiment, and thus the driving waveforms in the standard mode and the power-saving mode which are explained in the fourteenth embodiment are appropriately selected for driving, so as to realize a liquid crystal display device of a scattering type and with a very low power consumption.

It should be noted that although the example without providing a power generating means has been explained in this embodiment, a power generating means may be provided as in the liquid crystal display devices explained in the sixth embodiment and the seventh embodiment to perform driving by the energy supplied therefrom.

Modifications of Embodiments

Although the explanation has been made mainly of the example of performing the whole display rewriting, in which all the scanning electrodes within the display region are sequentially selected to rewrite the display contents of all the pixel portions during periods in one field, in the explanation of each embodiment, it is also possible to perform the partial display rewriting in which only the scanning electrodes corresponding to a display change region where the display contents are updated within the display region are sequentially selected using respective driving signals and the data signals are applied only to the data electrodes corresponding to the region to thereby rewrite a part of the display region.

In this case, the number of scanning electrodes to be selected is small in the case of performing the partial display rewriting as compared to the case of performing the whole display rewriting, so that the period required for rewriting can be decreased even if the selection period for selecting one scanning electrode is increased. Therefore, it is effective that the selection period is made longer when performing the partial display rewriting than when performing the whole display rewriting, so as to perform write by a signal at a low voltage.

In addition, when the whole display rewriting is performed again after the partial display rewriting is performed, it is preferable that a refresh period is provided before the performance of the whole display rewriting to apply the refresh voltage to the liquid crystal layer so as to cancel the unbalance of charge.

Further, the selection period in each driving signal is not limited to the value explained in each embodiment, but it can be appropriately set in accordance with the display contents. In this case, as the selection period is set longer, the optical change in the liquid crystal layer can be induced by a signal with a smaller amplitude, resulting in a reduction in power consumption.

Furthermore, the driving signals in the standard mode and the power-saving mode are not limited to the combinations explained in the embodiments, but necessary signals can appropriately be combined for use. It is not always necessary to make the signals in both modes applicable, and it is naturally adoptable to select the driving signal from a signal group including signals in plural types of standard modes or in plural types of power-saving modes and to apply them. Furthermore, the liquid crystal layer charge memory period is appropriately provided in each driving signal including the driving signal in the standard mode, which makes it possible to perform display with reduced power consumption.

The switching (selection) of the driving signal may be performed at a predetermined time. For example, it is preferable to set the selection period very long and slowly perform rewriting by a small voltage amplitude or to provide the liquid crystal layer charge memory period to hold the display during the time when it is considered that no users are looking at the display such as at night or the like.

Moreover, it is possible to use a chiral nematic liquid crystal other than the ferroelectric liquid crystal for the liquid crystal layer of the liquid crystal display device explained in each embodiment. Further, it is also adoptable to use a scattering type liquid crystal layer composed of the ferroelectric liquid crystal and a transparent solid substance containing the ferroelectric liquid crystal using no polarizer to perform display in a scattering state and a transmission state.

Further, the explanation has been made assuming that the center voltage of the driving signal is 0 V in the explanation of each embodiment, but a signal having the same waveform may be applied by a negative voltage with the maximum voltage being 0 V. If the selection signal and the data signal have the same center voltage, an appropriate voltage value may be set in consideration of simplification of the signal generation circuit and so on.

INDUSTRIAL APPLICABILITY

As has been described, according to a liquid crystal display device of this invention and a driving method of the same, a selection period for selecting a scanning electrode is set in accordance with display contents and the required frequency of update thereof to configure a liquid crystal display device with a remarkably low power consumption.

Especially when there is no need to update the display, the voltage to be applied to the liquid crystal layer is made zero or at least one of the scanning electrode and the data electrode is set at a floating potential, which makes it possible to hold the display with almost no power consumption.

Furthermore, in a liquid crystal display device provided with a power generating element, by selecting the driving waveform for a power consumption in accordance with the amount of power generated by the power generating element and the amount of power stored in a secondary battery, it is possible to configure a self-standing liquid crystal display device which covers all the driving energy only by the generated energy by the power generating element installed in the device.

Such a liquid crystal display device can be used widely for a portable electronic device such as a wristwatch, a cellular phone, a personal digital assistant (PDA), a mobile game machine, or the like, which is strongly required to decrease in size and cannot be provided with a large capacity battery. Further, it is very effective to use the liquid crystal display device for other electronic devices because of a substantial reduction in power consumption.

What is claimed is:

1. A driving method of a liquid crystal display panel in which a liquid crystal layer is sealed between a transparent first substrate formed with a plurality of scanning electrodes and a transparent second substrate formed with a plurality of data electrodes, said electrodes being formed on respective inner faces opposing each other, and portions where said scanning electrodes and data electrodes oppose each other with said liquid crystal layer sandwiched therebetween constitute pixel portions respectively, and which performs display by an electrooptical change having a memory property in said liquid crystal layer at each said pixel portion, wherein selection signals are applied to said plurality of scanning electrodes and a data signal is applied to said data electrode in correspondence with said selection signal of each said scanning electrode to control said individual pixel portion independently, and a plurality of sets of said selection signals having different time lengths of selection periods for selecting one scanning electrode are provided to respectively correspond to different time lengths of a write period for displaying one picture, and selectively applied in accordance with operation state and necessary write frequency of the liquid crystal display panel, as said selection signals, and a liquid crystal layer charge memory period, during which potentials of said scanning electrode and said data electrode are set to a floating potential, is provided after each said pixel portion within a display region of said liquid crystal display panel is selected at least once and display contents thereof are rewritten.

2. The driving method of a liquid crystal display panel according to claim 1, wherein a liquid crystal layer charge memory period, during which potentials of said scanning electrode and said data electrode are set to a floating potential, is provided after each said pixel portion within a display region of said liquid crystal display panel is selected once and display contents thereof are rewritten and further each said pixel portion repeatedly selected and display contents thereof are rewritten a plurality of times.

3. The driving method of a liquid crystal display panel according to claim 1, wherein a voltage amplitude of at least one of said selection signal and said data signal is decreased as said selection period for selecting one scanning electrode by said selection signal is increased.

4. The driving method of a liquid crystal display panel according to claim 1, wherein a potential difference between said selection signal to be applied to said scanning electrode and said data signal to be applied to said data electrode when said selection period for selecting one scanning electrode by said selection signal is short is made larger than a potential difference between said selection signal and said data signal when said selection period is long.

5. The driving method of a liquid crystal display panel according to claim 1, wherein said plurality of selection signals having different selection periods are changed after said pixel portions at least within a predetermined region in said display region of said liquid crystal display panel are selected and display contents thereof are rewritten.

6. The driving method of a liquid crystal display panel according to claim 1, wherein said selection signal and said data signal are generated by electric energy generated by a power generating element or by discharge energy of a storage battery for storing said electric energy, and said selection period for selecting one scanning electrode by said selection signal is changed in accordance with an amount of power generated by said power generating element or an amount of power stored in said storage battery.

7. The driving method of a liquid crystal display panel according to claim 6, wherein said selection period for selecting one scanning electrode by said selection signal is made shorter and a potential difference between said selection signal to be applied to said scanning electrode and said data signal to be applied to said data electrode is made larger when the amount of power generated by said power generating element or the amount of power stored in said storage battery is large than when it is small.

8. The driving method of a liquid crystal display panel according to claim 1, wherein said plurality of selection signals are switched at a set point of time, and one selection signal of said plurality of selection signals has a period during which a potential thereof to said data signal is positive and a period during which the potential is negative in said selection period of one scanning electrode.

9. The driving method of a liquid crystal display panel according to claim 1, wherein one selection signal of said plurality of selection signals has a period during which a potential thereof to said data signal is positive and a period during which the potential is negative in said selection period of one scanning electrode, and assuming that a period from selection of a first scanning electrode to rewrite once display contents of each said pixel portion within said display region of said liquid crystal display panel to reselection of said first scanning electrode to rewrite them the next time is defined as a field, an order of the period during which the potential of said selection signal to said data signal is positive and the period during which the potential is negative is reversed in a field and in the next field.

10. The driving method of a liquid crystal display panel according to claim 1, wherein assuming that a period from selection of a first scanning electrode to rewrite once display contents of each said pixel portion within a display region of said liquid crystal display panel to reselection of said first scanning electrode to rewrite them the next time is defined as a field, each said selection signal applies voltages of the same polarity during said period for selecting each said scanning electrode in a sequential plurality of fields, and thereafter applies voltages of both positive and negative polarities during said period for selecting one scanning electrode in the next field.

11. The driving method of a liquid crystal display panel according to claim 1, wherein in a mode of reducing power consumption, assuming that a period from selection of a first scanning electrode to rewrite once display contents of each said pixel portion within a display region of said liquid crystal display panel to reselection of said first scanning electrode to rewrite them the next time is defined as a field, there are provided a field, in which voltages of one polarity to said data signal are applied as said selection signal during said selection period of said scanning electrode by said selection signal, and a field, in which voltages of both positive and negative polarities are applied, and a refresh period for applying a refresh voltage for canceling unbalance of charge in said liquid crystal layer at the same time to said liquid crystal layer between each of said plurality of scanning electrodes and each of said plurality of data electrodes is provided before said selection period of a first scanning electrode by said selection signal, and voltages of both positive and negative polarities are applied as said refresh voltage by said selection signal and said data signal.

12. The driving method of a liquid crystal display panel according to claim 1, wherein in a mode of reducing power consumption, assuming that a period from selection of a first scanning electrode to rewrite once display contents of each said pixel portion within a display region of said liquid crystal display panel to reselection of said first scanning electrode to rewrite them the next time is defined as a field, there are provided a field, in which voltages of one polarity to said data signal are applied as said selection signal during said selection period of said scanning electrode by said selection signal, and a field, in which voltages of both positive and negative polarities are applied, said selection period of one scanning electrode is made longer in the field, in which said voltages of both positive and negative polarities to said data signal are applied as said selection signal, than in the field, in which said voltages of one polarity are applied, and absolute values of said voltages of both polarities are made equal to absolute values of said voltages of one polarity, and a refresh period for applying a refresh voltage for canceling unbalance of charge in said liquid crystal layer at the same time to said liquid crystal layer between each of said plurality of scanning electrodes and each of said plurality of data electrodes is provided before said selection period of a first scanning electrode by said selection signal, and voltages of both positive and negative polarities are applied as said refresh voltage by said selection signal and said data signal.

13. A driving method of a liquid crystal display panel in which a liquid crystal layer is sealed between a transparent first substrate formed with a plurality of scanning electrodes and a transparent second substrate formed with a plurality of data electrodes, said electrodes being formed on respective inner faces opposing each other, and portions where said scanning electrodes and data electrodes oppose each other with said liquid crystal layer sandwiched therebetween constitute pixel portions respectively, and which performs display by an electrooptical change having a memory property in said liquid crystal layer at each said pixel portion, wherein selection signals are applied to said plurality of scanning electrodes and a data signal is applied to said data electrode in correspondence with said selection signal of each said scanning electrode to control said individual pixel portion independently, and a plurality of sets of said selection signals having different time lengths of selection periods for selecting one scanning electrode are provided to respectively correspond to different time lengths of a write period for displaying one picture, and selectively applied in accordance with operation state and necessary write frequency of the liquid crystal display panel, as said selection signals, and a whole display rewriting and a partial display rewriting are performed, in said whole display rewriting, said selection signal being applied to each of said scanning electrodes constituting all said pixel portions within a display region of said liquid crystal display panel, and said data signal being applied to each said data electrode in correspondence with said selection signal of each said scanning electrode to thereby rewrite display contents of all said pixel portions, and in said partial display rewriting, said selection signals being applied only to said scanning electrodes constituting said pixel portions within a display change region where display contents are changed within said display region, said data signals being applied only to said data electrodes associated therewith respectively, and potentials of said scanning electrodes and said data electrodes constituting said pixel portions except for said display change region being set to a floating potential to thereby rewrite a part of display contents of said display region.

14. The driving method of a liquid crystal display panel according to claim 13, wherein said selection period for selecting one scanning electrode by said selection signal is made longer in said partial display rewriting than in said whole display rewriting.

15. The driving method of a liquid crystal display panel according to claim 14, wherein a potential difference between said scanning electrode to which said selection signal is applied and said data electrode to which said data signal is applied is made smaller in said partial display rewriting than in said whole display rewriting.

16. The driving method of a liquid crystal display panel according to claim 13, wherein when said partial display rewriting is switched to said whole display rewriting, a refresh period for applying a refresh voltage for canceling unbalance of charge in said liquid crystal layer at the same time to said liquid crystal layer between each of said plurality of scanning electrodes and each of said plurality of data electrodes is provided before start of said whole display rewriting, and voltages of both positive and negative polarities are applied as said refresh voltage by said selection signal and said data signal.

17. A liquid crystal display device, comprising:

a liquid crystal display panel in which a liquid crystal layer is sealed between a transparent first substrate formed with a plurality of scanning electrodes and a transparent second substrate formed with a plurality of data electrodes, said electrodes being formed on respective inner faces opposing each other, and portions where said scanning electrodes and said data electrodes oppose each other with said liquid crystal layer sandwiched therebetween constitute pixel portions respectively, and which performs display by an electrooptical change having a memory property in said liquid crystal layer at each said pixel portion; and a liquid crystal display panel drive circuit for applying selection signals to said plurality of scanning electrodes and applying a data signal to said data electrode in correspondence with said selection signal of each said scanning electrode to control said individual pixel portion independently, wherein a plurality of sets of said selection signals having different time lengths of selection periods for selecting one scanning electrode are provided to respectively correspond to different time lengths of a write period for displaying one picture, and selectively applied in accordance with operation state and necessary write frequency of the liquid crystal display panel, as said selection signals, further comprising a power generating element, wherein said liquid crystal display panel drive circuit being a circuit for generating said selection signal and said data signal by electric energy generated by said power generating element or by discharge energy of a storage battery for storing said electric energy, and having a device for changing time lengths of said selection period for selecting one scanning electrode by said selection signal in accordance with an amount of power generated by said power generating element or an amount of power stored in said storage battery.

18. The liquid crystal display device according to claim 17, wherein said power generating element is a photovoltaic element.

19. The liquid crystal display device according to claim 18, wherein said photovoltaic element is provided on a visible side of said liquid crystal display panel and a reflection type polarizer is provided on the visible side of said liquid crystal display panel or opposite side thereto to reflect incident light from outside toward said photovoltaic element by said reflection type polarizer.

20. The liquid crystal display device according to claim 17, wherein said liquid crystal display panel drive circuit has a device for making a potential difference between said selection signal to be applied to said scanning electrode and said data signal to be applied to said data electrode larger when said selection period for selecting one scanning electrode by said selection signal is short than a potential difference between said selection signal and said data signal when said selection period is long, and said liquid crystal display device further comprising an operation member for causing, from outside, said liquid crystal display panel drive circuit to select said selection signal having a different selection period.

21. The liquid crystal display device according to claim 17, wherein said liquid crystal display panel drive circuit has a device for making a potential difference between said selection signal to be applied to said scanning electrode and said data signal to be applied to said data electrode larger when said selection period for selecting one scanning electrode by said selection signal is short than a potential difference between said selection signal and said data signal when said selection period is long as well as for making said potential difference smaller when an amount of power generated by said power generating element is small than when said amount of power generation is large, and an operation member for forcing, from outside, said liquid crystal display panel drive circuit to increase said selection period by said selection signal and decrease said potential difference is provided.

22. A liquid crystal display device, comprising:

a liquid crystal display panel, in which transparent first and second substrates are disposed with inner faces opposing each other, a plurality of scanning electrodes and a plurality of signal electrodes are formed to be perpendicular to each other as well as a pixel electrode is formed for every isolated region surrounded by said scanning electrodes and said signal electrodes on said inner face of one of said substrates, an opposed electrode is formed on said inner face of the other of said substrates, a liquid crystal layer is sealed between said first substrate and said second substrate, and portions where said pixel electrodes and said opposed electrode oppose each other with said liquid crystal layer sandwiched therebetween constitute pixel portions respectively, and a switching element which is ON/OFF controlled by said selection signal applied to each said scanning electrode is provided between said signal electrode and said pixel electrode in the vicinity of an intersection of each said scanning electrode and signal electrode; and a liquid crystal display panel drive circuit for applying selection signals to said plurality of scanning electrodes and applying a data signal to said signal electrode in correspondence with said selection signal of each said scanning electrode to control said individual pixel portion independently, comprising a device for providing a liquid crystal layer charge memory period, during which potentials of said scanning electrode and said data electrode are set to a floating potential, after each said pixel portion within a display region of said liquid crystal display panel is selected at least once and display contents thereof are rewritten, wherein said liquid crystal display panel drive circuit further comprises a device for providing and selectively applying, as said selection signals, a plurality of sets of selection signals having different time lengths of selection periods for selecting one scanning electrode to respectively correspond to different time lengths of a write period for displaying one picture in accordance with operation state and necessary write frequency of the liquid crystal display panel.

23. The liquid crystal display device according to claim 22, wherein each said pixel portion is provided with a storage element connected in series to said switching element and in parallel to said liquid crystal layer constituting said pixel portion.

24. The liquid crystal display device according to claim 23, wherein said storage element is comprised of a capacitor.

25. The liquid crystal display device according to claim 22, wherein said switching element is a thin film transistor with a semiconductor layer of polysilicon.

26. A liquid crystal display device, comprising:

a liquid crystal display panel, in which transparent first and second substrates are disposed with inner faces opposing each other, a plurality of signal electrodes and many pixel electrodes adjacent to said signal electrodes are formed on said inner face of one of said substrates, a plurality of scanning electrodes perpendicular to said signal electrodes and opposing said pixel electrodes are formed on said inner face of the other of said substrates, a liquid crystal layer is sealed between said first substrate and said second substrate, and portions where said pixel electrodes and said scanning electrodes oppose each other with said liquid crystal layer sandwiched therebetween constitute pixel portions respectively, and a switching element is provided between said signal electrode and each said pixel electrode; and a liquid crystal display panel drive circuit for applying selection signals to said plurality of scanning electrodes and applying a data signal to said signal electrode in correspondence with said selection signal of each said scanning electrode to control said individual pixel portion independently, comprising a device for providing a liquid crystal layer charge memory period, during which potentials of said scanning electrode and said data electrode are set to a floating potential, after each said pixel portion within a display region of said liquid crystal display panel is selected at least once and display contents thereof are rewritten, wherein said liquid crystal display panel drive circuit further comprises a device for providing and selectively applying, as said selection signals, a plurality of sets of selection signals having different time lengths of selection periods for selecting one scanning electrode to respectively correspond to different time lengths of a write period for displaying one picture, in accordance with operation state and necessary write frequency of the liquid crystal display panel.

27. The liquid crystal display device according to claim 26, wherein each said pixel portion is provided with a storage element connected in series to said switching element and in parallel to said liquid crystal layer constituting said pixel portion.

28. The liquid crystal display device according to claim 27, wherein said storage element is comprised of a capacitor.

29. The liquid crystal display device according to claim 26, wherein said switching element is a thin film diode comprised of an amorphous silicon film.

* * * * *